US007452645B2

(12) United States Patent
Sugiura

(10) Patent No.: US 7,452,645 B2
(45) Date of Patent: Nov. 18, 2008

(54) TONER FOR DEVELOPING ELECTROSTATIC IMAGE, METHOD FOR PRODUCING THE SAME, DEVELOPER, IMAGE FORMING APPARATUS, PROCESS CARTRIDGE, AND IMAGE FORMING METHOD

(75) Inventor: Hideki Sugiura, Fuji (JP)

(73) Assignee: Ricoh Company, Ltd., Tokyo (JP)

( * ) Notice: Subject to any disclaimer, the term of this patent is extended or adjusted under 35 U.S.C. 154(b) by 476 days.

(21) Appl. No.: 11/181,844

(22) Filed: Jul. 15, 2005

(65) Prior Publication Data

US 2006/0024600 A1 Feb. 2, 2006

(30) Foreign Application Priority Data

Jul. 16, 2004 (JP) ..... 2004-210093

(51) Int. Cl.
*G03G 9/00* (2006.01)

(52) U.S. Cl. ..... 430/108.1; 430/108.3; 430/108.4; 430/108.6; 430/110.1; 430/111.4; 399/252

(58) Field of Classification Search ..... 430/108.1, 430/108.3, 108.4, 108.6, 110.1, 111.4; 399/252
See application file for complete search history.

(56) References Cited

U.S. PATENT DOCUMENTS

| | | | |
|---|---|---|---|
| 6,333,131 | B1 | 12/2001 | Ishiyama et al. |
| 6,455,219 | B1 | 9/2002 | Chen et al. |
| 2003/0152859 | A1 | 8/2003 | Emoto et al. |
| 2004/0067189 | A1 | 4/2004 | Sugiura et al. |
| 2004/0115550 | A1 | 6/2004 | Sugiura et al. |
| 2004/0136763 | A1 | 7/2004 | Murakami et al. |
| 2004/0229143 | A1 | 11/2004 | Umemura et al. |
| 2005/0026064 | A1 | 2/2005 | Sugiura et al. |
| 2005/0058924 | A1 | 3/2005 | Miyakawa |
| 2005/0089787 | A1 | 4/2005 | Uchinokura et al. |

FOREIGN PATENT DOCUMENTS

| | | | |
|---|---|---|---|
| CN | 1310361 | A | 8/2001 |
| CN | 1416024 | A | 5/2003 |
| CN | 1487372 | A | 4/2004 |
| CN | 1490683 | A | 4/2004 |
| CN | 1495548 | A | 5/2004 |
| EP | 0 631 195 | | 12/1994 |
| EP | 0 977 092 | A2 | 2/2000 |

(Continued)

OTHER PUBLICATIONS

Database WPI, AN 2000-444895, XP-002340622, JP 2000-122336 A, Apr. 28, 2000.

*Primary Examiner*—Mark A Chapman
(74) *Attorney, Agent, or Firm*—Oblon, Spivak, McClelland, Maier & Neustadt, P.C.

(57) ABSTRACT

A toner is disclosed, for developing electrostatic images by means of image forming apparatuses, that comprises toner particles, and an external additive, wherein the toner particles comprise a binder resin and a colorant, the external additive is introduced onto the surface of the toner particles, the external additive liberates from the surface of the toner particles in a rate of 7% to 50% under the condition that the toner is dispersed within a surfactant-containing electrolyte at 20 W output power and 20 kHz frequency for one minute by means of an ultrasonic homogenizer.

45 Claims, 16 Drawing Sheets

FOREIGN PATENT DOCUMENTS

| | | | |
|---|---|---|---|
| EP | 1 239 334 | A1 | 9/2002 |
| EP | 1 276 017 | A2 | 1/2003 |
| EP | 1 394 622 | A2 | 3/2004 |
| EP | 1 398 673 | A2 | 3/2004 |
| EP | 1 502 933 | A2 | 2/2005 |
| EP | 1 505 453 | A1 | 2/2005 |
| JP | 2000-122336 | | 4/2000 |
| JP | 3129074 | | 11/2000 |
| JP | 2002-244314 | | 8/2002 |
| JP | 2002-351129 | | 12/2002 |
| JP | 2003215837 | | 7/2003 |
| JP | 2004-102236 | | 4/2004 |
| JP | 2004-246345 | | 9/2004 |

TONER FOR DEVELOPING ELECTROSTATIC IMAGE, METHOD FOR PRODUCING THE SAME, DEVELOPER, IMAGE FORMING APPARATUS, PROCESS CARTRIDGE, AND IMAGE FORMING METHOD

BACKGROUND OF THE INVENTION

Field of the Invention

The present invention relates to toners for developing electrostatic latent images utilized in image forming apparatuses such as copiers, facsimiles, and printers; and process cartridges and image forming apparatuses that utilize the toners.

In image forming processes such as electrophotographic, electrostatic recording, and electrostatic printing processes, typically, toners are deposited as a developer on image bearing members such as photoconductors on which an electrostatic latent image has been formed in developing step, the toners are transferred on transfer media such as transfer paper from the photoconductors in transferring step, then the toners are fixed on the transfer media. Generally, developers are classified into two-component developers and monocomponent developers; for example, the two-component developers contain a magnetic carrier and a toner, whereas the monocomponent developers contain no magnetic carrier.

Conventionally, dry toners have been commercially employed that are produced by melting and kneading a binder such as of styrene resins and polyester resins and a colorant to prepare a mixture, then milling finely the mixture. The toners have been small-sized and spherically-shaped for forming highly fine and precise color images under the demand for high quality images; namely small-sized toners may lead to higher dot-reproducibility, and spherically-shaped toners may improve developing and transferring properties.

Generally, toners containing a binder resin have a volume average particle diameter of approximately 10 μm or so, and contain an external additive of organic and/or inorganic fine particles so as to enhance transporting and/or mixing abilities. Inorganic fine particles such as silica, alumina, and titanium oxide are typically mixed and deposited onto toner particles by way of dry-mixing using a mixer and the like.

However, inorganic fine particles added externally to toners tend to impregnate into toners and to lower the flowability, thus deteriorating the supplying, developing, and charging properties. Further, inorganic fine particles, mixed insufficiently with toners, often migrate from the toners and deposit on various sites within image forming apparatuses, alternatively adhere to image bearing members such as photoconductors, possibly causing filming to which toners adhere firmly.

In addition, processes for producing toner particles in liquid phases such as suspension, emulsion, or dispersion polymerization processes have been investigated to produce small-sized and spherically-shaped toners for forming highly fine and precise color images. However, the spherically-shaped toners typically suffer from inferior cleanability since such toners easily roll on photoconductors and run through cleaning blades of elastomer.

In order to solve these problems, Japanese Patent Application Laid-Open (JP-A) Nos. 2002-244314 and 2002-351129 disclose a toner that is produced on the base of optimum free rate of additives within the toner, in which the rate is calculated by means of a particle analyzer. However, the detection sensitivity is typically insufficient for distinguishing slight differences in terms of remaining amounts and/or free amounts of additives; the calculation process is impossible to design optimum control range when the adhesion to the matrix is poor as is the case that silica with a large particle diameter is employed as the additive.

Japanese Patent No. 3129074 and JP-A No. 2000-122336 disclose a toner that is produced through evaluating additives by use of an ultrasonic homogenizer. These proposals may represent certain effects to stabilize electric charge of toners and to decrease filming on photoconductors; however, the decrease of filming and the improvement of cleaning ability are not satisfactory at the same time in general.

The term "filming" of toners as used herein means films formed on photoconductors in a process that wax and/or resin of toner adheres onto surface of photoconductors at first, paper powder adheres to the wax and/or resin, and ionic materials absorb to the paper powder in a wet condition, consequently forming a rigid film on the surface of photoconductors. The occurrence of the filming tends to yield image deletion.

In order to address the filming, a cleaning blade may simply scrape ionic substance such as ammonium nitride and/or the filming on the photoconductor, thereby abnormal wear of photoconductors and occurrence of image deletion may be prevented and the image quality may be maintained. However, the employment of cleaning blades typically leads to abrasion wear of photoconductors as high as 2 μm to 3 μm per 100,000 rounds, thus the photoconductors suffer from lower durability and shorter lifetime in spite of the improved image quality.

Other proposals are disclosed in which hardness and wear resistance of surface layer of photoconductors are increased to suppress the abrasion wear, thereby leading to higher durability and prolonged lifetime of photoconductors. Addition of fillers such as of metal oxides may effectively enhance the wear resistance. However, the increased hardness and wear resistance of surface layer may lead to insufficient scraping of the surface layer of photoconductors along with the ionic substance such as ammonium nitride and/or toner filming on the photoconductor, thus the abnormal wear of photoconductors and image deletion may not be prevented satisfactorily, resulting in decrease of image quality.

Further, when photoconductors with higher hardness and wear resistance of surface layer are employed in order to achieve higher durability and prolonged lifetime of photoconductors, an additional means or device should be provided for removing ionic substance such as ammonium nitride and/or toner filming on the photoconductor. The additional means or device is one that raises pressure of a cleaning blade onto a photoconductor at predetermined timing; however, smaller space around the photoconductor rejects the placement of such a means or device in general.

Further, such electrophotographic image forming apparatuses are conventional that are equipped with a drum heater within the photoconductor in order to prevent image deletion in photoconductors with higher durability and lower wear abrasion. It has been confirmed that heating of photoconductors may suppress the occurrence of image deletion. However, the placement of the drum heater inevitably leads to larger size of the photoconductor, thus is not suited to small-diameter photoconductors that are mainly employed in current commercial market.

As described above, conventional organic photoconductors generally exhibit shorter lifetime owing to abrasion of photoconductor surface. Furthermore, wear resistance is essentially demanded for photoconductors since higher pressure is applied from the cleaning blade. In order to solve the problem, inorganic fillers may be introduced into the outer-most layer of photoconductors, thereby surface hardness are raised and lifetime are prolonged. However, it has been experienced that the higher surface hardness and longer lifetime also encounter with filming, since the photoconductors cannot have the scraping effect in the previous photoconductors.

As such, higher cleaning ability essentially requires higher blade pressure, which also requires essentially addition of filler such as silica with larger particle diameters; however, the improved wear resistance has encountered with filming on photoconductors.

JP-A No. 2003-215837 discloses a composition that additionally contains silica with a large particle diameter, of which the concept is different from the present invention that filming is suppressed while maintaining the cleanability and wear resistance of photoconductors.

SUMMARY OF THE INVENTION

It is an object of the invention to provide a toner that affords less filming and superior cleanability of photoconductors by way of controlling free amount of an external additive contained in the toner. The other objects will be apparent from the following descriptions.

In an aspect of the present invention, a toner for developing an electrostatic image is provided that comprises toner particles, and an external additive, wherein the toner particles comprise a binder resin and a colorant, the external additive is introduced onto the surface of the toner particles, and the external additive liberates from the surface of the toner particles in a rate of 7% to 50% based on the external additive under the condition that the toner is dispersed within a surfactant-containing electrolyte at 20 W output power and 20 kHz frequency for one minute by means of an ultrasonic homogenizer.

In another aspect of the present invention, a method of producing a toner for developing an electrostatic image is provided that comprises preparing a composition that contains a binder resin and a colorant, and adding at least two species of inorganic fine particles to the composition, wherein at least the species of inorganic fine particles having a larger average primary-particle diameter is added to the composition within an aqueous medium that contains a surfactant of which the polarity is different from the polarity of the group attached to the exposed surface of the composition.

In still another aspect of the present invention, a two-component developer for developing an electrostatic image formed on a photoconductor is provided that comprising a toner for developing an electrostatic image, and a magnetic carrier, wherein the toner contains toner particles that comprise a binder resin and a colorant, and an external additive that is introduced onto the surface of the toner particles, and the external additive liberates from the surface of the toner particles in a rate of 7% to 50% under the condition that the toner is dispersed within a surfactant-containing electrolyte at 20 W output power and 20 kHz frequency for one minute by means of an ultrasonic homogenizer.

In still another aspect of the present invention, a monocomponent developer for developing an electrostatic image formed on a photoconductor is provided that comprises a toner for developing an electrostatic image, wherein the toner contains toner particles that comprise a binder resin and a colorant, and an external additive that is introduced onto the surface of the toner particles, and the external additive liberates from the surface of the toner particles in a rate of 7% to 50% under the condition that the toner is dispersed within a surfactant-containing electrolyte at 20 W output power and 20 kHz frequency for one minute by means of an ultrasonic homogenizer.

In still another aspect of the present invention, an image forming apparatus is provided that comprises a photoconductor, a charging unit configured to charge the photoconductor uniformly, an exposing unit configured to expose the charged photoconductor depending on image data to form an electrostatic latent image, a developing unit configured to develop the electrostatic latent image by means of a developer to form a toner image, a transferring unit configured to transfer the toner image onto a transfer material, and a cleaning unit configured to clean the surface of the photoconductor, wherein the toner contains toner particles that comprise a binder resin and a colorant, and an external additive that is introduced onto the surface of the toner particles, and the external additive liberates from the surface of the toner particles in a rate of 7% to 50% under the condition that the toner is dispersed within a surfactant-containing electrolyte at 20 W output power and 20 kHz frequency for one minute by means of an ultrasonic homogenizer.

In still another aspect of the present invention, a process cartridge is provided that comprises a photoconductor, and a developing unit configured to develop an electrostatic latent image by means of a developer to form a toner image, wherein the process cartridge is detachably attached to an mage forming apparatus to form a unitary construction, the toner contains toner particles that comprise a binder resin and a colorant, and an external additive that is introduced onto the surface of the toner particles, and the external additive liberates from the surface of the toner particles in a rate of 7% to 50% under the condition that the toner is dispersed within a surfactant-containing electrolyte at 20 W output power and 20 kHz frequency for one minute by means of an ultrasonic homogenizer.

In still another aspect of the present invention, an image forming method is provided that comprises charging a photoconductor, exposing the charged photoconductor to form an electrostatic latent image, developing an electrostatic latent image by means of a developer to form a toner image, and transferring the toner image onto a transferring material, wherein the toner contains toner particles that comprise a binder resin and a colorant, and an external additive that is introduced onto the surface of the toner particles, and the external additive liberates from the surface of the toner particles in a rate of 7% to 50% under the condition that the toner is dispersed within a surfactant-containing electrolyte at 20 W output power and 20 kHz frequency for one minute by means of an ultrasonic homogenizer.

The toner, the method for producing the toner, the two-component developer, the monocomponent developer, the image forming apparatus, the process cartridge, and the image forming method may provide photoconductors with less filming and superior cleanability, thus may provide images with superior high quality.

DESCRIPTION OF THE PREFERRED EMBODIMENTS

Figure 1A:
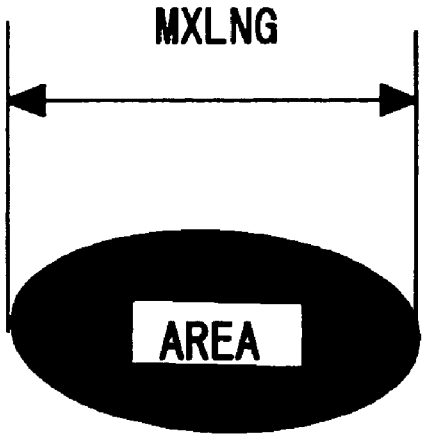
FIG. 1A is a schematic view of a toner particle to explain a circularity factor SF-1.

The present invention will be explained with reference to the preferred embodiments, to which the present invention is not to be limited, since those skilled in the art may easily change or modify them within the scope of the present invention defined in claims.

The electrophotographic toner comprises a binder resin and a colorant, and also an external additive on the surface of toner particles.

We found that the filming occurrence significantly depends on toner species. Accordingly, we have concerned with the effect of toner properties on filming, in particular, we have investigated the properties of external additives since we have experienced that external additives significantly affect the filming.

As a result, we have concluded that free amount of additives in the toner should be controlled for satisfactory filming property as well as cleaning property. Specifically, a stress is applied to the toner in water by an ultrasonic homogenizer, thereby the additives are caused to desorb, then the remaining rate, the absorptive affinity, and free rate are determined. Specific procedures were as follows so as to minimize the fluctuation owing to operators and other environmental factors:

(i) a mixture of 0.5 ml of drywell as a surfactant, 100 ml of Isoton as an electrolyte, and 4 g of toner was hand-shaken 50 times, then was allowed to stand for one hour or more;

(ii) the mixture was further hand-shaken 30 times, then was dispersed for 1 minute by means of an ultrasonic homogenizer in following conditions, i.e. output power: 20 W (watt), vibration period: 60 second non-stop, amplitude: 20 W (39%), temperature at vibration start: 23±1.5° C.;

(iii) the dispersion was filtered by means of a filter having a pore size of 1 μm, the additive desorbed from the toner was removed, then the toner was dried; and (iv) the additive amount in the toner was determined by fluorescent X-ray analysis in terms of before and after the removal of the additive, thereby the desorbed rate or amount of the additive was obtained.

When the rate of free external additive is 7% to 50% that is an index to express the tendency to liberate, and the amount of free external additive is 0.1 part to 0.7 part based on 100 parts of toner that is an index for the amount to display the function, the filming may be suppressed and the cleanability may be enhanced.

When the rate of free external additive is 7% or less, the tendency to liberate is insufficient, the dam effect is likely to be poor at cleaning photoconductors, thus the cleanability may be insufficient. When the rate of free external additive is 50% or more, the external additive is excessively liberate thus promoting the filming, resulting in insufficient reduction of filming.

In order to reduce the filming due to deposition onto the photoconductor as well as to enhance the cleaning ability due to deposition on the tip of cleaning blade so as to prevent the pass-through of toner, the rate of free external additive is limited to 7% to 50%.

Further, when the amount of free external additive is less than 0.1 part based on 100 parts of toner, the amount of the free external additive to liberate and perform is insufficient, resulting in inappropriate flowability and charge stability. When the amount of free external additive is more than 0.7 part based on 100 parts of toner, sufficient flowability may be provided. However, the high amount of free external additive may induce filming, deteriorate fixing property, transfer property, image sharpness, and graininess, and also may adversely affect on smear of charge roller, charge uniformity, and image uniformity with time.

The term "toner" as used herein of "based on 100 parts of toner" described above means the entire toner that contains toner particles and external additives such as inorganic fine particles, charge control agent, and others.

Examples of inorganic fine particles as external additives incorporated into the toner according to the present invention include metal oxides, metal nitrides, and metal carbides such as silica, alumina, barium titanate, magnesium titanate, calcium titanate, strontium titanate, ferrous oxide, copper oxide, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide, and silicon nitride. Among these, silica, alumina, and titanium oxide are more preferable, in particular silica is most preferable. In the present invention, external additives having a number-average particle diameter of 8 nm to 80 nm and those having a number-average particle diameter of 120 nm to 300 nm are preferably utilized.

Further, the organic fine particles may be an external additive having a number-average particle diameter of 120 nm to 300 nm. When the number-average particle diameter is less than 80 nm, the external additive may not provide sufficient resistance against thermal and/or mechanical shock, and when it is more than 500 nm, the fixing ability may be lowered owing to less contacting area of toner with other materials, and also the flowability tends to decrease significantly. As such, the primary-particle diameter of the inorganic fine particles as an external additive is preferably 80 nm to 500 nm in order to improve cleanability as well as to prevent the filming.

The process to blend the external additives into toners may be properly selected; for example an external additive of toner may be subjected to a dry mixing using a mixer, in which the toner particles and the inorganic particles are stirred and mixed while being deflocculated. Preferably, the external additives such as inorganic fine particles and/or resin fine particles are uniformly and firmly adhered onto the toner particles in the blending process.

The means for treating the inorganic fine particles may be mixers such as Henschel mixer and Q mixer that can easily control the remaining rate of the inorganic fine particles through revolution number of blades and mixing period, for example.

Wet mixing may be available to deposit inorganic fine particles onto toner particles in a liquid medium. Such a wet process is suited for deposition of external additives in that the external additives may firmly adhere onto the toner particles, and the remaining rate may be easily adjusted by the amount of surfactants.

In the wet process, the intended process may be carried out after the toner particles are dispersed into an aqueous medium and the existing surfactant is removed by a rinsing step. For example, the residual surfactant in the aqueous medium is removed through a solid-liquid separation step such as filtration and centrifuging, then the resulting cake or slurry is dispersed again into an aqueous medium, to which inorganic fine particles are dispersed or to which previously dispersed inorganic fine particles are added. A surfactant, dispersed previously into the aqueous medium, having reverse polarity with the inorganic fine particles may allow efficient adhesion of the inorganic fine particles onto the surface of toner particles. When the inorganic fine particles are hardly dispersible due to hydrophobic-treatment, small amount of alcohol may afford proper dispensability of the inorganic fine particles by virtue of lowered surface tension, then the surfactant solution having the reverse polarity is added slowly under stirring. The amount of the surfactant having the reverse polarity is 0.01 to 1% by mass based on the solid content of the toner particles. The addition of the surfactant having the reverse polarity may neutralize the charge of inorganic fine particles in the form of aqueous dispersion, thereby the inorganic fine particles may flocculate and deposit on the surface of the inorganic fine particles. The amount of the inorganic fine particles is preferably 0.01% by mass to 5% by mass based on the solid content of the toner particles.

The inorganic fine particles deposited on the surface of the toner particles may be firmly fixed to the toner particles through the following heat treatment, thereby the inorganic fine particles may hardly separate from the toner particles. Preferably, the heat treatment is carried out at temperatures higher than Tg of the resin in the toner. The heat treatment may be carried out after drying while preventing the flocculation of toner particles.

In some cases, a lubricant may be added to lower the friction coefficient with the photoconductor thereby to improve the cleanability. The lubricant is exemplified by metal stearates such as zinc stearate.

Examples of the anionic surfactant include alkylbenzene sulfonates, α-olefin sulfonates, and phosphoric esters.

Examples of the cationic surfactant include alkylamine salts, amino alcohol fatty acid derivatives, polyamine fatty acid derivatives, imidazoline, and other amine salts cationic surfactants, alkyltrimethylammonium salts, dialkyldimethylammonium salts, alkyldimethylbenzylammonium salts, pyridinium salts, alkylisoquinolinum salts, benzethonium chloride, and other quaternary ammonium salts.

Examples of the amphoteric surfactant include fatty acid amide derivatives, polyhydric alcohol derivatives, and other nonionic surfactants, alanine, dodecyldi(aminoethyl)glycine, di(octylaminoethyl)glycine, and N-alkyl-N,N-dimethylammoniumbetaines.

Preferably, the average circularity of toner particles is 0.92 or more in the toner according to the present invention, more preferably is 0.93 or more, still more preferably is 0.94 or more from viewpoint of higher image quality owing to superior dot reproducibility and proper transfer property. The toners with an average circularity of less than 0.92 i.e. less-spherical shape tend to hardly bring about sufficient transfer property and high quality images. The circularity of the toner is a value obtained by optically detecting toner particles, and the circumferential length of a circle which has an area equivalent to the projection area of the toner is divided by a circumferential length of an actual toner particle. Specifically, the average circularity of the toner is measured using a flow particle image analyzer (FPIA-2000; manufactured by Sysmex Corp.). To a given vessel, 100 ml to 150 ml of pure water with is placed, 0.1 ml to 0.5 ml of a surfactant is added as a dispersant, and about 0.1 g to 9.5 g of toner is further added. The suspension with the sample dispersed therein was subjected to a dispersion for about 1 minute to 3 minutes using an ultrasonic dispersing apparatus to make a concentration of the dispersant 3,000/μL to 10,000/μL to measure the shape and distribution of the toner.

Preferably, the toners according to the present invention have an volume average particle diameter of 3 μm to 8 μm, the ratio of (Dv/Dn) is 1.00 to 1.40, wherein Dv means a volume average particle diameter and Dn means a number average particle diameter.

In general, toners having a smaller particle diameter may deposit precisely over latent images. However, when a volume average diameter is smaller than the minimum diameter of the present invention, and when used as a two-component developer, the toner fuses on the surface of magnetic carriers in a long period of stirring in an image developing apparatus, and it makes charging abilities of the magnetic carriers lowered, and when used as a monocomponent developer, toner-filming to a developing roller and toner fusion onto a member such as a blade for making a toner have a thin layer, are liable to occur.

On the other hand, when the toner volume average particle diameter is greater than the upper limit of the present invention, it becomes harder to obtain a high-resolution and high quality image, and it is often the case that toner particle diameter largely varies when toner inflow/outflow being performed in a developer.

Further, narrower particle diameter distribution may lead to uniform distribution of toner charge and thus high quality images with less fog of background, and also higher transfer rate. However, when Dv/Dn exceeds 1.40, the charge distribution often comes to more broad, and the resolution tends to decrease.

The average particle diameter and the particle diameter distribution of toners can be measured using Coulter Counter TA-II, and Coulter Multi-sizer II (by Beckman Coulter, Inc.). In the present invention, the average particle diameter and the particle diameter distribution are measured by using Coulter Counter TA-II model and by connecting it to an interface (by The Institute JUSE) and a personal computer (PC9801, by NEC Co.) which outputs a number distribution and a volume distribution. The electrolyte is prepared as 1% NaCl aqueous solution from 1st grade reagent of sodium chloride.

The measurement procedure is as follows, i.e. to the electrolyte of 50 ml to 100 ml is added a dispersant such as alkyl benzene sulfonate in an amount of 0.1 ml to 5 ml, then 1 mg to 10 mg of the sample is added. The mixture is dispersed for one minute by means of an ultrasonic-dispersing device. To another beaker is added 100 ml to 200 ml of the electrolyte aqueous solution, into which the sample dispersion is added in a predetermined concentration, then by means of the Coulter Counter TA-II, 30,000 particles each having a particle diameter of 2 μm to 40 μm are determined in terms of the volume-based diameter distribution and number-based diameter distribution using an aperture of 100 μm, and the volume-average particle diameter is determined.

Preferably, the rate of toner particles having a diameter of 3 μm or less is 10% by mass or less within the toners according to the present invention from the viewpoint of higher image quality. Higher rate of fine particles, having a diameter of 3 μm or less, such as above 10% may lead to disadvantageous effects e.g. smear of photoconductors, toner scattering within apparatuses, and the like.

Figure 1B:
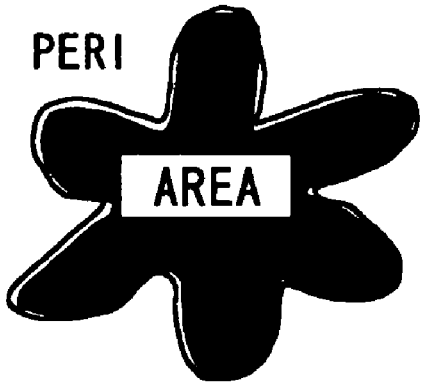
FIG. 1B is a schematic view of a toner particle to explain a circularity factor SF-2.

Preferably, the toner according to the present invention represents a circularity factor SF-1 of 100 to 180 and a circularity factor SF-2 of 100 to 180. FIGS. 1A and 1B are schematic views of a toner particle to explain circularity factors SF-1 and SF-2. Circularity factor SF-1 represents a circular level of toner shape, which is calculated from Equation (1), in which the maximum length MXLNG (see FIG. 1A) of the toner image projected on two-dimensional plane is squared, then divided by the area value of AREA and multiplied by 100π/4.

$$SF\text{-}1=\{(\mathrm{MXLNG})^2/\mathrm{AREA}\}\times(100\pi/4) \qquad \text{Equation (1)}$$

The value of 100 in Circularity factor SF-1 corresponds to exact spherical shape, the larger is the SF-1 the shape is more different from exact spherical shape.

Circularity factor SF-2 represents an irregular level of a toner shape, which is calculated from Equation (2), in which the peripheral length PERI (see FIG. 1B) of the toner image projected on two-dimensional plane is squared, then divided by the area value of AREA and multiplied by 100/4π.

$$SF\text{-}2=\{(\mathrm{PERI})^2/\mathrm{AREA}\}\times(100/4\pi) \qquad \text{Equation (2)}$$

The value of 100 in Circularity factor SF-2 corresponds to non-irregular shape, the larger is the SF-2 the more irregular is the shape.

When the toner shape is similar to sphere, the contact area between toner particles or between toner particles and photoconductors comes to narrow like a spot contact; consequently, the adsorptivity comes to lower between toner particles, the flowability comes to higher, the adsorptivity comes to lower between toner particles and photoconductors, and the transfer rate comes to higher. On the other hand, SF-1 and SF-2 preferably have a somewhat higher value from the viewpoint that spherical toner particles easily enter into a space between cleaning blades and photoconductors. However, excessively large values with respect to SF-1 and SF-2 tend to bring about lower image quality due to higher toner scatter on images, thus SF-1 and SF-2 are preferred to be no more than 180.

Specifically, SF-1 and SF-2 are determined by way of taking pictures using Scanning Electron Microscope S-800 (by Hitachi, Ltd.) and analyzing the pictures using Image Analyzer LUSEX3 (by Nireco Co.).

The toner raw particles in the present invention comprises a binder resin, colorant, and releasant, and may be produced through, but not limited to, milling the mixture of raw materials, or polymerization such as suspension polymerization, emulsion polymerization, dispersion polymerization, emulsion flocculation, emulsion coagulation, and the like. Preferably, the toner according to the present invention has a relatively small particle diameter and is approximately spherical in order to provide highly precise and fine images. Such a toner may be produced through suspension polymerization, emulsion polymerization, or polymer suspension process by way of emulsifying, suspending, or flocculating an oil phase within an aqueous medium, for example. More specifically, toners may be produced in the following way using materials and additives described below.

(Suspension Polymerization Process)

A polymerizable monomer, oil-soluble polymerization initiator, colorant, releasant, surfactant, solid dispersant, and the like are dispersed in an aqueous medium to emulsify these ingredients. The particle diameter of the releasant may be controlled by the velocity to stir for dispersing the releasant, temperature, and the like. Then, particles are formed through polymerization reaction, and inorganic fine particles are adhered to the surface of toner particles under a wet condition. Preferably, the toner particles are surface-treated after the excessive surfactant and the like are rinsed and removed. A functional group may be introduced onto the surface of toner particles by use of polymerizable monomers such as organic acids e.g. acrylic acid, methacrylic acid, α-cyanoacrylic acid, α-cyanomethacrylic acid, itaconic acid, crotonic acid, fumaric acid, maleic acid, and maleic anhydride; acrylamide, methacrylamide, diacetone acrylamide, and methylol compounds thereof; vinylpyridine, vinylpyrrolidone, vinylimidazole, and ethyleneimine; methacrylate of acrylate compounds containing an amino group such as dimethylamino ethylmethacrylate. Further, a functional group may be introduced onto the surface of particles by adsorbing a dispersant containing an acid or basic group.

(Emulsion Polymerization Flocculation Process)

A latex may be synthesized by a conventional emulsifying-polymerizing process using a polymerizable monomer, water-soluble polymerization initiator, and surfactant in an aqueous medium. Separately, an aqueous dispersion containing a colorant, releasant, and the like are prepared of which the size is controlled. The latex and the dispersion are mixed, flocculated to a toner-size, and heated to fuse thereby to produce a toner, then the toner is treated with inorganic fine particles under a wet condition. The polymerizable monomers utilized to produce a latex by a suspension polymerization are available to produce a functional group onto the surface of toner particles.

(Polymer Suspension Process)

Aqueous media for use in the present invention may comprise water alone or in combination with an organic solvent that is miscible with water. Such miscible organic solvents include, but are not limited to, alcohols such as methanol, isopropyl alcohol, and ethylene glycol; dimethylformamide, tetrahydrofuran; cellosorves such as methyl cellosolve; and lower ketones such as acetone and methyl ethyl ketone. Into the oil phase of volatile solvent of the toner composition, dissolved or dispersed are a resin, prepolymer, colorant such as a pigment, releasant having a controlled particle diameter, charge control agent, and the like. The oil phase of the toner composition is dispersed into an aqueous medium with a surfactant, solid dispersant, or the like to react the prepolymer thereby to produce particles, thereafter the particles are treated with inorganic fine particles under a wet condition.

(Dry Milling)

As for the dry milling process, a toner may be produced by mechanically mixing raw materials containing at least a binder resin, charge control agent, and colorant, melting and kneading the raw materials, then milling and classifying the mixture. The colorant may be utilized as a component of masterbatch in order to enhance the dispersibility of the colorant, and the masterbatch is blended with the other materials in the following step.

The mechanical mixing may be carried out by a conventional process using a mixer with stirring blades, for example, then the mixture is melted and kneaded within a melting-kneading apparatus. The melting-kneading apparatus may be a single-screw or double-screw continuous kneader or a batch kneader such as a roll mill and Banbury mixer. Specifically, Model KTK double screw extruder (by Kobe Steel, Ltd.), Model TEM double screw extruder (by Toshiba Machine Co.), extruders (by KCK Co.), Model PCM double screw extruder (by Ikegai Tekko Co.), Model KEX double screw extruder (by Kurimoto, Ltd.), and continuous kneaders (by Buss Co.) are employed. The resulting melted and kneaded product is subjected to milling after cooled. The milling is carried out through coarsely billing by means of a hammer mill, Raut Plex, and the like and finely milling by means of a jet mill and other mechanical grinder. Preferably, the milling is carried out into an average particle diameter of 3 μm to 15 μm, then the milled product is classified for adjusting the particle diameter distribution. Then, external additives are added to toner particles; the addition is carried out through stirring and mixing the toner particles and external additives by means of a mixer to coat the surface of the toner particles with the external additives.

The components of toner according to the present invention and the production method thereof will be explained in the following.

(Modified Polyester)

The toner of the present invention comprises a modified polyester (i) as a binder resin. A modified polyester indicates a polyester in which a combined group other than ester bond may reside in a polyester resin, and different resin components are combined into a polyester resin through covalent bond, ionic bond or the like. Specifically, a modified polyester is one that a functional group such as an isocyanate group or the like, which reacts to a carboxylic acid group and a hydrogen group, is introduced to a polyester end and further reacted to an active hydrogen-containing compound to modify the polyester end.

Examples of the modified polyester (i) include a urea modified polyester which is obtained by a reaction between a polyester prepolymer (A) having an isocyanate group and amines (B). Examples of the polyester prepolymer (A) having an isocyanate group include a polyester prepolymer which is a polycondensation polyester of a polyvalent alcohol (PO) and a polyvalent carboxylic acid (PC) and having an active hydrogen group is further reacted to a polyvalent isocyanate compound (PIC). Examples of the active hydrogen group included into the above-noted polyester include a hydroxyl group (an alcoholic hydroxyl group and a phenolic hydroxyl group), an amino group, a carboxyl group, and a mercapto group. Among these groups, an alcoholic hydroxyl group is preferable.

A urea-modified polyester is formed in the following manner.

Examples of the polyvalent alcohol compound (PO) include a divalent alcohol (DIO), and a trivalent or more polyvalent alcohol (TO), and any of a divalent alcohol (DIO) alone and a mixture of a divalent alcohol (DIO) with a small amount of a polyvalent alcohol (TO) are preferable. Examples of the divalent alcohol (DIO) include alkylene glycols such as ethylene glycol, 1,2-propylene glycol, 1,3-propylene glycol, 1,4-bytandiol, and 1,6-hexanediol; alkylene ether glycols such as diethylene glycol, triethylene glycol, dipropylene glycol, polyethylene glycol, polypropylene glycol, and polytetramethylene ether glycol; alicyclic diols such as 1,4-cyclohexane dimethanol, and hydrogenated bisphenol A; bisphenols such as bispheonol A, bisphenol F, and bisphenol S; alkylene oxide adducts of the above-noted alicyclic diol such as an ethylene oxide, a propylene oxide, and a butylene oxide; and alkylene oxide adducts of the above-noted bisphenols such as an ethylene oxide, a propylene oxide, and a butylene oxide. Among the above mentioned, an alkylene glycol having carbon number 2 to 12 and an alkylene oxide adduct of bisphenols are preferable, and an alkylene oxide adduct of bisphenols and a combination of the adduct with an alkylene glycol having carbon number 2 to 12 are particularly preferable. Examples of the trivalent or more polyvalent alcohol (TO) include a polyaliphatic alcohol of trivalent to octavalent or more such as glycerine, trimethylol ethane, trimethylol propane, pentaerythritol, and sorbitol; and trivalent or more phenols such as trisphenol PA, phenol novolac, and cresol novolac; and alkylene oxide adduct of the trivalent or more polyphenols.

Examples of the polyvalent carboxylic acid (PC) include a divalent carboxylic acid (DIC) and a trivalent or more polyvalent carboxylic acid (TC), and any of a divalent carboxylic acid (DIC) alone and a mixture of a divalent carboxylic acid (DIC) with a small amount of a polyvalent carboxylic acid (TC) are preferable. Examples of the divalent carboxylic acid (DIC) include an alkylene dicarboxylic acid such as succinic acid, adipic acid, and sebacic acid; an alkenylen dicarboxylic acid such as, maleic acid, and fumaric acid; an aromatic dicarboxylic acid such as phthalic acid, isophthalic acid, terephthalic acid, and naphthalene dicarboxylic acid. Among these divalent carboxylic acids, an alkenylen dicarboxylic acid having carbon number 4 to 20 and an aromatic dicarboxylic acid having carbon number 8 to 20 are preferable. Examples of the trivalent or more polyvalent carboxylic acid (TC) include an aromatic polyvalent carboxylic acid having carbon number 9 to 20 such as trimellitic acid, and pyromellitic acid. It is noted that as a polyvalent carboxylic acid (PC), an acid anhydride from among the polyvalent carboxylic acids or a lower alkyl ester such as methyl ester, ethyl ester, and isopropyl ester may be used to react to a polyvalent alcohol (PO).

A ratio of a polyvalent alcohol (PO) to a polyvalent carboxylic acid (PC), defined as an equivalent ratio [OH]/[COOH] of a hydroxyl group [OH] to a carboxyl group [COOH], is typically 2/1 to 1/1, preferably 1.5/1 to 1/1, and more preferably 1.3/1 to 1.02/1.

Examples of the polyvalent isocyanate compound (PIC) include an aliphatic polyvalent isocyanate such as tetramethylen diisocyanate, hexamethylen diisocyanate, and 2,6-diisocyanate methyl caproate; an alicyclic polyisocyanate such as isophorone diisocyanate, and cyclohexyl methane diisocyanate; an aromatic diisocyanate such as tolylene diisocyanate, and diphenylmethane diisocyanate; an aromatic aliphatic diisocyanate ($\alpha,\alpha,\alpha',\alpha'$-tetramethyl xylylene diisocyanate, and the like); isocyanates; a compound in which the above noted polyisocyanate is blocked with a phenol derivative, an oxime, caprolactam, and the like; and a combination of two or more elements thereof.

A ratio of a polyvalent isocyanate compound (PIC), defined as an equivalent ratio [NCO]/[OH] of an isocyanate group [NCO] to a hydroxyl group [OH] of a polyester having a hydroxyl group, is typically 5/1 to 1/1, preferably 4/1 to 1.2/1, and more preferably 2.5/1 to 1.5/1. When [NCO]/[OH] is more than 5, low-temperature image fixing properties is often poor. When the molar ratio of [NCO] is less than 1, when a urea modified polyester is used, the urea content of ester becomes lower, which makes hot-offset resistivity insufficient.

The component content of polyvalent isocyanate compound (PIC) of a polyester prepolymer having an isocyanate group (A) is typically 0.5% by mass to 40% by mass, preferably 1% by mass to 30% by mass, and more preferably 2% mass to 20% by mass. When less than 0.5% by mass, it makes hot-offset resistivity insufficient and brings about disadvantages in the compatibility between heat resistant storage properties and low-temperature image fixing properties. On the other hand, when it is more than 40 wt %, low-temperature image fixing properties become poor. The number of isocyanate groups contained in per one molecular of polyester prepolymer having isocyanate group (A) is typically 1 or more, preferably 1.5 to 3 on an average, and more preferably 1.8 to 2.5 on average. When the number of isocyanate groups is less than 1 per one molecular of polyester prepolymer, the molecular weight of the urea modified polyester becomes lower, which makes hot-offset resistivity poor.

Next, examples of amines (B) to be reacted to a polyester prepolymer (A) include a divalent amine compound (B1), a trivalent or more polyvalent amine compound (B2), an aminoalcohol (B3), an amino mercaptan (B4), an amino acid (B5), and a compound in which the amino group of B1 to B5 is blocked (B6).

Examples of the divalent amine compound (B1) include an aromatic diamine such as phenylene diamine, diethyl toluene diamine, 4,4'-diamino diphenyl methane; an alicyclic diamine such as 4,4'-diamino-3,3'-dimethyl dicyclohexyl methane, diamine cyclohexane, and isophorone diamine; and an aliphatic diamine such as ethylene diamine, tetramethylene diamine, and hexamethylene diamine. Examples of the trivalent or more polyvalent amine compound (B2) include diethylene triamine and triethylene tetramine. Examples of the aminoalcohol (B3) include ethanol amine, and hydroxyethylaniline. Examples of the amino mercaptan (B4) include aminoethyl mercaptan and aminopropyl mercaptan. Examples of the amino acid (B5) include aminopropionic acid, aminocaproic acid, and the like. Examples of the compound in which the amino group of B1 to B5 is blocked (B6) include a ketimine compound obtained from the above-noted amines of B1 to B5 and ketones such as acetone, methyl ethyl ketone, and methyl isobuthyl ketone and oxazolidine compound, and the like. Among these amines (B), a divalent amine compound B1 and a mixture of B1 with a small amount of a trivalent or more polyvalent amine compound (B2) are preferable.

A ratio of amines (B), defined as an equivalent ratio [NCO]/[NHx] of isocyanate group [NCO] in a polyester prepolymer having isocyanate group (A) to amine group [NHx] in amines (B), is typically 1/2 to 2/1, preferably 1.5/1 to 1/1.5, and more preferably 1.2/1 to 1/1.2. When [NCO]/[NHx] is more than 2 or less than 1/2, the molecular weight of urea modified polyester becomes lower, which makes hot-offset resistivity degraded.

In addition, the urea modified polyester may include a urethane bond as well as a urea bond. A molar ratio of the urea bond content to the urethane bond content is typically 100/0 to 10/90, preferably 80/20 to 20/80, and more preferably 60/40 to 30/70. When a molar ratio of the urea bond is less than 10%, hot-offset resistivity becomes degraded.

A modified polyester (i) used in the present invention is manufactured by one-shot method, and prepolymer method. The weight average molecular weight of the modified polyester (i) is typically 10,000 or more, preferably 20,000 to 10,000,000 and more preferably 30,000 to 1,000,000. The molecular weight peak is preferably 1,000 to 10,000, and when less than 1,000, it is hard to be subjected to elongation reactions, and the toner elasticity is low, which makes hot-offset resistivity poor. When the molecular weight peak is more than 10,000, it may cause degradation of fixability and may bring hard challenges in manufacturing in yielding toner fine particles and in toner grinding. The number average molecular weight of the modified polyester (i) when used together with an unmodified polyester (ii), which will be hereafter described, is not particularly limited, and it may be a number average molecular weight which is easily obtained to be used with the above-noted weight average molecular weight. When a modified polyester (i) is used alone, the number average molecular weight is typically 20,000 or less, preferably 1,000 to 10,000, and more preferably 2,000 to 8,000. When the number average molecular weight is more than 20,000, low-temperature image fixing properties and gross properties when used in a full-color device become poor.

In cross-linking and/or elongation reactions of a polyester prepolymer (A) and amines (B) in order to obtain a modified polyester (i), a reaction stopper may be used as required to control the molecular weight of a urea modified polyester to be obtained. Examples of the reaction stopper include a monoamine such as diethyl amine, dibutyl amine, buthyl amine, and lauryl amine, and a compound in which the above-noted elements are blocked.

It is noted that the molecular weight of a polymer to be formed can be measured by means of gel permeation chromatography (GPC), using a tetrahydrofuran (THF) solvent.

(Unmodified Polyester)

In the present invention, not only the modified polyester (i) may be used alone but also an unmodified polyester (ii) may be included together with the modified polyester (i) as binder resin components. Using an unmodified polyester (ii) in combination with a modified polyester (i) is preferable to the use of the modified polyester (i) alone, because low-temperature image fixing properties and gloss properties when used in a full-color device become improved. Examples of the unmodified polyester (ii) include a polycondensation polyester of a polyvalent alcohol (PO) and a polyvalent carboxylic acid (PC), and the like, same as in the modified polyester (i) components. Preferable compounds thereof are also the same as in the modified polyester (i). As for the unmodified polyester (ii), in addition to an unmodified polyester, it may be a polymer which is modified by a chemical bond other than urea bonds, for example, it may be modified by a urethane bond. It is preferable that at least a part of modified polyester (i) is compatible with part of an unmodified polyester (ii), from the aspect of low-temperature image fixing properties and hot-offset resistivity. Thus, it is preferable that the composition of the modified polyester (i) is similar to that of the unmodified polyester (ii). A weight ratio of a modified polyester (i) to an unmodified polyester (ii) when an unmodified polyester (ii) being included, is typically 5/95 to 80/20, preferably 5/95 to 30/70, more preferably 5/95 to 25/75, and still more preferably 7/93 to 20/80. When the weight ratio of a modified polyester (i) is less than 5%, it makes hot-offset resistivity degraded and brings about disadvantages in compatibility between heat resistant storage properties and low-temperature image fixing properties.

The molecular weight peak of the unmodified polyester (ii) is typically 1,000 to 10,000, preferably 2,000 to 8,000, and more preferably 2,000 to 5,000. When the molecular weigh peak of the unmodified polyester (ii) is less than 1,000, heat resistant storage properties becomes degraded, and when more than 10,000, low-temperature image fixing properties becomes degraded. The hydroxyl value of the unmodified polyester (ii) is preferably 5 or more, more preferably 10 to 120, and still more preferably 20 to 80. When the value is less than 5, it brings about disadvantages in the compatibility between heat resistant storage properties and low-temperature image fixing properties. The acid number of the unmodified polyester (ii) is preferably 1 to 5, and more preferably 2 to 4. Since a wax with a high acid value is used, as for a binder, a binder with a low acid value is easily matched with a toner used in a two-component developer, because such a binder leads to charging and a high volume resistivity.

The glass transition temperature (Tg) of the binder resin is typically 35° C. to 70° C., and preferably 55° C. to 65° C. When less than 35° C., shelf stability under higher temperature becomes degraded, and when more than 70° C., low-temperature image fixing properties becomes insufficient. The toner of the present invention shows a proper heat resistant storage properties tendency even with a low glass transition temperature, compared to a toner made from a polyester known in the art, because a urea modified polyester easily exists on the surface of particles of the toner base to be obtained. It is noted that the glass transition temperature (Tg) can be measured using a differential scanning calorimeter (DSC).

(Colorant)

With respect to the colorant to be used, all of the dyes and pigments known in the art may be used. For example, it is possible to use carbon black, nigrosine dye, iron black, naphthol yellow S, Hansa yellow (10G, 5G, and G), cadmium yellow, yellow iron oxide, yellow ocher, yellow lead, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazinelake yellow, quinoline yellow lake, anthraene yellow BGL, isoindolinon yellow, colcothar, red lead, lead vermilion, cadmium red, cadmium mercury red, antimony vermilion, permanent red 4R, para red, fiser red, parachloroorthonitro anilin red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridon red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS, BC), indigo, ultramarine, iron blue, anthraquinon blue, fast violet B, methylviolet lake, cobalt purple, manganese Violet, dioxane violet, anthraquinon violet, chrome green, zinc green, chromium oxide, viridian green, emerald green, pigment green B, naphthol green B, green gold, acid green lake, malachite green lake, phthalocyanine green, anthraquinon green, titanium oxide, zinc flower, lithopone, and a mixture thereof. The colorant content of the toner is typically 1% by mass to 15% by mass, and preferably 3% by mass to 10% by mass.

The colorant may be used as a masterbatch compounded with a resin. Examples of the binder resin in the masterbatch include a styrene such as, polystyrene, poly-p-chlorostyrene, polyvinyl toluene, and derivative substitution polymer thereof, or a copolymer of the above-noted styrene and vinyl compound, polymethyl methacrylate, polybutyl methacrylate, polyvinylchloride, polyvinyl acetate, polyethylene, polypropylene, polyester, an epoxy resin, epoxy polyol resin, polyurethane, polyamide, polyvinyl butyral, polyacrylic acid resin, rodin, modified-rodin, terpene resin, aliphatic hydrocarbon resin, alicyclic hydrocarbon resin, aromatic petroleum resin, chlorinated paraffin, and paraffin wax. Each of these colorants may be employed alone or in combination of two or more.

(Charge Control Agent)

As a charge control agent, a conventional one in the art can be used. Examples of the charge control agent include nigrosine dye, triphenylmethane dye, chrome-contained metal-complex dye, molybdic acid chelate pigment, rhodamine dye, alkoxy amine, quaternary ammonium salt such as fluoride-modified quaternary ammonium salt, alkylamide, phosphoric simple substance or compound thereof, tungsten itself or compound thereof, fluoride activator, salicylic acid metallic salt, and salicylic acid derivative metallic salt. Specifically, Bontron 03 of a nigrosine dye, Bontron P-51 of a quaternary ammonium salt, Bontron S-34 of a metal containing azo dye, Bontron E-82 being an oxynaphthoic acid metal complex, Bontron E-84 of a salicylic acid metal complrex, and Bontron E-89 of a phenol condensate (by Orient Chemical Industries, Ltd.); TP-302 and TP-415 being a quaternary ammonium salt molybdenum metal complex (by Hodogaya Chemical Co.); Copy Charge PSY VP2038 of a quaternary ammonium salt, Copy Blue PR of a triphenylmethane derivative, and Copy Charge NEG VP2036 and Copy Charge NX VP434 of a quaternary ammonium salt (by Hoechst Ltd.); LRA-901, and LR-147 being a boron metal complex (by Japan Carlit Co., Ltd.), copper phtalocyamine, perylene, quinacridone, azo pigment, and other high-molecular weight compounds having a functional group, such as sulfonic acid group, carboxyl group, and quaternary ammonium salt. Among the charge control agents, a substance capable of controlling a toner to a negative polarity is preferably used.

The usage of the charge control agent is determined depending on the type of a binder resin, presence or absence of an additive to be used as required, and the method for manufacturing a toner including a dispersion process and is not limited uniformly; preferably, to 100 parts by mass of binder resin, 0.1 part by mass to 10 parts by mass of the charge control agent is used and more preferably with 0.2 part by mass to 5 part by mass of the charge control agent. When the charge control agent is more than 10 parts by weight, toner-charge properties are exceedingly large, which lessens the effect of the charge control agent itself and increases in electrostatic attraction force with a developing roller, and causes degradations of developer fluidity and image density.

(Releasant)

A wax having a melting point of 50° C. to 120° C. which is dispersed in a binder resin is more effectively works on the phase boundary between a fixing roller and a toner as a releasant in a dispersion liquid with a binder resin dispersed therein, which exert effect on high temperature offsets without any applications of a releasant like a oil to a fixing roller. The wax components are as follows. Examples of the wax include a wax of vegetable origin such as carnauba wax, cotton wax, sumac wax, and rice wax; a wax of animal origin such as beeswax, and lanoline, and a wax of mineral origin such as ozokerite, and ceresin, and a petroleum wax such as paraffin, micro crystalline, and petrolatum. Besides the above-noted permanent waxes, there are a hydrocarbon synthetic wax such as Fischer-Tropsch wax, polyethylene wax; and a synthetic wax such as ester wax, ketone wax, and ether wax. Further, it is also possible to use a polyacrylate homopolymer such as poly-n-stearyl methacrylate, and poly-n-lauril methacrylate being a fatty acid and a low-molecular-weight crystalline polymer resin such as 12-hydroxy stearic acid amide, stearic acid amide, phthalic anhydride imide, and chlorinated hydrocarbon or a copolymer such as a n-stearyl acrylate-ethylmethacrylate copolymer, and the like; and a crystalline polymer having a long alkyl group in its side chain such as, a n-stearylacrylate-ethyl-methacrylate copolymer.

The above-noted charge control agents and the releasants may be fused and kneaded with a masterbatch and a binder resin and may be surely added when dissolved and dispersed into an organic solvent.

(External Additive)

Preferably, inorganic particles are used as an external additive for assisting in fluidity of toner particles, developing properties, and charge properties.

The preferable method for producing the toner according to the present invention will be explained in the following with respect to exemplary aspects, but not limited to.

—Dissolving and Suspending for Producing Toner—

(1) A liquid containing toner raw materials is prepared through dispersing or dissolving a colorant, unmodofied-polyester, polyesterprepolymers containing an isocyanate group, and releasant into an organic solvent. The releasant may be a wax, which is dispersed and stirred in an organic solvent to form releasant particles. The stirring of the releasant may provide size-controlled releasant particles, which are poured into the organic solvent with the other ingredients.

The solvent is preferably volatile and has a boiling point lower than 100° C. because of easily removing from the dispersion after the particles are formed. Specific examples of such a solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methylacetate, ethylacetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used. The addition quantity of such a solvent is from 0 to 300 parts by mass, preferably from 0 to 100 parts by mass, and more preferably from 25 to 70 parts by mass based on 100 parts by mass of the prepolymer.

(2) The liquid that contains toner raw materials is emulsified within an aqueous medium under the presence of a surfactant and resin fine particles. The aqueous medium may be solely water, alternatively the aqueous medium may contain as alcohol such as methanol, isopropyl alcohol, and ethylene glycol, dimethylformamide, tetrahydrofuran, cellosorves such as methyl cellosolve, and a lower ketone such as acetone and methylethylketone.

The amount of the aqueous medium is preferably 50 parts by mass to 2000 parts by mass, more preferably 100 parts by mass to 1000 parts by mass based on 100 parts by mass of the liquid containing toner raw materials. When the amount is less than 50 parts by mass, the liquid containing toner raw materials disperses insufficiently within the aqueous medium to obtain toner particles with predetermined particle diameter; the amount of above 20000 parts by mass leads to higher cost.

In order to arrange properly the dispersion condition within the aqueous medium, dispersants such as surfactants and resin fine particles may be added optionally.

Examples of the surfactant include anionic surfactants such as alkylbenzene sulfonic acid salts, α-olefin sulfonic acid salts, and phosphoric acid salts; cationic surfactants such as amine salts e.g. alkyl amine salts, aminoalcohol fatty acid derivatives, polyamine fatty acid derivatives and imidazoline, and quaternary ammonium salts e.g. alkyltrimethyl ammonium salts, dialkyldimethyl ammonium salts, alkyldimethyl benzyl ammonium salts, pyridinium salts, alkyl isoquinolinium salts and benzethonium chloride; nonionic surfactants such as fatty acid amide derivatives and polyhydric alcohol derivatives; and ampholytic surfactants such as alanine, dodecyldi(aminoethyl)glycin, di(octylaminoethyle) glycin, and N-alkyl-N,N-dimethylammonium betaine.

Further, a surfactant having a fluoroalkyl group may provide a dispersion with superior dispersibility even in a small amount of the surfactant. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkanoyl ($C_6$ to $C_{11}$)oxy}-1-alkyl($C_3$ to $C_4$) sulfonate, sodium 3-{omega-fluoroalkanoyl($C_6$ to $C_8$)-N-ethylamino}-1-propanesulfonate, fluoroalkyl($C_{11}$ to $C_{20}$) carboxylic acids and their metal salts, perfluoroalkylcarboxylic acids and their metal salts, perfluoroalkyl($C_4$ to $C_{12}$)sulfonate and their metal salts, perfluorooctanesulfonic acid diethanol amides, N-propyl-N-(2-hydroxyethyl)perfluorooctanesulfone amide, perfluoroalkyl($C_6$ to $C_{10}$)sulfoneamidepropyltrimethylammonium salts, salts of perfluoroalkyl ($C_6$ to $C_{10}$)-N-ethylsulfonyl glycin, monoperfluoroalkyl($C_6$ to $C_{16}$)ethylphosphates, etc.

Specific examples of the trade name of such surfactants include Surflon S-111, S-112 and S-113 (by Asahi Glass Co.); Frorard FC-93, FC-95, FC-98 and FC-129 (by Sumitomo 3M Ltd.); Unidyne DS-101 and DS-102 (by Daikin Industries, Ltd.); Megafac F-110, F-120, F-113, F-191, F-812 and F-833 (by Dainippon Ink and Chemicals, Inc.); ECTOP EF-102, 103, 104, 105, 112, 123A, 306A, 501, 201 and 204 (by Tohchem Products Co.); Futargent F-100 and F150 (by Neos Co.).

Specific examples of the cationic surfactants include primary, secondary and tertiary aliphatic amines having a fluoroalkyl group, aliphatic quaternary ammonium salts such as perfluoroalkyl($C_6$ to $C_{10}$) sulfoneamidepropyltrimethylammonium salts, benzalkonium salts, benzetonium chloride, pyridinium salts, imidazolinium salts, etc. Specific examples of the trade name thereof include Surflon S-121 (by Asahi Glass Co.), Frorard FC-135 (by Sumitomo 3M Ltd.), Unidyne DS-202 (by Daikin Industries, Ltd.), Megaface F-150 and F-824 (by Dainippon Ink and Chemicals, Inc.), Ectop EF-132 (by Tohchem Products Co.), and Futargent F-300 (by Neos Co.).

The resin fine particles are utilized in order to stabilize the toner particles within the aqueous medium. Preferably, the average particle diameter of the resin fine particles is 5 nm to 300 nm, more preferably 20 nm to 200 nm. The resin fine particles are attached to the surface or surface layer of the dispersed particles to coat the toner particles within the aqueous medium.

Preferably, the glass transition temperature (Tg) of the resin fine particles is 40° C. to 90° C., more preferably 50° C. to 70° C. When the Tg is below 40° C., the shelf life of the toner is likely to be insufficient, resulting possibly in blocking in apparatuses. When the Tg is above 90° C., the resin fine particles tend to disturb the adhesion with the fixture paper and to raise the lower fixing temperature, resulting possibly in insufficient fixing temperature, inferior fixture in conventional copiers, and peeling tendency of fixed images under slight rubbing.

Preferably, the mass average molecular mass of the resin fine particles is 200,000 or less, more preferably is 50,000 or less. The lower limit is usually about 4,000. The mass average molecular mass of the resin fine particles is more than 200,000, the resin fine particles tend to disturb the adhesion with the paper and to raise the lower fixing temperature.

Resins for use as resin fine particles are not particularly limited, as long as capable of forming a dispersion in an aqueous medium, and may be selected from thermoplastic resins and thermosetting resins. Examples of the resins include vinyl resins, polyurethane resins, epoxy resins, polyester resins, polyamide resins, polyimide resins, silicone resins, phenolic resins, melamine resins, urea resins, aniline resins, ionomer resins, and polycarbonate resins. The resin fine particles may comprise two or more resins. Among them, vinyl resins, polyurethane resins, epoxy resins, polyester resins, and mixtures thereof are preferred since aqueous dispersion of fine spherical resin particles may be produced easily.

Specific examples of the vinyl resins include homopolymers and copolymers of vinyl monomers, such as styrene-(meth)acrylic ester resins, styrene-butadiene copolymers, (meth)acrylic acid-acrylic ester copolymers, styrene-acrylonitrile copolymers, styrene-maleic anhydride copolymers, and styrene-(meth)acrylic acid copolymers.

Preferably, the content of the resin fine particles is 0.5% by mass to 10% by mass, more preferably is 1% by mass to 3% by mass based on the organic solvent within the aqueous medium. The content of the resin fine particles may bring about proper emulsifying.

The resin fine particles are employed in order to control or adjust the toner shape such as circularity and distribution as described above, and the resin fine particles exist locally on the surface of toner particles. Preferably, the surface-coverage rate of the resin fine particles over the toner particles is 1% to 90%, more preferably is 5% to 80%. When the surface-coverage rate is above 90%, the substantially entire coverage of resin fine particles may prevent the bleeding of the releasant from within toner particles to outside them, thus offset on the fixing roller may be induced due to the suppressed releasing effect. When the surface-coverage rate is less than 1%, toner particles tend to coagulate each other due to non-inhibited affinity between toner particles, resulting in unfortunate deterioration in flowability.

Specific examples of the resin fine particles include particulate polymethylmethacrylate having particle diameters of 1 μm and 3 μm, particulate polystyrene having particle diameters of 0.5 μm and 2 μm, particulate styrene-acrylonitrile copolymers having a particle diameter of 1 μm, PB-200H (by Kao Corp.), SGP and SPG-3G (by Soken Chemical & Engineering Co.), SB Technopolymer (Sekisui Plastics Co.), and Micropearl (Sekisui Fine Chemical Co.).

In addition, such dispersants of inorganic compounds may be utilized as tricalcium phosphate, calcium carbonate, titanium oxide, and hydroxyapatite.

The dispersion of toner particles may be stabilized by use of a polymeric protective colloid along with the resin fine particles and/or the dispersants of inorganic compounds. Examples of the polymeric protective colloid include homopolymers and copolymers of acids such as acrylic acid, methacrylic acid, α-cyanoacrylic acid, α-cyanomethacrylic acid, itaconic acid, crotonic acid, fumaric acid, maleic acid, and maleic anhydride; hydroxyl-group-containing (meth) acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic ester, diethylene glycol monomethacrylic ester, glycerol monoacrylic ester, glycerol monomethacrylic ester, N-methylolacrylamide, and N-methylolmethacrylamide; vinyl alcohol and ethers thereof such as vinyl methyl ether, vinyl ethyl ether, and vinyl propyl ether; esters of vinyl alcohol and a carboxyl-group-containing compound such as vinyl acetate, vinyl propionate, and vinyl butyrate; acrylamide, methacrylamide, diacetone acrylamide, and methylol compounds thereof; acid chlorides such as acryloyl chloride, and methacryloyl chloride; nitrogen atom such as vinylpyridine, vinylpyrrolidone, vinylimidazole, and ethyleneimine; polyoxyethylene compounds such as polyoxyethylene, polyoxypropylene, polyoxyethylene alkyl amines, polyoxypropylene alkyl amines, polyoxyethylene alkyl amides, polyoxypropylene alkyl amides, polyoxyethylene nonyl phenyl ether, polyoxyethylene lauryl phenyl ether, polyoxyethylene stearyl phenyl ester, and polyoxyethylene nonyl phenyl ester; and cellulose derivatives such as methyl cellulose, hydroxyethyl cellulose, and hydroxypropyl cellulose.

The dispersing procedure is not particularly limited and includes known procedures such as low-speed shearing, high-speed shearing, dispersing by friction, high-pressure jetting, ultrasonic dispersion. To allow the dispersed particles to have an average particle diameter of 2 μm to 20 μm, the high-speed shearing procedure is preferred. When a high-speed shearing dispersing machine is used, the number of rotation is not particularly limited and is generally from 1,000 rpm to 30,000 rpm, and preferably from 5,000 rpm to 20,000 rpm. The amount of dispersion time is not particularly limited and is generally from 0.1 minute to 5 minutes in a batch system. The dispersing temperature is generally from 0° C. to 150° C. under a pressure of a load, and preferably from 40° C. to 98° C.

(3) In parallel with preparation of the emulsified liquid, amines (B) are added to the emulsified liquid to be reacted to a polyester prepolymer having an isocyanate group (A). The reaction is involved in cross-linking and/or elongation of molecular chains. The reaction time for cross-linking and/or elongation is appropriately set depending on the reactivity derived from the combination of the isocyanate structure of the polyester prepolymer (A) and the amines (B) and is generally from 10 minutes to 40 hours, and preferably 2 hours to 24 hours. The reaction temperature is generally 0° C. to 150° C., and preferably 40° C. to 98° C. Where necessary, a catalyst known in the art may be used as required. Specifically, examples of the catalyst include a dibutyltin laurate, and a diocryltin laurate.

(4) After completion of the reaction, the organic solvent is removed from the emulsified dispersion or reaction mixture and the residue is washed and dried to obtain toner base particles.

The entire system is gradually raised in temperature while stirring as a laminar flow, is vigorously stirred at set temperature, and the organic solvent is removed to thereby yield toner base particles. When calcium phosphate salts or another dispersion stabilizer that is soluble in acid or base is used, the dispersion stabilizer is removed from the fine particles by dissolving the dispersion stabilizer by action of an acid such as hydrochloric acid and washing the fine particles. Alternatively, the component can be removed, for example, by enzymatic decomposition.

(5) A charge control agent is incorporated into the obtained toner base particles, and then inorganic fine particles such as silica fine particles, and titanium oxide fine particles are added to the toner particles as external additives, thereby to yield a toner.

The incorporation of the charge control agent and the external addition of inorganic particles are performed by way of a conventional procedure using a mixer, for example.

Thus, a toner having a narrow particle diameter distribution may be easily produced. In addition, vigorous stirring at removing the organic solvent may control the toner-particle shape between substantial-spherical shape and rugby-ball shape, and the surface of the toner particles may be morphologically controlled within a range from smooth surface to shriveled surface.

The toner according to the present invention exhibits approximately spherical shape, which may be expressed as follows.

Figure 2A:
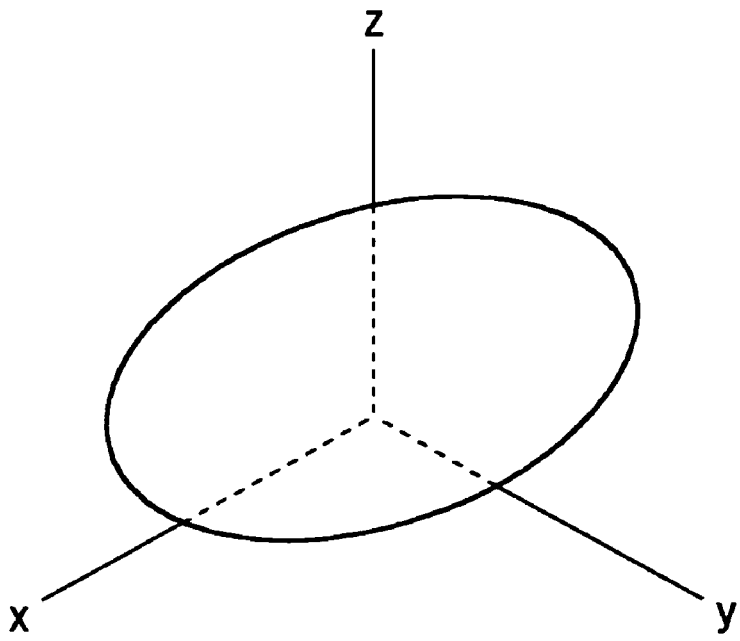
FIG. 2A is a schematic view to show an exemplary shape of a toner according to the present invention.
Figure 2B:
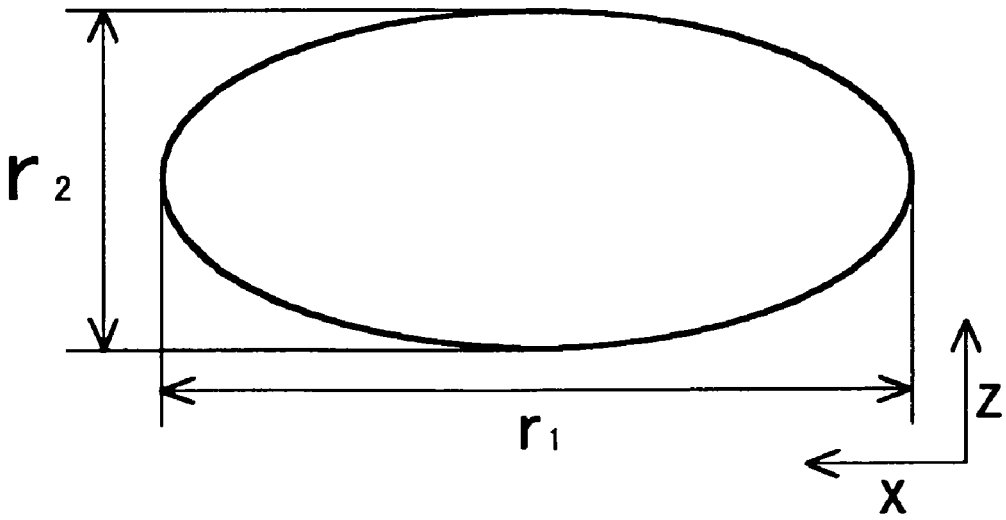
FIG. 2B is a schematic view to show an exemplary shape of a toner according to the present invention.
Figure 2C:
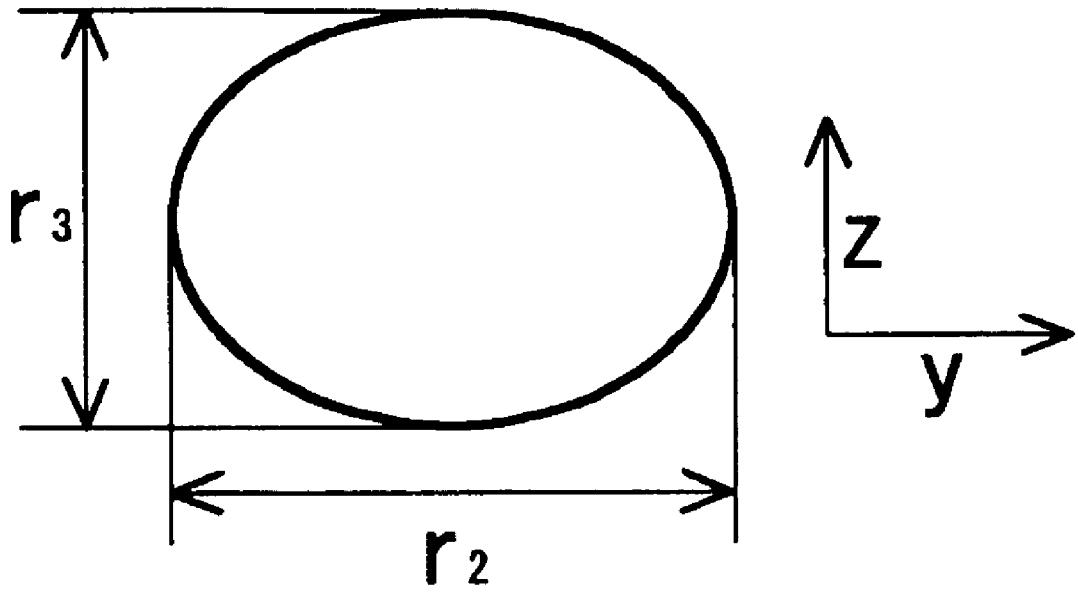
FIG. 2C is a schematic view to show an exemplary shape of a toner according to the present invention.

FIGS. 2A, 2B, and 2C show representative shapes of toner according to the present invention. Maximum length r1, minimum length r2, and thickness r3 are defined for the approximately spherical shape as shown in FIGS. 2A, 2B, and 2C, wherein r1≧r2≧r3. Preferably, r2/r1 is 0.5 to 1.0 (see FIG. 2B), and r3/r2 is 0.7 to 1.0 in the toner according to the present invention. When r2/r1 ((minimum length)÷(maximum length)) is less than 0.5, the toner tends to exhibit poor dot-reproducibility and lower transfer efficiency due to less spherical shape, hardly producing high quality images. When r3/r2 ((thickness)÷(minimum length)) is less than 0.7, the shape of the toner is almost flat, thus the transfer efficiency is likely to be considerably lower than that of spherical toner. When r3/r2 is about 1.0 in particular, the toner particles may act as rotatable body, resulting in higher flowability of the toner. The values of r1, r2, and r3 are measured, by taking a number of photographs from various angles by SEM and analyzing the photographs.

In a preferable embodiment according to the present invention, the external additive comprises the first inorganic fine particles of which the primary-particle diameter is 50 nm to 300 nm and the second inorganic fine particles of which the primary-particle diameter is 5 nm to 30 nm; the remaining rate Za of the first inorganic fine particles is 80% to 90%, and the remaining rate Zb of the second inorganic fine particles is 70% to 95%; wherein Za is expressed by Ya/Xa, Xa is the content of the first inorganic fine particles in the toner, Ya is the content of the first inorganic fine particles remaining in the toner after exposing the toner to ultrasonic wave at 20 W output power and 25 kHz frequency for one minute within a liquid containing a surfactant, Zb is expressed by Yb/Xb, Xb is the content of the second inorganic fine particles in the toner, Yb is the content of the second inorganic fine particles remaining in the toner after exposing the toner to ultrasonic wave of 25 kHz for one minute within a liquid containing an surfactant. The toner in this embodiment may provide superior cleanability, transfer property, and developing property.

Preferably, Xa is 0.5% by mass to 6.0% by mass, and Xb is 0.2% by mass to 5.0% by mass, thereby the toner may represent appropriate flowability, charging property, and fixing property at lower temperatures.

Preferably, the first inorganic fine particles are silica particles.

Preferably, the primary-particle diameter of the first inorganic fine particles in the toner is 50 nm to 300 nm, more preferably is 80 nm to 200 nm, and still more preferably is 100 nm to 150 nm. The first inorganic fine particles having the primary-particle diameter of the range may provide the toner with superior cleanability, transfer property, and developing property. Namely, the primary-particle diameter of 50 nm or more is preferred from the viewpoint of sufficient cleanability and spacer effect, superior transfer property and developing property, and also prevention of embedding into toner particles. Further, the primary-particle diameter of 300 nm or less is preferred from the viewpoint of affinity with toner surface and fixing property at lower temperatures.

Preferably, the content of the first inorganic fine particles is 0.5% by mass to 6.0% by mass, more preferably 0.5% by mass to 3.0% by mass based on the toner. The content of 0.5% by mass or more is preferred from the viewpoint of significant functions of the first inorganic fine particles, and the content of 6.0% by mass or less is preferred from the viewpoint of flowability, charging property, and fixing property at lower temperatures.

Preferably, the standard deviation σ of primary-particle diameter represents the relation of $R/4 \leqq \sigma \leqq R$, more preferably of $R/3 \leqq \sigma \leqq 2/3 \times R$ (R: average primary-particle diameter), thereby toner particles with smaller diameter, moderate diameter, and larger diameter are appropriately compounded, thus higher flowability may be achieved in toner particles of smaller diameter, and effective spacer effect may be obtained in moderate and larger toner particles. It has been experienced that these advantageous effects are more significant than those of the toners obtained by mechanically blending toner particles with smaller diameter, moderate diameter, and larger diameter.

Preferably, the primary-particle diameter of the second inorganic fine particles in the toner is 5 nm to 30 nm, more preferably is 10 nm to 20 nm. When the primary-particle diameter of the second inorganic fine particles is larger than the range, the flowability and charging property are likely to be inferior, and when smaller than the range, the second inorganic fine particles tend to be embedded remarkably into the toner and the toner is likely to degrade with time.

Preferably, the content of the second inorganic fine particles is 0.2% by mass to 5.0% by mass, more preferably 0.5% by mass to 2.0% by mass, thereby appropriate flowability and charging property may be attained.

Examples of the first and second inorganic fine particles include silica, alumina, titanium oxide, barium titanate, magnesium titanete, calcium titanate, strontium titanate, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide, and silicon nitride. Preferably, the first inorganic fine particles are silica in light of superior flowability and charge property. Preferably, the first and the second inorganic fine particles are silica.

The first and the second inorganic fine particles may be surface-treated into hydrophobic. Examples of the substance for imparting hydrophobic property include silane coupling agents, sililating agents, silane coupling agents having a fluorinated alkyl group, organic titanate coupling agents, and aluminum-containing coupling agents. In addition, silicone oils may perform as the substance for imparting hydrophobic property in some cases.

The "remaining rate" of the inorganic fine particles in the present invention is an index to express the tendency of the inorganic fine particles to liberate from the toner particles. The "remaining rate" differs from the "free amount of external additive", which is also an index described above, in that the less is the "remaining rate" the inorganic fine particles tend to liberate from the toner particles owing to lower affinity between both of the particles.

The measurement of "remaining rate" of the inorganic fine particles is common to that of the "free amount of external additive" in that the ultrasonic homogenizer is utilized, and differs in that an aqueous solution containing a surfactant is utilized for determining the "remaining rate". The remaining rate Za of the first organic fine particles are determined by way of measuring the initial content Xa of the first organic fine particles on the base of fluorescent X-ray, and measuring the remaining content Ya of the first organic fine particles after subjecting the toner to ultrasonic vibration at 25 kHz for one minute within a liquid containing an surfactant using an ultrasonic homogenizer, wherein Xa and Ya are measured based on the entire mass of the toner as 100%, then Za is calculated from the equation Za (%)=Ya/Xa. Similarly, the remaining rate Zb of the second organic fine particles is determined through measuring the initial content Xb and the remaining content Yb of the second organic fine particles in the toner particles.

More specifically, the "remaining rate" is determined in the present invention as follows. The measure condition indicated below is referred to as "Measure Condition 1" in this specification.

To 100 ml of an aqueous solution containing a surfactant of drywell at 4% by mass, 5.0 g of a toner is added and allowed to stand for sufficient wetting, then the slurry of the toner and the aqueous solution is subjected to ultrasonic vibration at 25 kHz frequency and 20 W output power for one minute by means of an ultrasonic homogenizer (UT-30, by Sonics & Materials, Inc.). Then the dispersion is filtered, the remaining toner is rinsed sufficiently by deionized water. Thereafter, the toner is dried at 38° C. for one day.

The initial content Xa and Xb and the remaining content Ya and Yb of the first and second inorganic fine particles in the toner is determined by means of fluorescent X-ray analysis. Specifically, a calibration curve is previously prepared using plural toners having known content of the inorganic fine particles. The fluorescent X-ray analyzer may be ZSX-100E (by Rigaku Co.) for example. When the first and second inorganic fine particles are of the same substance, these cannot be analyzed by the X-ray process at a time. In such case, the first and second inorganic fine particles are to be analyzed separately.

Preferably, the remaining rate Za of the first inorganic fine particles is 80% to 90%, more preferably 85% to 90%. In the range of the remaining rate, the toner may sustain the first inorganic fine particles with more adequate affinity, thus the toner may exhibit superior durability under a consistent stress, and provide a spacer effect for prolonged period. When the remaining rate Za is below 80%, the first inorganic fine particles may easily liberate from the toner, thus the carrier spent and/or filming tend to occur, and the charge stability of the toner may decrease. When the remaining rate Za is above 90%, the flowability of the toner may be lowered, the first organic fine particles tents to be buried within the toner, and the toner tends to degrade.

Preferably, the remaining rate Zb of the second inorganic fine particles is 70% to 95%, more preferably 75% to 85%. In the range of the remaining rate, the second organic fine particles may avoid excessive free rate and embedding into toner under a consistent stress, and the toner may exhibit higher flowability. When the remaining rate Zb is below 70%, the second inorganic fine particles may easily liberate from the toner, thus the carrier spent and/or filming tend to occur, and the charge stability of the toner may decrease. When the remaining rate Zb is above 90%, the flowability of the toner may be lowered, the second organic fine particles tents to be buried within the toner, and the toner tends to degrade.

The preferable ranges in terms of Za and Zb may provide the toner with superior cleanability, transfer property, and developing property for a long period.

Preferably, the external additive in the present invention comprises two or more species of inorganic fine particles, silica and titanium oxide are included in the organic fine particles, the remaining rate of the titanium oxide is 70% or more, the remaining rate of the silica is 85% or less, and remaining rate of the titanium oxide is higher than the remaining rate of the silica; wherein the remaining rate means the rate of amount remaining after subjecting to ultrasonic vibration at 25 kHz frequency and 20 W output power for one minute in an aqueous solution containing a surfactant as described above.

Preferably, both of silica and titanium oxide are included into the toner, thereby higher charge amount may be achieved, the toner may be free from such problems as toner scatter, background smear or fog, and the like, and clogging of toner may be efficiently prevented at toner-convey lines.

As described above, in the preferable embodiment of the present invention, the remaining rate of the titanium oxide is 70% or more, the remaining rate of the silica is 85% or less, and remaining rate of the titanium oxide is higher than the remaining rate of the silica. It is preferred that titanium oxide is firmly adhered to the toner since free titanium oxide adversely affects the filming. It is preferred that silica adheres to the toner with an affinity lower than that of titanium oxide from the viewpoint of higher flowability and cleanability, since lower affinity of titanium oxide may lead to inferior image quality and photoconductor degradation, and higher affinity of silica may lead to inferior cleanability, insufficient flowability, and lower charge amount.

Preferably, the remaining rate of the titanium oxide is 98% or less, since no existence of free titanium oxide bring about no improvement on flowability owing to the addition of titanium oxide.

Preferably, the remaining rate of silica is 50% or more. It is preferred that silica adheres to the toner with an affinity lower than that of titanium oxide from the viewpoint of higher flowability and cleanability; on the other hand, the remaining rate of silica below 50% may lead to excessive amount of free silica, which resulting in problems such as filming.

Another process for determining the "remaining rate" in the present invention is as follows. The measure condition indicated below is referred to as "Measure Condition 2" in this specification.

To 100 ml of an aqueous solution containing a surfactant at 0.2% by mass, 4.0 g of a toner is added and allowed to stand for sufficient wetting, then the slurry of the toner and the aqueous solution is subjected to ultrasonic vibration at 20 kHz frequency and 20 W output power for one minute by means of an ultrasonic homogenizer (VCX-750, by Sonics &

Materials, Inc.), thereby the external additive is separated from the surface of the toner particles. Then, the dispersion is allowed to stand to separate into precipitation part and supernatant part. The precipitation is rinsed and dried, then the dried product is analyzed by fluorescent X-ray process to determine the remaining external additive. The ratio of before and after the ultrasonic exposure is calculated to obtain the remaining ratio.

In order to tailor the remaining ratio desirably, the species of titanium oxide and silica are properly selected, and the production conditions are arranged so as to adhere firmly the external additive to the toner surface. More specifically, silica is selected of which the primary-particle diameter is larger than that of titanium oxide, and a mixing apparatus is utilized for surface treatment that presents strong stirring such as Q mixer. In addition, such a way may be effective that other types of silica are employed having higher charging property or resistivity, or a toner is subjected to surface treatment using titanium oxide at first then silica.

Preferably, the averages of the primary-particle diameter are different between the first and the second inorganic fine particles. These inorganic fine particles have a tendency to embed gradually into toner particles under the stress in the developing process. When the averages are different, the larger particles act as a spacer when contacting with image bearing members such as photoconductors or carrier surface, thereby preventing the smaller inorganic fine particles from embedding into toner particles. Accordingly, the toner surface may maintain the condition coated with the external additive of the initial state, thus the effect to reduce the filming may be maintained also.

Preferably, the amount of the inorganic fine particles having a lower average-primary-particle diameter is higher than the amount of the inorganic fine particles having a higher average-primary-particle diameter. It has been experienced that the smaller amount of particles having higher average diameters and higher amount particles having lower particle diameters may bring about less change of toner properties with time. The reason is believed that the larger is the diameter of inorganic fine particles the more preferentially the embedding of the particles proceeds.

Preferably, at least one species of the inorganic fine particles exhibits an average-primary-particle diameter of 0.03 μm or less. The average-primary-particle diameter of 0.03 μm or less may lead to appropriate flowability, uniform-toner charge, and prevention of toner scatter and background smear.

Preferably, at least one species of silica in the inorganic fine particles exhibits an average-primary-particle diameter of 80 nm to 500 nm. This range of silica may bring about deposition of silica at the contacting region of the cleaning blade and the photoconductor, which leads to proper cleanability owing to a dam effect.

Preferably, at least one species of the inorganic fine particles is treated into hydrophobic by use of hydrophobic-treatment agents such as organic silane compounds, which may provide the toner according to the invention with appropriate environmental preservability, high image quality with fewer defects such as voids in letters, and the like. The hydrophobic treatment may be performed with respect to two species or all species of the inorganic fine particles.

Examples of hydrophobic-treatment agents include organic silane compounds such as dimethyldichlorosilane, trimethylchlorosilane, methyltrichlorosilane, allyldimethyldichlorosilane, allylphenyldichlorosilane, benzyldimethylchlorosilane, bromomethyldimethylchlorosilane, alpha-chloroethyltrichlorosilane, p-chloroethyltrichlorosilane, chloromethyldimethylchlorosilane, chloromethyltrichlorosilane, p-chlorophenyltrichloro silane, 3-chloropropyltrichlorosilane, 3-chloropropyltrimethoxysilane, vinyltriethoxysilane, vinylmethoxysilane, vinyltris(beta-methoxyethoxy) silane, gamma-methacryloxypropyltrtmethoxysilane, vinyltriacetoxysilane, divinyldichlorosilane, dimethylvinylchlorosilane, octyl-trichlorosilane, decyl-trichlorosilane, nonyltrichlorosilane, (4-t-propylphenyl)-trichlorosilane, (4-t-butylphenyl)-trichlorosilane, dipentyl-dichlorosilane, dihexyl-dichlorosilane, dioctyl-dichlorosilane, dinonyldichlorosilane, didecyl-dichlorosilane, didodecyl-dichlorosilane, dihexadecyl-dichlorosilane, (4-t-butylphenyl)-octyldichlorosilane, dioctyl-dichlorosilane, didecenyldichlorosilane, dinonenyl-dichlorosilane, di-2-ethylhexyldichlorosilane, di-3,3-dimethylpentyl-dichlorosilanei, trihexyl-chlorosilane, trioctyl-chlorosilane, tridecyl-chlorosilane, dioctyl-methyl-chlorosilane, octyl-dimethyl-chlorosilane, (4-t-propylphenyl)-diethyl-chlorosilane, octyltrimethoxysilane, hexamethyldisilazane, hexaethyldisilazane, diethyltetramethyldisilazane, hexaphenyldisilazane, and hexatolyldisilazane; silicone oils such as dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acrylic or methacrylic-modified silicone oils, and α-methylstyrene-modified silicone oils; sililating agents, silane coupling agents having a fluoroalkyl group, organotitanate coupling agents, and aluminum-containing coupling agents. Among these, organic silane compounds are preferable.

Application of these hydrophobic-treatment agents to the inorganic fine particles may provide hydrophobic inorganic fine powders adapted to the present invention.

Examples of commercially available silica treated into hydrophobic include HDK H 2050EP and HVK21 (by Hoechst AG); R972, R974, RX200, RY200, R202, R805, and R812 (by Nippon Aerosil Co.); and TS530 and TS720 (Cabot Co.). Suitable titanium oxides of hydrophobic property include crystalline titanium oxides of anatase or rutile crystal form, specifically, T-805 (Nippon Aerosil Co.), STT-30A and STT-30A-FS (rutile crystal, by Titan Kogyo K. K.), and the like.

The particle diameter of the inorganic fillers for use in the present toner may be measured by particle diameter analyzers utilizing dynamic light scattering such as DLS-700 (by Otsuka Electronics Co.) or Coulter N4 (by Coulter Electronics Inc.) However, it is hard to dissociate secondary aggregates of inorganic fine particles treated by the hydrophobic-treatment agents; therefore, it is preferable to measure the particle diameter from direct observation of particles using SEM or TEM. In such measurements, at least 100 particles are taken picture and analyzed from images.

Preferably, the content of the wax is 5% by mass or more based on the entire mass of the toner from the viewpoint of image quality, gloss, and prevention of hot offset.

The toner in the preferable embodiment of the present invention may suppress the filming, and provide superior transfer property and high image quality, therefore, may be properly utilized in full-color image forming apparatuses. In particular, the toner is adapted to two-component developing under higher velocity, and tandem system developing equipped with photoconductors for respective colors. Further, the toner is adapted to intermediate-transfer tandem-system that contains plural transfer steps, since the transfer property is superior.

Further, the toner in the preferable embodiment of the present invention may suitably adapt to lower temperature fixing system, thus may be employed in energy-saving fixing apparatuses with shorter warm-up period, lower temperature, and higher velocity. Such fixing apparatuses are exemplified by those comprising a heating portion with a heater, and a film adjacent to the heater, and a pressing portion to apply pressure with heating portion, wherein a recording material with toner images is passed through between the film and the pressing portion, and a fixing apparatus in which the heating portion is constructed from magnetic metal and is heated by electromagnetic induction.

The toner of the present invention may be utilized as a monocomponent magnetic toner without a magnetic carrier or a non-magnetic carrier.

In the application for two-component developers, the toner is blended with a magnetic carrier. Preferably, the magnetic carrier is a ferrite containing divalent metal such as Fe, Mn, Zn, Cu etc., and has a volume average particle diameter of 20 μm to 100 μm. When the average particle diameter is less than 20 μm, the carrier tend to adhere onto the photoconductor during the developing step, and when the average particle diameter is above 100 μm, the magnetic carrier hardly forms a uniform mixture with the toner, thus the charge amount of the toner is insufficient and inferior charge tends to occur during continuous operation. The magnetic carrier may be properly selected depending on the image forming apparatus and process; from the viewpoint of higher saturation magnetization, Cu ferrite containing Zn is preferable. The resin for coating the magnetic carrier may be properly selected depending on the application, examples of the resin include silicone resins, styrene-acrylic resins, fluorine-containing resins, and olefin resins. The coating may be carried out by preparing a solution of the coating resin, and spraying the solution within a fluidized layer, thereby coating the resin onto the core of the magnetic material, or depositing electrostatically the resin particles onto the core of the magnetic material, heating and melting the resin particle. Preferably, the thickness of the coated resin is 0.05 μm to 10 μm, more preferably is 0.3 μm to 4 μm.

Preferably, the toner of the present invention is utilized as a color toner. The toner may exhibit superior reproducibility for narrow lines, small dots and intermediate color, and proper graininess, therefore is particularly suited to form color images.

The image forming apparatus according to the present invention comprises a photoconductor, a charging unit configured to charge the photoconductor uniformly, an exposing unit configured to expose the charged photoconductor depending on image data to form an electrostatic latent image, a developing unit configured to develop the electrostatic latent image by means of a developer to form a toner image, a transferring unit configured to transfer the toner image onto a transfer material, and a cleaning unit configured to clean the surface of the photoconductor, and the toner according to the present invention is employed.

Preferably, the photoconductor contains a filler, and the content of the filler is 4% by volume to 20% by volume at the region from the photoconductor surface to 5 μm depth; the cleaning unit comprises an elastomeric cleaning blade.

Figure 3:
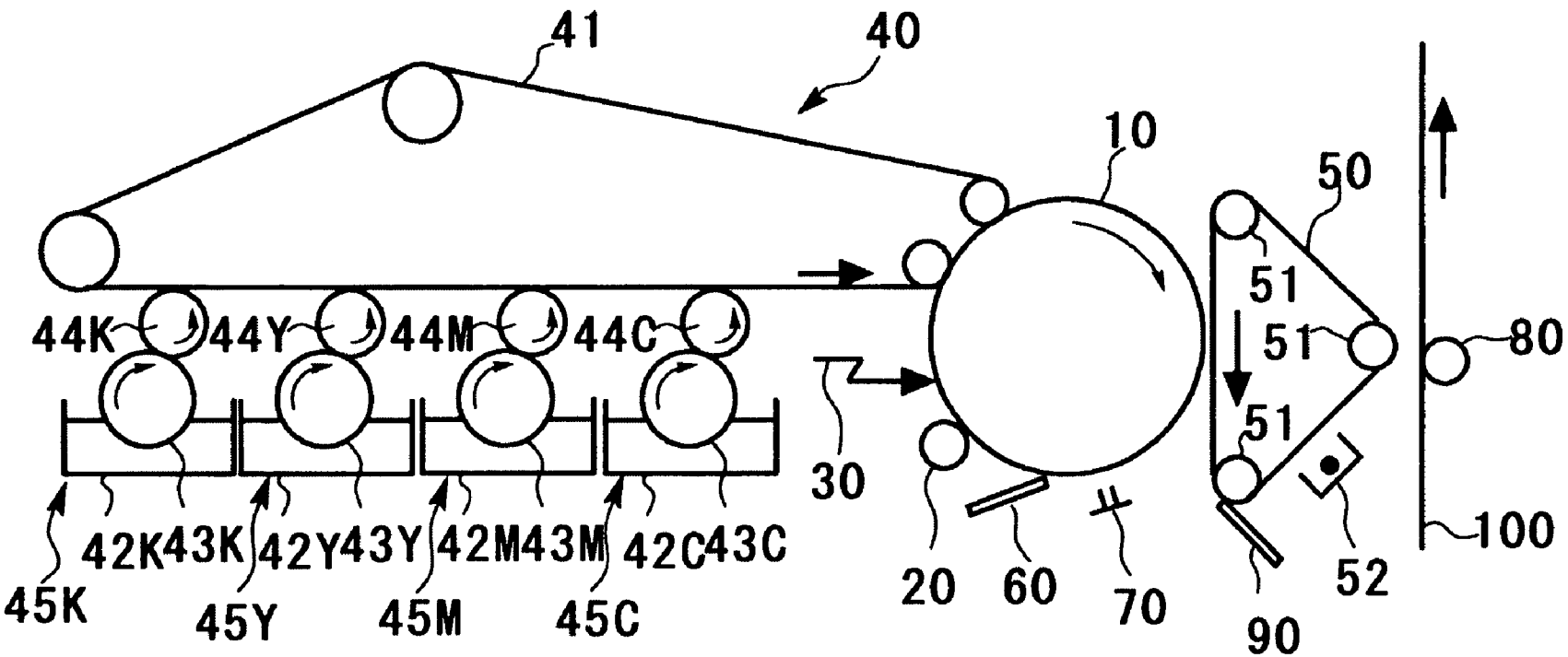
FIG. 3 is a schematic view to show an exemplary construction of an image forming apparatus according to the present invention.

FIG. 3 is a schematic view to show an exemplary construction of an image forming apparatus according to the present invention.

—Image Forming Apparatus—

The image forming apparatus according to the present invention will be explained in the following.

—Intermediate Transfer Body—

Figure 4:
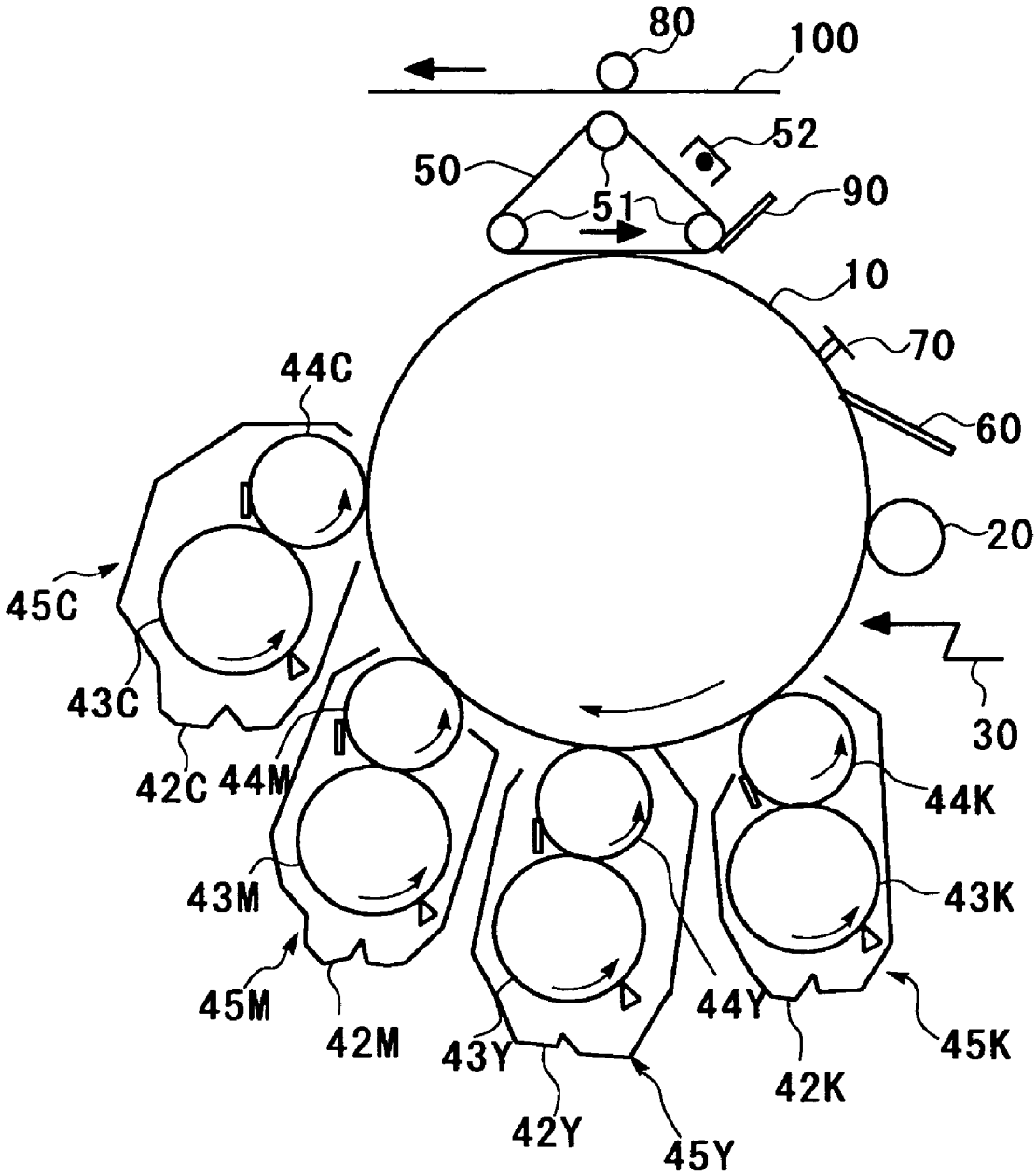
FIG. 4 is a schematic view to show an exemplary construction of an image forming apparatus according to the present invention.

An embodiment of the intermediate transfer body of a transfer system will be described. FIG. 4 is a view of a schematic configuration of a copier of the embodiment. Around photoconductor drum (hereinafter referring to as "photoconductor") 10 as an image substrate, charging roller 20 as a charging device, exposing device 30, cleaning device 60 having a cleaning blade, diselectrifying lamp 70 as a device to remove charge, image developer 40, and intermediate transfer body 50 are arranged. The intermediate transfer body 50 is configured so that it is suspended by a plurality of suspension rollers 51, and moves in the direction of the arrow by driving means such as a motor (not shown) in a manner of an endless belt.

One or more of the suspension rollers 51 has an additional role as a transfer bias roller, which supplies a transfer bias to the intermediate transfer body, and a power supply (not shown) applies a desired transfer bias voltage thereto. Additionally, a cleaning device 90 having a cleaning blade for the intermediate transfer body 50 is also arranged. Further, transfer roller 80 is positioned facing the intermediate transfer body 50 as transfer means to transfer a developed image to a sheet of support paper 100, which is the final support material. A power supply (not shown) applies a transfer bias voltage to the transfer roller 80. Moreover, corona charger 52 as a charging device is located by the intermediate transfer body 50.

The image developer 40 comprises developing belt 41 as a developer support, a black (hereinafter Bk) developing unit 45K, yellow (hereinafter Y) developing unit 45Y, magenta (hereinafter M) developing unit 45M, and cyan (hereinafter C) developing unit 45C, the developing units positioned around the developing belt 41. In addition, the developing belt 41 is configured so that it is suspended by a plurality of belt rollers, and by driving means such as a motor or the like (not shown), is advanced to the direction of the arrow in a manner of an endless belt. The developing belt 41 moves at substantially the same speed as the photoconductor 10 at a section where the two contact each other.

Since the configurations of the developing units are common, only the Bk developing unit 45K will be described, and for other developing units 45Y, 45M, and 45C, components that correspond to those in the Bk developing unit 45K are shown in the figure with the same reference numbers followed by a letter Y, M, and C, respectively, and their descriptions are omitted. The developing unit 45K comprises a developing tank 42K that contains a solution of developer of high viscosity and high density including toner particles and carrier liquid component, a scooping roller 43K that is positioned so that its lower portion is dipped in the liquid developer in the developing tank 42K, and a applying roller 44K that receives the developer scooped by the scooping roller 43K, makes a thin layer of the developer, and applies the developer to the developing belt 41. The applying roller 44K is electrically conductive, and a power supply (not shown) applies a desired bias thereto.

With regards to the device configuration of the copier of this embodiment, a device configuration different from the one shown in FIG. 1 may be employed in which a developing unit of each color is located around a photoconductor 10, as shown in FIG. 2.

Next, the operation of the copier of the embodiment will be described. In FIG. 1, the photoconductor 10 is rotationally driven in the direction of the arrow and is uniformly charged by the charging roller 20. Then, the exposing device 30 uses reflected light from the original document passing through an optical system (not shown) and forms an electrostatic latent image on the photoconductor 10. The electrostatic latent image is then developed by the image developer 40, and a toner image as a visualized (developed) image is formed. A thin layer of developer on the developing belt 41 is released from the belt 41 in a form of a thin layer by a contact with the photoconductor in a developing region, and is moved to the portion where the latent image is formed on the photoconductor 10. The toner image developed by the image developer 40 is transferred to the surface of the intermediate transfer body 50 at a portion of contact (primary transfer region) of the photoconductor 10 and the intermediate transfer body 50 that is moving at the same speed (primary transfer). In a case when three colors or four colors are transferred and overlaid, the process is repeated for each color to form a color image on the intermediate transfer body 50.

The corona charger 52 is placed in order to charge the overlaid toner image on the intermediate transfer body at a position that is downstream of the contact section of the photoconductor 10 and the intermediate transfer body 50, and that is upstream of the contact section of the intermediate transfer body 50 and the sheet of support paper 100 with regards to the direction of the rotation of the intermediate transfer body 50. Then, the corona charger 52 provides a charge to the toner image the polarity of which is the same as that of the toner particles that form the toner image, and gives a sufficient charge for a good transfer to the sheet of support paper 100. After being charged by the corona charger 52, the toner image is transferred at once to the sheet of support paper 100 that is carried in the direction of the arrow from a sheet feeder (not shown) by a transfer bias of the transfer roller 80 (secondary transfer). Thereafter, the sheet of support paper 100 to which the toner image is transferred is detached from the photoconductor 10 by a detaching device (not shown), and fusing is conducted thereto by a fusing device (not shown). After that, the sheet 100 is ejected from the device. On the other hand, after the transfer, the cleaning device 60 removes and retrieves toner particles that are not transferred from the photoconductor 10, and the charge removing lamp 70 removes remaining charge from the photoconductor 10 to prepare for the next charging.

The static friction coefficient of the intermediate transfer body is preferably 0.1 to 0.6, more preferably 0.3 to 0.5. The volume resistance of the intermediate transfer body is preferably several Ω·cm or more and $10^3$ Ω·cm or less. By controlling the volume resistance from several Ω·cm to $10^3$ Ω·cm, charging of the intermediate transfer body itself is prevented. It also prevents uneven transfer at secondary transfer because the charge that is provided by charging means does not remain as much. In addition, it is easier to apply transfer bias for the secondary transfer.

The materials for the intermediate transfer body in not particularly limited, and all materials known to the art can be used. Examples are named hereinafter.

(1) Materials with high Young's moduli (tension elasticity) used as a single layer belt, which includes polycarbonates (PC), polyvinylidene fluoride (PVDF), polyalkylene terephthalate (PAT), blend materials of PC/PAT, ethylene tetrafluoroethylene copolymer (ETFE)/PC, and ETFE/PAT, thermosetting polyimides of carbon black dispersion, and the like. These single layer belts having high Young's moduli are small in their deformation against stress during image formation and are particularly advantageous in that mis-registration is not easily formed when forming a color image.

(2) A double or triple layer belt using the above-described belt having high Young's modulus as a base layer, added with a surface layer and an optional intermediate layer around the peripheral side of the base layer. The double or triple layer belt has a capability to prevent print defect of unclear center portion in a line image that is caused by the hardness of the single layer belt.

(3) A belt with a relatively low Young's modulus that incorporates a rubber or an elastomer. This belt has an advantage that there is almost no print defect of unclear center portion in a line image due to its softness. Additionally, by making the width of the belt wider than driving and tension rollers and thereby using the elasticity of the edge portions that extend over the rollers, it can prevent snaky move of the belt. Therefore, it can reduce cost without the need for ribs and a device to prevent the snaky move.

Conventionally, intermediate transfer belts have been adopting fluorine resins, polycarbonates, polyimides, and the like, but in the recent years, elastic belts in which elastic members are used in all layers or a part thereof. There are issues on transfer of color images using a resin belt.

Color images are typically formed by four colors of color toners. In one color image, toner layers of layer 1 to layer 4 are formed. Toner layers are pressurized as they pass the primary transfer in which the layers are transferred from the photoconductor to the intermediate transfer belt and the secondary transfer in which the toner is transferred from the intermediate transfer belt to the sheet, which increases the cohesive force among toner particles. As the cohesive force increases, phenomena such as drop outs of letters and dropouts of edges of solid images are likely to occur. Since resin belts are too hard to be deformed by the toner layers, they tend to compress the toner layers and therefore drop out phenomena of letters are likely to occur.

Recently, the demand for printing full color images on various types of paper such as Japanese paper and paper having a rough surface is increasing. However, with sheets of paper having low smoothness, gaps between the toner and the sheet are likely to be formed at transfer and therefore miss-transfers can happen. In the transfer pressure of secondary transfer section is raised in order to increase contact, the cohesive force of the toner layers will be higher, which will result in drop out of letters as described above.

Elastic belts are used for the following aim. Elastic belts deform according to the toner layers and the roughness of the sheet having low smoothness at the transfer section. In other words, since the elastic belts deform to comply with local bumps and holes, a good contact is achieved without increasing the transfer pressure against the toner layers excessively so that it is possible to obtain transferred images having excellent uniformity without any drop out of letters even on sheets of paper of low flatness.

For the resin of the elastic belts, one or more can be selected from the group including polycarbonates, fluorine resins (ETFE, PVDF), styrene resins (homopolymers and copolymers including styrene or substituted styrene) such as polystyrene, chloropolystyrene, poly-α-methylstyrene, styrene-butadiene copolymer, styrene-vinyl chloride copolymer, styrene-vinyl acetate copolymer, styrene-maleic acid copolymer, styrene-acrylate copolymers (styrene-methyl acrylate copolymer, styrene-ethyl acrylate copolymer, styrene-butyl acrylate copolymer, styrene-octyl acrylate copolymer, and styrene-phenyl acrylate copolymer), styrene-methacrylate copolymers (styrene-methyl methacrylate copolymer, styrene-ethyl methacrylate copolymer, styrene-phenyl methacrylate copolymer, and the like), styrene-α-chloromethyl acrylate copolymer, styrene-acrylonitrile acrylate copolymer, and the like, methyl methacrylate resin, butyl methacrylate resin, ethyl acrylate resin, butyl acrylate resin, modified acrylic resins (silicone-modified acrylic resin, vinyl chloride resin-modified acrylic resin, acrylic urethane resin, and the like), vinyl chloride resin, styrene-vinyl acetate copolymer, vinyl chloride-vinyl acetate copolymer, rosin-modified maleic acid resin, phenol resin, epoxy resin, polyester resin, polyester polyurethane resin, polyethylene, polypropylene, polybutadiene, polyvinylidene chloride, ionomer resin, polyurethane resin, silicone resin, ketone resin, ethylene-ethylacrylate copolymer, xylene resin and polyvinylbutylal resin, polyamide resin, modified polyphenylene oxide resin, and the like. However, it is understood that the materials are not limited to those mentioned above.

For the rubber and elastomer of the elastic materials, one or more can be selected from the group including butyl rubber, fluorine rubber, acrylic rubber, ethylene propylene rubber (EPDM), acrylonitrilebutadiene rubber (NBR), acrylonitrile-butadiene-styrene natural rubber, isoprene rubber, styrene-butadiene rubber, butadiene rubber, ethylene-propylene rubber, ethylene-propylene terpolymer, chloroprene rubber, chlorosufonated polyethylene, chlorinated polyethylene, urethane rubber, syndiotactic 1,2-polybutadiene, epichlorohydrin rubber, silicone rubber, fluorine rubber, polysulfurized rubber, polynorbornen rubber, hydrogenated nitrile rubber, thermoplastic elastomers (such as polystyrene elastomers, polyolefin elastomers, polyvinyl chloride elastomers, polyurethane elastomers, polyamide elastomers, polyurea elastomers, polyester elastomers, and fluorine resin elastomers), and the like. However, it is understood that the materials are not limited to those mentioned above.

There are no limitations as to electric conductive agents for resistance adjustment, and examples include carbon black, graphite, metal powders such as aluminum, nickel, and the like; and electric conductive metal oxides such as tin oxide, titanium oxide, antimony oxide, indium oxide, potassium titanate, antimony tin oxide (ATO), indium tin oxide (ITO), and the like. The metal oxides may be coated on non-conducting particulates such as barium sulfate, magnesium silicate, calcium carbonate, and the like. It is understood that the conductive agents are not limited to those mentioned above.

Materials of the surface layer are required to prevent contamination of the photoconductor by the elastic material and to reduce the surface friction of the transfer belt so that toner adhesion is lessened and the cleanability and secondary transfer property are increased. For example, one or more of polyurethane, polyester, epoxy resin, and the like is used, and powders or particles of a material that reduces surface energy and enhances lubrication such as fluorine resin, fluorine compound, carbon fluoride, titanium dioxide, silicon carbide, or the like can be dispersed and used. One or more lubricant materials may be used or, alternatively, powders or particles of different sizes may be employed. In addition, it is possible to use a material such as fluorine rubber that is treated with heat so that a fluorine-rich layer is formed on the surface and the surface energy is reduced.

Several processes are listed below as examples of manufacturing processes of the belts, but the processes are not limited to these examples, and in general, two or more processes are combined for the manufacture of belts.

Examples of the processes include centrifugal forming in which material is poured into a rotating cylindrical mold to form a belt, spray application in which a liquid paint is sprayed to form a film, dipping method in which a cylindrical mold is dipped into a solution of material and then pulled out, injection mold method in which material is injected between inner and outer mold, and a method in which a compound is applied onto a cylindrical mold and the compound is vulcanized and ground.

Methods to prevent elongation of the elastic belt include using a core resin layer that is difficult to elongate on which a rubber layer is formed, incorporating a material that prevents elongation into the core layer, and the like, but the methods are not particularly related with the manufacturing processes.

For materials that prevent elongation of a core layer, one or more can be selected from the group including, for example, natural fibers such as cotton, silk and the like; synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, phenol fibers, and the like; inorganic fibers such as carbon fibers, glass fibers, boron fibers, and the like, metal fibers such as iron fibers, copper fibers, and the like, and materials is a form of a weave or thread can be used. It is understood naturally that the materials are not limited to those described above.

A thread may be one or more of filaments twisted together, and any twisting and plying is accepted such as single twisting, multiple twisting, doubled yarn, and the like. Further, fibers of different materials selected from the above-described group may be spun together. The thread may be treated before use in such a way that it is electrically conductive.

On the other hand, the weave may be of any type including plain knitting, and the like. It is naturally possible to use a union weave to apply electric conductive treatment.

The manufacturing process of the core layer is not particularly limited. For example, there is a method in which a weave that is woven in a cylindrical shape is placed on a mold or the like and a coating layer is formed on top of it. Another method uses a cylindrical weave being dipped in a liquid rubber or the like so that on one side or on both sides of the core layer, coating layer(s) is formed. In another example, a thread is wound helically to a mold or the like in an arbitrary pitch, and then a coating layer is formed thereon.

If the thickness of the elastic layer is too large, the elongation and contraction of the surface becomes large and may cause a crack on the surface layer although it depends on the hardness of the elastic layer. Moreover, if the amount of elongation and contraction is large, the size of images are elongated and contracted. Therefore, it is not preferred (about 1 mm or more).

—Charge Device—

Figure 5:
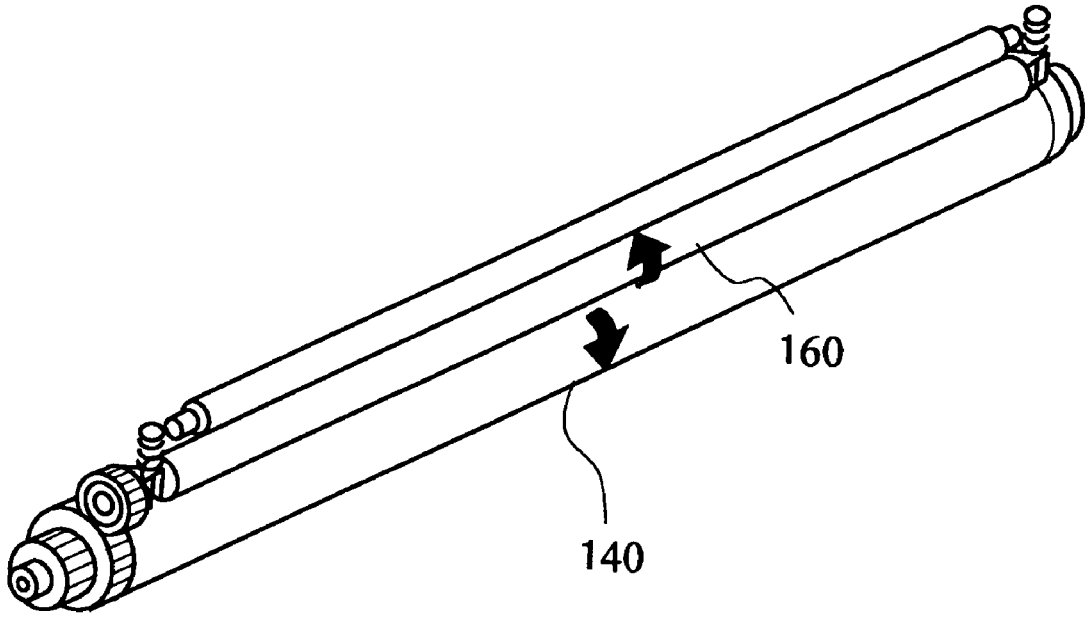
FIG. 5 is a schematic view to show an exemplary construction of an image forming apparatus that is equipped with a contact charger.

FIG. 5 is a schematic diagram showing an example of the image-forming apparatus that equips a contact charger of charging unit. The photoconductor 140 to be charged as a latent electrostatic photoconductor is rotated at a predetermined speed of process speed in the direction shown with the arrow in the figure. The charging roller 160, which is brought into contact with the photoconductor, contains a core rod and a conductive rubber layer formed on the core rod in a shape of a concentric circle. The both terminals of the core rod are supported with bearings (not shown) so that the charging roller enables to rotate freely, and the charging roller is pressed to the photoconductor at a predetermined pressure by a pressurizing member (not shown). The charging roller 160 in this figure therefore rotates along with the rotation of the photoconductor. The charging roller 160 is generally formed with a diameter of 16 mm in which a core rod having a diameter of 9 mm is coated with a rubber layer having a moderate resistance of approximately 100,000 Ω·cm.

The power supply (not shown) is electrically connected with the core rod, and a predetermined bias is applied to the charging roller by the power supply, thereby, the surface of the photoconductor 140 is uniformly charged at a predetermined polarity and potential.

The charging device in the present invention may be a non-contacting unit rather than the contacting unit described above; preferably, the contact charger is preferable since the generation of ozone is relatively little.

An alternative electric field is applied to the charging device of the image forming apparatuses of the present invention. Direct electric field typically generates a great number of $O_3^-$ and $NO_3^-$, since the photoconductor is uniformly charged. The ozone and nitrogen oxide tend to attach to the photoconductor and degrade the surface of the photoconductor; consequently, the surface of the photoconductor is hardened, the abrasion wear comes to larger, the external additive tends to deposit due to lowered friction coefficient, resulting in frequent occurrences of filming. On the contrary, alternative electric field duplicated with AC may reduce the generation of ozone etc. and the photoconductor may be charged uniformly. In particular, the alternative electric field may suppress the ozone-derived degradation of photoconductor owing to the generation of $H_3O^+$ having a reverse polarity.

The configuration of the charging device may be properly selected depending on specifications of the image forming apparatus; for example, the configuration may be magnetic brush, fur brush etc. in addition to roller. The magnetic brush is typically constructed from a charging material of ferrite particles such as Zn—Cu ferrite, a non-magnetic conductive sleeve for the support, and a magnetic roll encased therein. The fur blush is formed of a fur to which such a conductive material is applied as carbon, copper sulfide, metals, or metal oxides; the fur is wounded or adhered to the other metals or conductive materials to form a charging device.

—Cleaning Device—

Preferably, the cleaning device of the photoconductor is a cleaning blade, and the cleaning is performed through a counter contact at a contact angle of 15° to 40° between the cleaning blade and the photoconductor.

Figure 6:
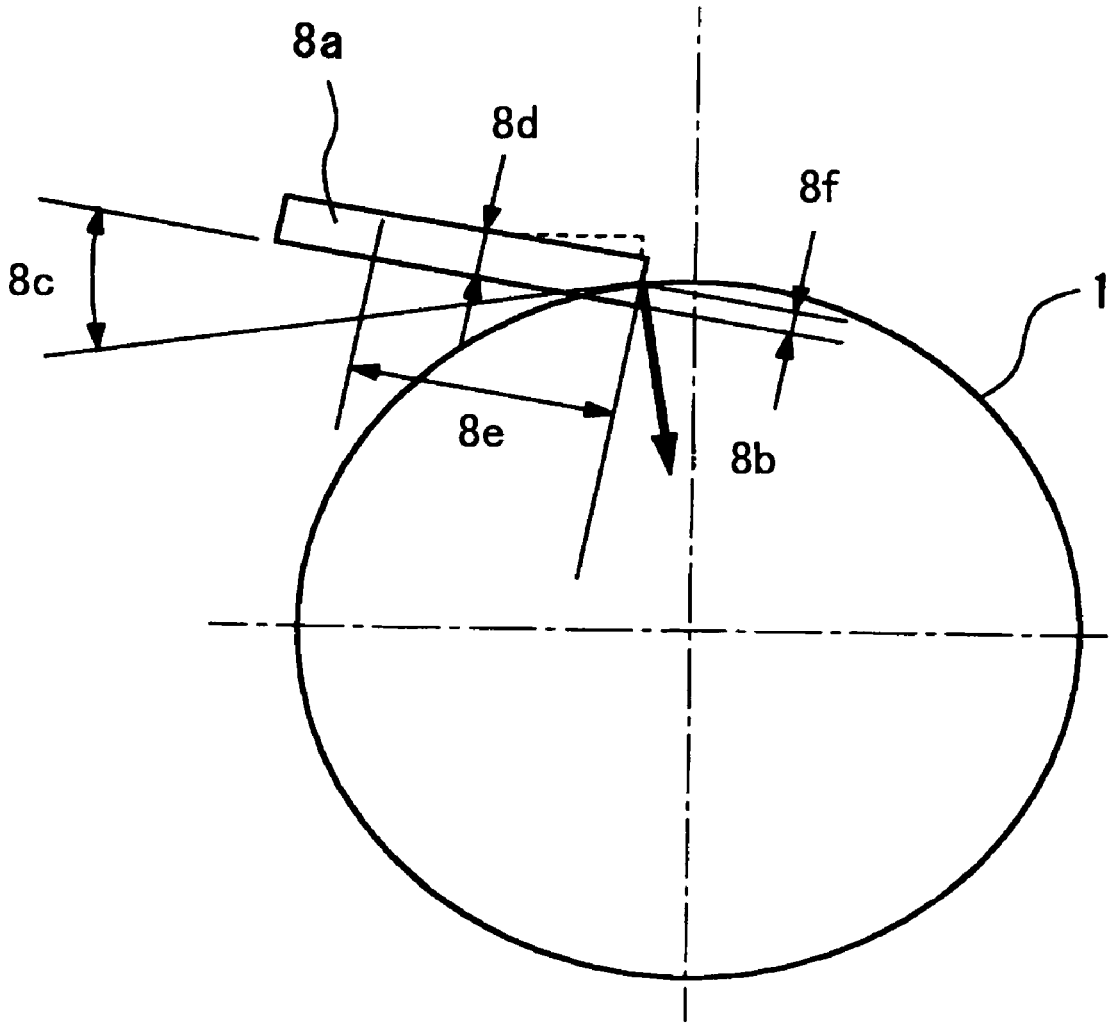
FIG. 6 is a schematic view to show an exemplary condition of a cleaning blade in a cleaning device available in the present invention.

FIG. 6 is a schematic view to show the contacting condition the cleaning blade. The contact manner of the cleaning blade 8*a* may be either counter contact or trail contact; preferable is the counter contact, since higher cleanability and less abrasion wear may be attained at less contact angle with the photoconductor 1.

Preferably, the contact angle 8*c* of the cleaning blade is 15° to 40° from the tangent line at the contact portion. When the contact angle is less than 15°, the cleaning tends to be inferior due to toner passing, and when the contact angle is less than 40°, the blade may possibly swirl.

Preferably, the cleaning blade applies a contact pressure 8*b* of 5 g/cm$^2$ to 50 g/cm$^2$ against the photoconductor. When the contact pressure 8*b* is below 5 g/cm$^2$, the toner of about 2 μm or less is hardly cleaned, and when above 50 g/cm$^2$, the tip of the cleaning blade 8*a* may be rounded or bounded, and inferior cleaning such as local flocculation is easily induced, thus cleanability is deteriorated.

Preferably, the cleaning blade 8*a* exhibits 65 to 85 of Hardness in JIS-A. When the Hardness in JIS-A is less than 65, the cleaning blade 8*a* may deform significantly, easily resulting in inferior cleaning, and when the Hardness in JIS-A is above 85, the wear of photoconductor tends to increase, resulting in shorter lifetime of the image forming apparatus. Preferably, the cleaning blade 8*a* is fixed or consolidated to the support in order to maintain the contact angle and the contact pressure consistently. In FIGS. 6, 8*d*, 8*e*, and 8*f* indicate the thickness, length, and bite of the cleaning blade 8*a*.

Preferably, the cleaning device of the image forming apparatus according to the invention comprises an elastomeric cleaning blade.

The cleaning system to clean the surface of photoconductors may be of rotary brush, blade, sucking, or the like. Among these, blade system is popular from the viewpoint of simple construction and higher efficiency. In the cleaning device based on blade system, the cleaning blade is formed from an elastic member such as of rubber material, the toner on the photoconductor is removed by sliding the elastomeric cleaning blade on the photoconductor.

The cleaning blade may be formed of a urethane rubber. The urethane rubber is a preferable material in light of effective cleanability, less deformability under environmental change, less damage onto photoconductors, adjustability of blade condition such as pressure and angle, wear resistance, stable cleanability with time, and the like.

Polyurethane is synthesized from isocyanate compounds and polyol compounds. The urethane rubber of the cleaning blade may be properly produced from plenty species of those compounds.

Examples of the isocyanate compounds include, tolylenediisocyanate, 4,4-diphenylmethane diisocyanate, 1,5-naphtalene diisocyanate, triphenylmethane triisocyanate, tolidine diisocyanate, xylene diisocyanate, hexamethylene diisocyanate, dicyclohexylmethane diisocyanate, and isophorone diisocyanate.

Polyol compounds are exemplified by polyether polyol, polyester polyol, acrylpolyol, and epoxy polyol. Examples of the monomers to synthesize acrylpolyol include methyl acrylate, ethyl acrylate, isopropyl acrylate, n-butyl acrylate, 2-ethylhexyl acrylate, ethyl methacrylate, isopropyl methacrylate, n-butyl methacrylate, isobutyl methacrylate, n-hexyl methacrylate, lauryl methacrylate, acrylic acid, methacrylic acid, maleic acid, itaconic acid, 2-hydroxyethyl methacrylate, hydroxylpropyl methacrylate, 2-hydroxyethyl acrylate, hydroxypropyl acrylate, acrylamide, N-methylol acrylamide, diacetone acrylamide, glycidyl methacrylate, styrene, vinyl toluene, vinyl acetate, and acrylonitrile.

Preferably, in the image forming apparatus according to the present invention, there exists a filler-containing region at the uppermost layer of the photoconductor, and the filler-containing region exhibits a Vickers hardness of 20.6 to 50.0. When the Vickers hardness is lower than 20.6, the durability is possibly insufficient due to abrasion of the photoconductor, resulting in inferior images such as image blur and unstable density. When the Vickers hardness is higher than 50.0, the photoconductor possibly suffers from filming due to excessively less scribing of the surface, resulting in image blur, inferior density, flog, and the like.

Preferably, the filler included into the photoconductor is inorganic fine particles of which the whiteness is 60 to 100 determined on the base of JIS P 8148.

When the whiteness of the filler is less than 60, the hardness of the photoconductor surface is insufficient, resulting in inferior images such as image blur and unstable density similarly to above. When the whiteness is higher than 100, the photoconductor possibly suffers from filming, resulting in image blur, inferior density, flog, and the like.

Preferably, the filler is alumina particles of which the number average particle diameter is 100 nm to 500 nm. Alumina is most preferably employed from the viewpoint that it exhibits higher hardness among metal oxides, provides no adverse effect on charge transfer in photoconductors, exhibits proper dispersibility at the surface of photoconductors, represents sufficient whiteness, provide appropriate affinity with photosensitive resins and charge transfer substances, and proper particle diameter is selectable.

When the number average particle diameter is less than 100 nm, the hardness at the uppermost layer of photoconductors is insufficient, resulting in inferior images such as image blur and unstable density similarly to above. When the number average particle size is higher than 500 nm, the photoconductor possibly suffers from filming, resulting in image blur, inferior density, flog, and the like.

—Photoconductor—

In the photoconductor of image forming apparatus according to the present invention, preferably, the volume % of the filler is 4% to 20% at the area from the surface to the depth of 5 μm.

Examples of the filler include silica, tin oxide, zinc oxide, titanium oxide, alumina, zirconia, indium oxide, antimony oxide, bismuth oxide, calcium oxide, antimony-doped indium oxide, and tin-doped indium oxide. Such metal oxides may improve mechanical durability owing to higher hardness, and provide higher image quality owing to suppressed optical scattering derived from appropriate affinity with solvents. Further, various possible surface-treatment may improve the dispersibility and electrostatic property.

The filler is added to the photoconductor in order to enhance the durability and hardness in particular. When the content of the filler is below 4% by volume at the region from the surface to the depth of 5 μm, the effect is often insufficient. The reason is believed that the contact area is insufficient between the filler particles exposed on the photoconductor and toner particles. When the content of the filler is above 20 volume %, the content of the binder resin is smaller inevitably, thus the mechanical strength is insufficient at the uppermost layer and the wear resistance is poor.

In the present invention, an amorphous silicon photoconductor (hereinafter referring to as "a-Si photoconductor") may be employed which is produced by way of heating a conductive support to 50° C. to 400° C. and depositing on the conductive support a photoconductive layer of amorphous silicon through vacuum deposition, spattering, ion-plating, thermal CVD, optical CVD, plasma CVD, or the like. Among these, preferable method is plasma CVD in which raw material gas is decomposed by glow discharge of direct current, high frequency, or microwave, and then a-Si is deposited on the substrate to form an a-Si film.

Figure 7A:
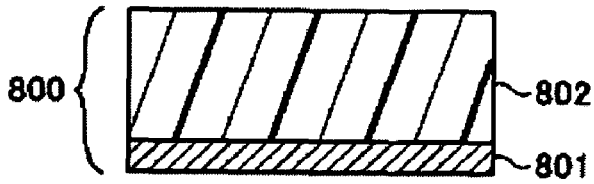
FIG. 7A is a schematic view to show an exemplary construction of a photoconductor.
Figure 7B:
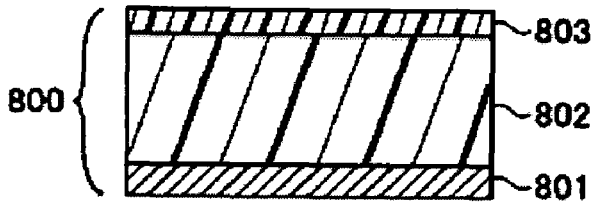
FIG. 7B is a schematic view to show another exemplary construction of a photoconductor.
Figure 7C:
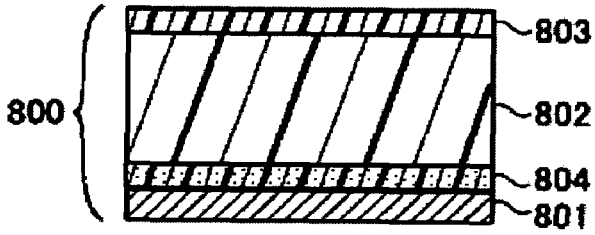
FIG. 7C is a schematic view to show still another exemplary construction of a photoconductor.
Figure 7D:
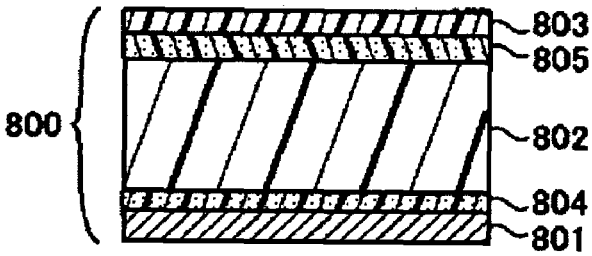
FIG. 7D is a schematic view to show still another exemplary construction of a photoconductor.

The amorphous silicon photoconductor has a layer structure of as follow. FIGS. 7A to 7D are schematic diagrams which explain the layer structure of the amorphous silicon photoconductor. In FIG. 7A, electrophotographic photoconductor 800 has substrate 801 and photoconductive layer 802 on the substrate 801. The photoconductive layer 802 is formed of a-Si: H, X, and exhibits photoconductivity. In FIG. 7B, electrophotographic photoconductor 800 has substrate 801, photoconductive layer 802 formed of a-Si: H, X and amorphous silicon surface layer 803. In FIG. 7D, electrophotographic photoconductor 800 has substrate 801, photoconductive layer 802 formed of a-Si: H, X, amorphous silicon surface layer 803 and amorphous silicon charge injection inhibiting layer 804. In FIG. 7D, electrophotographic photoconductor 800 has substrate 801 and photoconductive layer 802 on the substrate 801. The photoconductive layer 802 consists of charge generating layer 805 formed of a-Si: H, X and charge transporting layer 806. The electrophotographic photoconductor 800 further has amorphous silicon surface layer 803 on the photoconductive layer 802.

The substrate of the photoconductor may be conductivity or isolating. Examples of the conductive substrate include metals such as Al, Cr, Mo, Au, In, Nb, Te, V, Ti, Pt, Pd, Fe and the like, and alloys thereof such as stainless alloy and the like. Also, it can be use as a substrate that an insolating substrate such as a film or sheet of synthetic resin, e.g., polyester, polyethylene, polycarbonate, cellulose acetate, polypropylene, polyvinyl chloride, polystyrene, polyamide, or the like, glass, ceramic, in which at least a surface where faces to a photoconductive layer is treated to yield conductivity.

The shape of the substrate may be cylindrical, plate, or endless belt, which has a smooth or irregular surface. The thickness of thereof can be adjusted so as to form a predetermined photoconductor. In the case that flexibility is required to the photoconductor, the substrate can be as thinner as possible, provided that efficiently functioning as a substrate. The thickness of the substrate is generally 10 μm or more from the viewpoints of manufacture, handling, mechanical strength, and the like.

In the photoconductor used in the present invention, it is effective to dispose a charge injection inhibiting layer, which inhibits a charge injection from a conductive substrate, between the conductive substrate and the photoconductive layer (see FIG. 7). The charge injection inhibiting layer has a polarity dependency. Namely, when charging of single polarity is applied to a free surface of the photoconductor, the charge injection inhibiting layer functions so as to inhibit a charge injection from the conductive substrate to the photoconductive layer, and when charging of opposite polarity is applied, the charge injection inhibiting layer does not function. In order to attain such function, the charge injection inhibiting layer has relatively a lot of atoms which control a conductivity, compared with the photoconductive layer.

The thickness of the photoconductive layer is preferably about 0.1 μm to about 5 μm, more preferably 0.3 μm to 4 μm, and furthermore preferable 0.5 μm to 3 μm.

The photoconductive layer is disposed above the undercoat layer. The thickness of the photoconductive layer is not particularly limited, provided that obtaining a predetermined electrophotographic property and cost efficiency. The thickness thereof is preferably about 1 μm to about 100 μm, more preferably 20 μm to 50 μm, and furthermore preferably 23 μm to 45 μm.

The charge transporting layer is, in the case that the photoconductive layer is divided by its functions, a layer which mainly functions to transport charge. The charge transporting layer contains at least a silicon atom, a carbon atom, and a fluoride atom as its essential component. If needed, the charge transporting layer further contains a hydrogen atom and an oxygen atom so that the charge transporting layer is formed of a-SiC (H,F,O). Such charge transporting layer exhibits desirable photoconductivity, especially charge holding property, charge generating property, and charge transporting property. It is particularly preferable that the charge transporting layer contains an oxygen atom.

The thickness of the charge transporting layer is suitably adjusted so as to obtain desirable electrophotographic property and cost efficiency. The thickness thereof is preferably about 5 μm to about 50 μm, more preferably 10 μm to 40 μm, and the most preferably 20 μm to 30 μm.

The charge generating layer is, in the case that the photoconductive layer is divided by its functions, a layer which mainly functions to generate charge. The charge generating layer contains at least a silicon atom as an essential component and does not substantially contain a carbon atom. If needed, the charge generating layer further contains a hydrogen atom so that the charge generating layer is formed of a-Si:H. Such charge generating layer exhibits desirable photoconductivity, especially charge generating property and charge transporting property.

The thickness of the charge generating layer is suitably adjusted so as to obtain desirable electrophotographic property and cost efficiency. The thickness thereof is preferably about 0.5 μm to about 15 μm, more preferably 1 μm to 10 μm, and the most preferably 1 μm to 5 μm.

The amorphous silicon photoconductor used in the present invention may further contain a surface layer disposed on the photoconductive layer which is formed on the substrate as mentioned above. It is preferred to contain an amorphous silicon surface layer. The surface layer has a free surface so that desirable properties such as moisture resistance, repeating property, electric pressure tightness, environmental capability, wear resistance and the like.

The thickness of the surface layer is generally about 0.01 μm to about 3 μm, preferably 0.05 μm to 2 μm, and more preferably 0.1 μm to 1 μm. When the thickness thereof is less than about 0.01 μm, the surface layer is worn out during usage of the photoconductor. When the thickness thereof is more than about 3 μm, electrophotographic property is impaired such as an increase of residual charge, and the like.

Such amorphous silicon photoconductors exhibit higher surface hardness, have high sensitivity with light with long wavelength such as semiconductor laser light of 770 nm to 800 nm, are resistant to degradation caused by repetitive use and are thereby used as electrophotographic photoconductors, for example, in high-speed copiers and laser beam printers (LBP).

—Fixing Device (SURF Fixing)—

Figure 8:
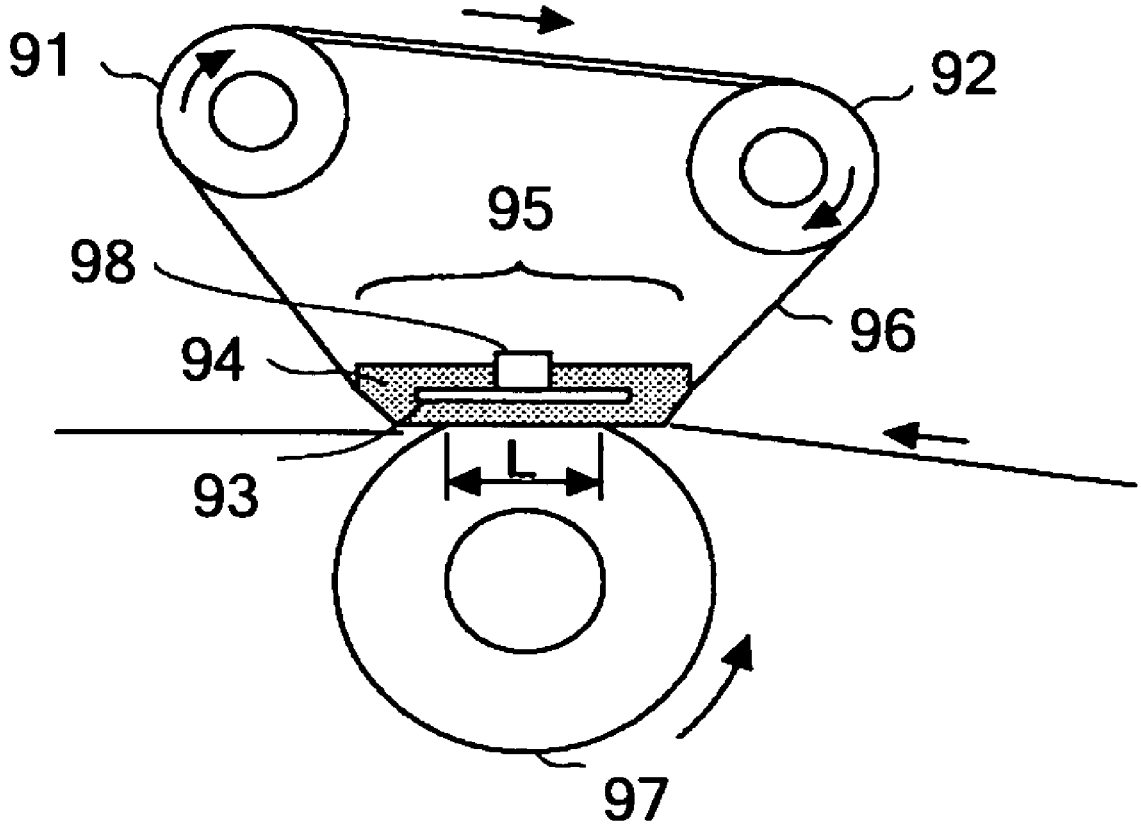
FIG. 8 is a schematic view to show a SURF fixing device.
Figure 9:
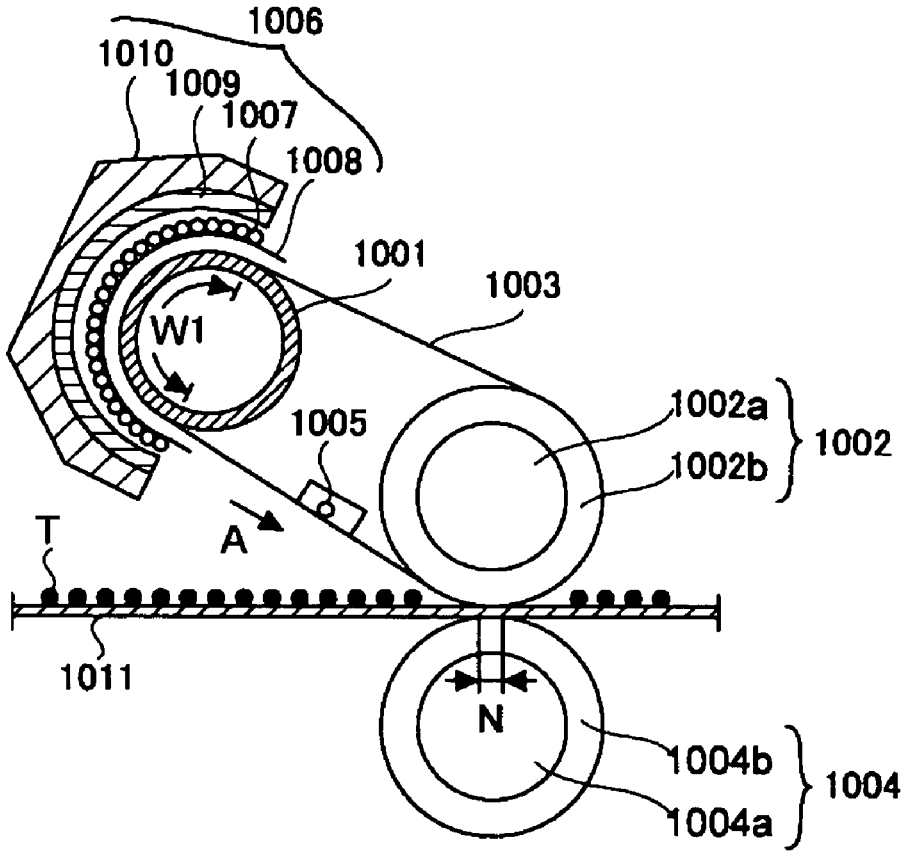
FIG. 9 is a schematic view to show an IH fixing device.
Figure 10A:
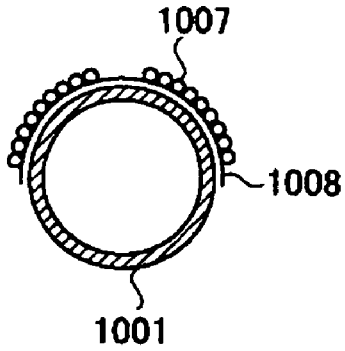
FIG. 10A is another schematic view to show an IH fixing device.
Figure 10B:
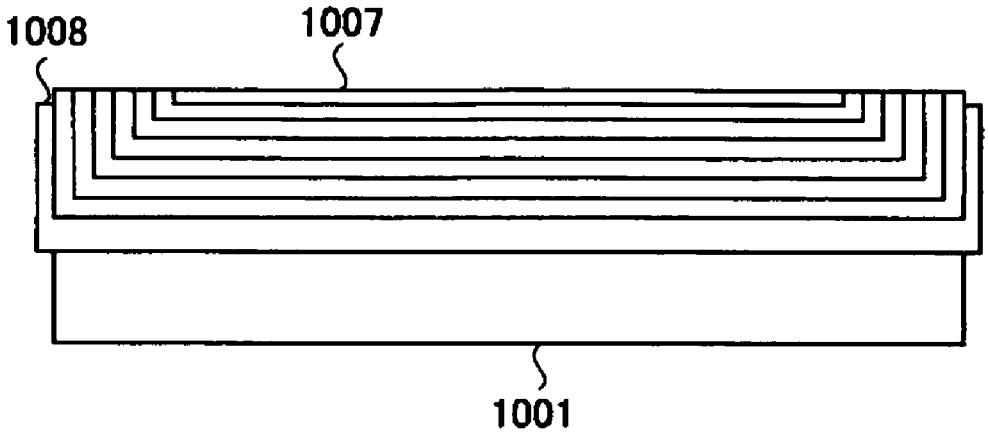
FIG. 10B is still another schematic view to show an IH fixing device.

With reference to FIG. 8, the fixing device is a SURF (surface rapid fusing) fixing device in which fixing is carried out by rotating a fixing film. Specifically, the fixing film 96 is a heat-resistant film in a form of an endless belt, and the fixing film is spanned around driving roller 91 which is a supportive rotator of the fixing film, driven roller 92, and heater 93 which is disposed downside. Heating device 95 is constructed from heater 93, support 94 on which thermosensor 98 is disposed.

The driven roller 92 performs also as a tension roller of fixing film 96. The fixing film 96 is driven and thereby rotates in a clockwise rotating direction as shown in the figure by the driving roller 91. This rotating speed is controlled so to travel at the same speed as a transfer medium S in a nip region L in which the pressurizing roller 97 and the fixing film 96 come in contact with each other.

The pressurizing roller 97 has a rubber elastic layer having an excellent releasing ability, such as silicone rubber. The pressurizing roller 97 rotates in a counterclockwise direction so as to adjust a contact pressure at 4 kg to 10 kg with respect to the fixing nip region L.

The fixing film 96 preferably has excellent heat resistance, releasing ability and wearing resistance. The thickness thereof is generally 100 μm or less, and preferably 40 μm or less. Examples of the fixing film are single or multi layered film of heat resistant resins such as polyimide, poly(ether imide), PES (poly(ether sulfide)), and PFA (tetrafluoroethylene-perfluoroalkyl vinyl ether copolymer). Specific examples may be a film having a thickness of 20 μm in which a releasing coat layer of 10 μm thickness, formed of electroconducting agent-added fluoride resin such as PTFE (polytetrafluoroethylene resin), PFA, or an elastic layer such as fluorocarbon rubber or silicone rubber is disposed on the side in contact with an image.

In FIG. 8, the heating device 95 in this embodiment contains the flat substrate 94 and fixing heater 93. The flat substrate 94 is formed of a material having high thermal conductivity and high electric resistance, such as alumina. On the surface of the heating member 95 where the fixing film 96 is in contact with, the fixing heater 93 formed of a resistant heating element is disposed so that the longer side of the fixing heater lies along the traveling direction of the fixing film. Such fixing heater 93 is, for example, screen printed with electric resistant material such as Ag/Pd or $Ta_2N$ in liner stripe or band stripe. Moreover, two electrodes (not shown) are disposed at both ends of fixing heater 93 so that the resistant heating element generates a heat by energizing between the electrodes. Further, on a side of the flat substrate 94 opposite to the fixing heater 93, a fixing thermal sensor 98 formed of thermistor is disposed.

Thermal information of the flat substrate is detected by the fixing thermal sensor and is sent to a controller so that quantity of electricity applied to the fixing heater is controlled, thus the heating member is controlled at a predetermined temperature.

The fixing device is not limited to the SURF fixing device in the present invention. The SURF fixing device is preferred in that image forming apparatuses may be provided with higher efficiency and shorter warm-up.

—Fixing Device (Electromagnetic Induction Heating (IH))—

The fixing device may be a fixing device based on electromagnetic induction heating (IH fixing device), in which Joule heat is generated by eddy current induced within a conductive material from alternative magnetic filed.

FIG. 7 shows an example of the image fixer. The image fixer shown in FIG. 7 comprises a heat roller 1001 heated by electromagnetic induction of an electromagnetic induction heating unit 1006; a fixing roller 1002 placed in parallel with the heat roller 1001; an endless-shaped heat resistant belt (toner heating medium) heated by the heat roller 1001 and rotated in the direction shown with an arrow A by at least any one of the rollers; and a pressure roller 1004 which is pressed to the fixing roller 1002 through a belt 1003 and rotates forwardly relative to the belt 1003.

The heat roller 1001 is a hollow-body and cylindrical-shape made of a magnetic metal member, such as iron, cobalt, nickel, or an alloy thereof and is configured to have a fast temperature rising property with a low thermal capacity, for example, designed to have an outer diameter of 20 mm and a wall thickness of 0.1 mm.

The fixing roller 1002 comprises, a cored bar 1002*a* made from a metal such as stainless-steel; and an elastic member 1002*b* coating the cored bar 1002*a* with a heat-resistant silicone rubber in a solid or foamed condition. Furthermore, to form a contact area having a given width between the pressure roller 1004 and the fixing roller 1002 by means of pressuring force from the pressure roller 1004, the outer diameter of the fixing roller 1002 is designed to be 40 mm and is made larger than that of the heat roller 1001. The elastic member 1002*b* is designed to have a wall thickness of about 3 to 6 mm, and a hardness of about 40° to 60° (Asker hardness). The configuration makes the heat roller 1001 quickly heated to shorten the warm-up time, because the thermal capacity of the heat roller 1001 becomes smaller than that of the fixing roller 1002.

The belt 1003 spanned over the heat roller 1001 and the fixing roller 1002 is heated at the area W1 which is in contact with the heat roller 1001 heated by action of an electromagnetic induction heating unit 1006. And the inner surface of the belt 1003 is continuously heated by rotations of the rollers of 1001 and 1002 to be consequently heated throughout the belt.

The pressure roller 1004 comprising a cored bar 1004*a* made from a cylindrical member of a high-thermal conductive metal such as copper or aluminum; and an elastic member 1004*b* having high heat resistance and toner releasing properties provided on the surface of the cored bar 1004*a*. In addition to the above-noted metals, SUS may be used for the cored bar 1004*a*.

The pressure roller 1004 presses the fixing roller 1002 through the belt 1003 to form the fixing nip portion N. In this aspect, by making the hardness of the pressure roller 1004 harder than that of the fixing roller 1002, the formation that the pressure roller 1004 makes inroads into the fixing roller 1002 (and the belt 1003) is taken, thereby it is possible to give the effect to facilitate a recording material 1011 separating from the surface of the belt 1003, because the recording material 1011 is arranged along the circumferential shape of the surface of the pressure roller 1004.

The electromagnetic induction heating unit 1006 which heats the heat roller 1001 by means of electromagnetic induction has, as shown in FIG. 7 and FIG. 8*a* and FIG. 8*b*, an exciting coil 1007 as a magnetic field generating unit; and a coil guide plate 1008 to which the exciting coil 1007 is rolled up. The coil guide place 1008 is disposed closely to the outer circumferential surface of the heat roller 1001 in a half cylinder shape. As shown in FIG. 8*b*, the exciting coil 1007 is the one that a long exciting coil wire rod is alternately rolled up along the coil guide plate 1008 in the axial direction of the heat roller 1001.

It is noted that the oscillation circuit of the exciting coil 1007 is connected to a frequency-variable driving power source (not shown).

At the outside of the exciting coil 1007, an exciting coil core 1009 which is made from a ferromagnetic element, such as ferrite and is in a half cylinder shape is fixed to an exciting coil core supporting member 1010 and closely disposed to the exciting coil 1007. It is noted that in the aspect of the present invention an exciting coil core 1009 having a relative permeability of 2500 is used.

A high-frequency alternating current of 10 kHz to 1 MHz, and preferably 20 kHz to 800 kHz is supplied from the driving power supply to the exciting coil 1007, thereby an alternate magnetic field occurs. The alternate magnetic field works on the heat roller 1001 and the heat generation layer 1003*a* of the belt 1003 at the contact area W1 of the heat roller 1001 and the heat-resistant belt 1003 and in the vicinity thereof. Inside of them, eddy currents I flow in the direction that prevents alternate magnetic field changes.

The eddy currents I induce the Joule heat depending on the resistances of the heat roller 1001 and the heat generation layer 1003*a* to make the belt 1003, which has the heat roller 1001 and the heat generation layer 1003*a*, heated by means of electromagnetic induction mainly in the contact area between the heat roller 1001 and the heat generation layer 1003*a* and the vicinity thereof.

In the heated thermo-resistant belt 1003 is measured for the internal-surface temperature by thermo sensitive device 1005 such as a high-sensitive thermistor, which is disposed around the inlet of the fixing nip portion N and arranged to contact with the internal surface of the thermo-resistant belt 1003.

Figure 11:
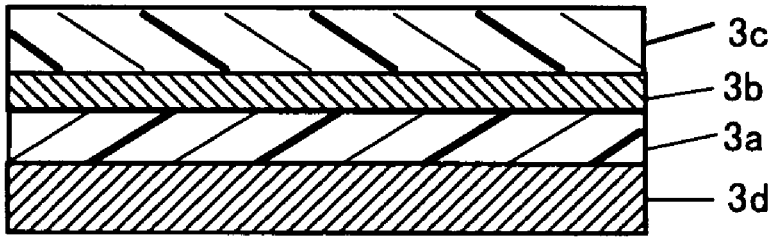
FIG. 11 is a schematic view to show an exemplary construction of a belt available in the present invention.
Figure 12:
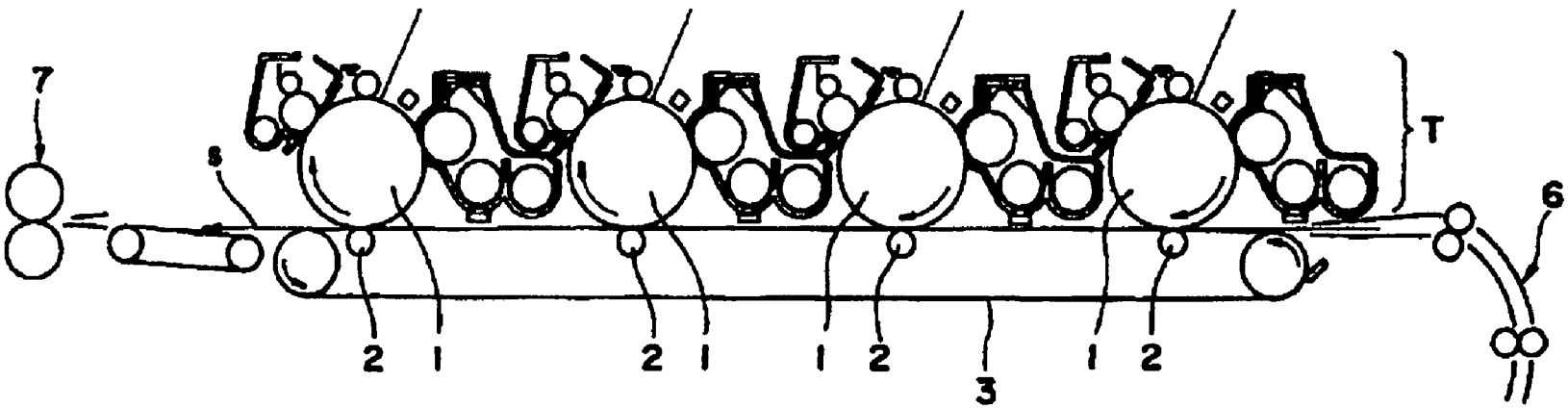
FIG. 12 is a schematic view to show an exemplary construction of a color-image forming apparatus of tandem type according to the present invention.

FIG. 11 is a schematic view to show an exemplary construction of a belt utilized in a fixing device based on electromagnetic induction heating. The construction of belt is of four layers as follows, substrate 3*d*: resin layer such as polyimide resin; heating layer 3*a*: magnetic metal such as Ni, Ag, SUS etc.; intermediate layer 3*b*: elastic layer for uniform fixing; and surface layer or release layer 3*c*: fluorine resin for release and oilless.

Preferably, the thickness of the release layer 3*c* is 10 μm to 300 μm, more preferably 200 μm. In this range, the surface layer of belt may enclose sufficiently toner image T on the recording material, thus toner image T may be heated and melted uniformly.

Preferably, the thickness of release layer 3*c* is at least 10 μm in order to assure the wear resistance with time. When the thickness of release layer 3*c* is larger than 300 μm, the thermal capacity of the belt is so large that the period for warm-up is extended. In addition, in the toner fixing process, the belt surface temperature hardly decrease in the fixing step, resulting in so-called hot offset phenomenon where flocculation effect of the toner dissolved at the exit of fixed portion cannot be obtained, and toner releasing properties of the belt decreases to make toner adhered to the belt.

A heating layer such as silver foil is provided inside the belt to heat by means of electromagnetic induction, thereby the surface of the belt may be heated efficiently. Preferably, a heating roller is combined that is heated by electromagnetic induction for higher thermal efficiency.

Preferably, the device for generating electromagnetic induction is provided apart from the heating portion. The reason is that the device for generating electromagnetic induction inside the heating roller inevitably leads to excessively large diameter of the heating roller, which requires the increase of pressure resistance of the heating roller, thus the thickness of the round layer should be increased and the thicker layer decreases the thermal efficiency. The device for generating electromagnetic induction disposed outside the heating roller may provide conveniences in terms of temperature control and entire construction.

As such, the IH fixing device is preferred in that the heat-transfer efficiency is higher than that of heating rollers, warm-up period is easily be shortened, thus quick start and energy conservation may be involved into image forming apparatuses.

—Image Developer—

In an image developer in the present invention, a power supply applies vibration bias voltage as developing bias, in which voltage direct current and alternating voltage are superpositioned, to a developing sleeve during developing. The potential of background part and the potential of image part are positioned between maximum value and minimum value of the vibration bias potential. This forms an alternating field in which directions alternately change at developing region. A toner and a carrier are intensively vibrated in this alternating field, so that the toner overshoots the electrostatic force of constraint from the developing sleeve and the carrier, and leaps to the photoconductor. The toner is then attached to the photoconductor relative to a latent electrostatic image thereon.

The difference of maximum value and minimum value of the vibration bias voltage (peak range voltage) is preferably 0.5 kV to 5 kV, and the frequency is preferably 1 kHz to 10 kHz. The waveform of the vibration bias voltage may be a rectangle wave, a sine wave, or a triangle wave. The voltage direct current of the vibration bias voltage is in the range of the potential at the background and the potential at the image as mentioned above, and is preferable set closer to the potential at the background from viewpoints of inhibiting a toner deposition on the background.

In the case that the waveform of the vibration bias voltage is a rectangle wave, it is preferred that a duty ratio is 50% or less. Here, the duty ratio is a ratio of time when the toner leaps to the photoconductor during a cycle of the vibration bias. In this way, the difference between the peak time value when the toner leaps the photoconductor and the time average value of bias can become very large. Consequently, the movement of the toner becomes further activated hence the toner is accurately attached to the potential distribution of the latent electrostatic image and rough deposits and an image resolution can be improved. Moreover, the difference between the time peak value when the carrier, which has an opposite polarity of current to the toner, leaps to the photoconductor and the time average value of bias can be small. Consequently the movement of the carrier can be restrained and the possibility of the carrier deposition on the background is largely reduced.

Preferably, the bias is applied to the image developer in order to produce highly fine and precise images with less roughness, but not limited to.

—Tandem Color Image Forming Apparatus—

Figure 13:
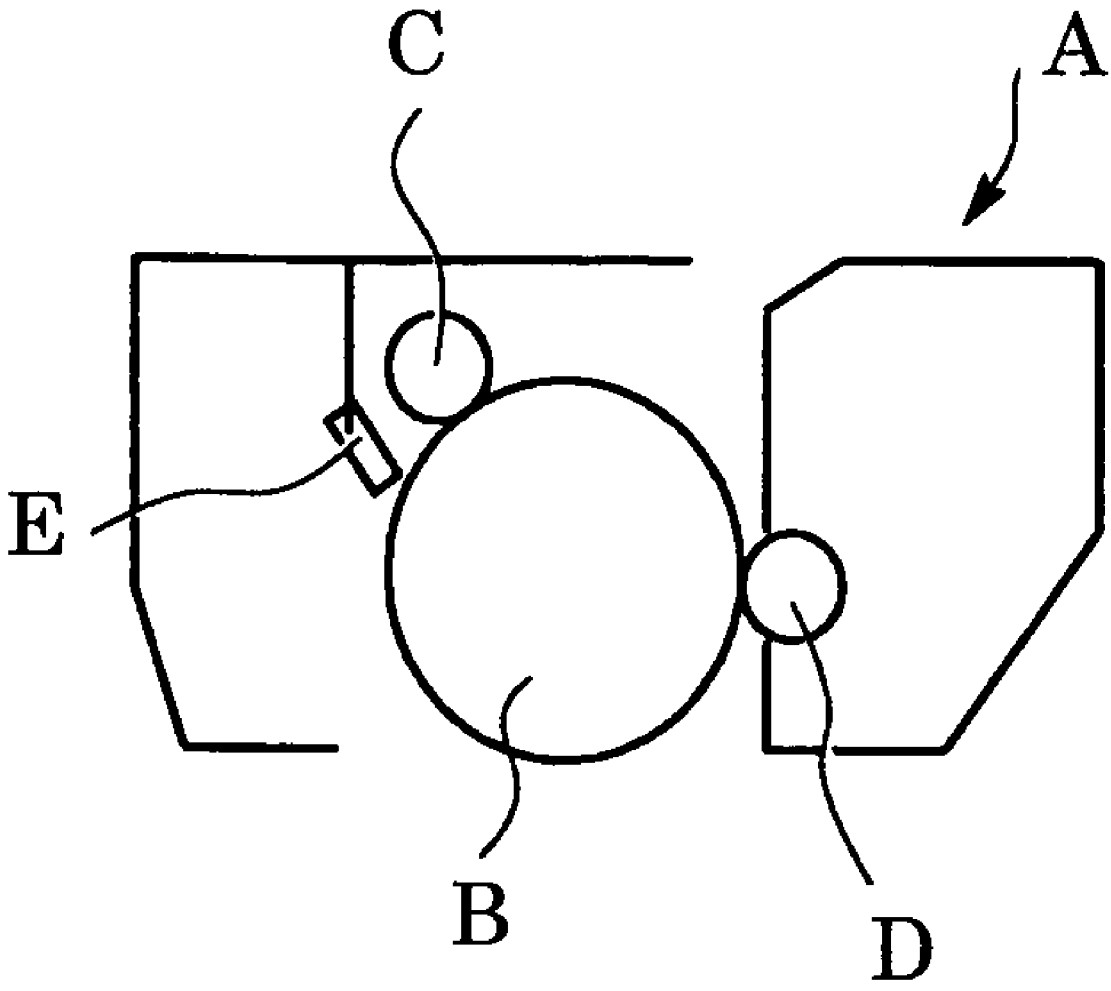
FIG. 13 is a schematic view to show an exemplary construction of an image forming apparatus of tandem indirect-transfer type equipped with a process cartridge according to the present invention.

The present invention may also be applied to a color-image forming apparatus of a tandem system. An embodiment of such a color-image forming apparatus of the tandem system will be described below. Such tandem electrophotographic apparatus are roughly classified as a direct transfer system and an indirect transfer system. In the direct transfer system as shown in FIG. 13, a transfer device 2 serving as a transfer, transfers images on individual photoconductors 1 sequentially to a sheet "s," serving as a recording medium, transported by a sheet conveyer belt 3. In the indirect transfer system as shown in FIG. 4, a primary transfer device 2 sequentially transfers images on individual photoconductors 1 to an intermediate transfer 4, and a secondary transfer device 5 transfers the resulting images on the intermediate transfer 4 to the sheet "s" at once. The transfer device 5 serving as the transfer, may be in the form of a transfer conveyer belt or a roller.

The direct transfer system must comprise a sheet feeder 6 upstream to the sequentially arrayed photoconductors 1 of the tandem image forming apparatus T and an image-fixing device 7 downstream thereof. The system inevitably increases in its size in a sheet conveying direction. In contrast, in the indirect transfer system, the secondary transfer mechanism can be relatively freely arranged, and the sheet feeder 6 and the image-fixing device 7 can be arranged above and/or below the tandem image forming apparatus T. The apparatus of the indirect transfer system can therefore be downsized.

In the direct transfer system, the image-fixing device 7 should be arranged in the vicinity of the tandem image forming apparatus T to prevent upsizing of the apparatus in a sheet conveying direction. The sheet "s" cannot sufficiently bend in such a small space between the image-fixing device 7 and the tandem image forming apparatus T. Accordingly, image formation upstream to the image-fixing device 7 is affected by an impact, specifically in a thick sheet, formed when the tip of the sheet "s" enters the image-fixing device 7 and by the difference between the conveying speed of the sheet when it passes through the image-fixing device 7 and the conveying speed of the sheet by the transfer conveyor belt.

In contrast, in the indirect transfer system, the sheet "s" can sufficiently bend in a space between the image-fixing device 7 and the tandem image forming apparatus T. Thus, the image-fixing device 7 does not significantly affect the image formation.

Figure 14:
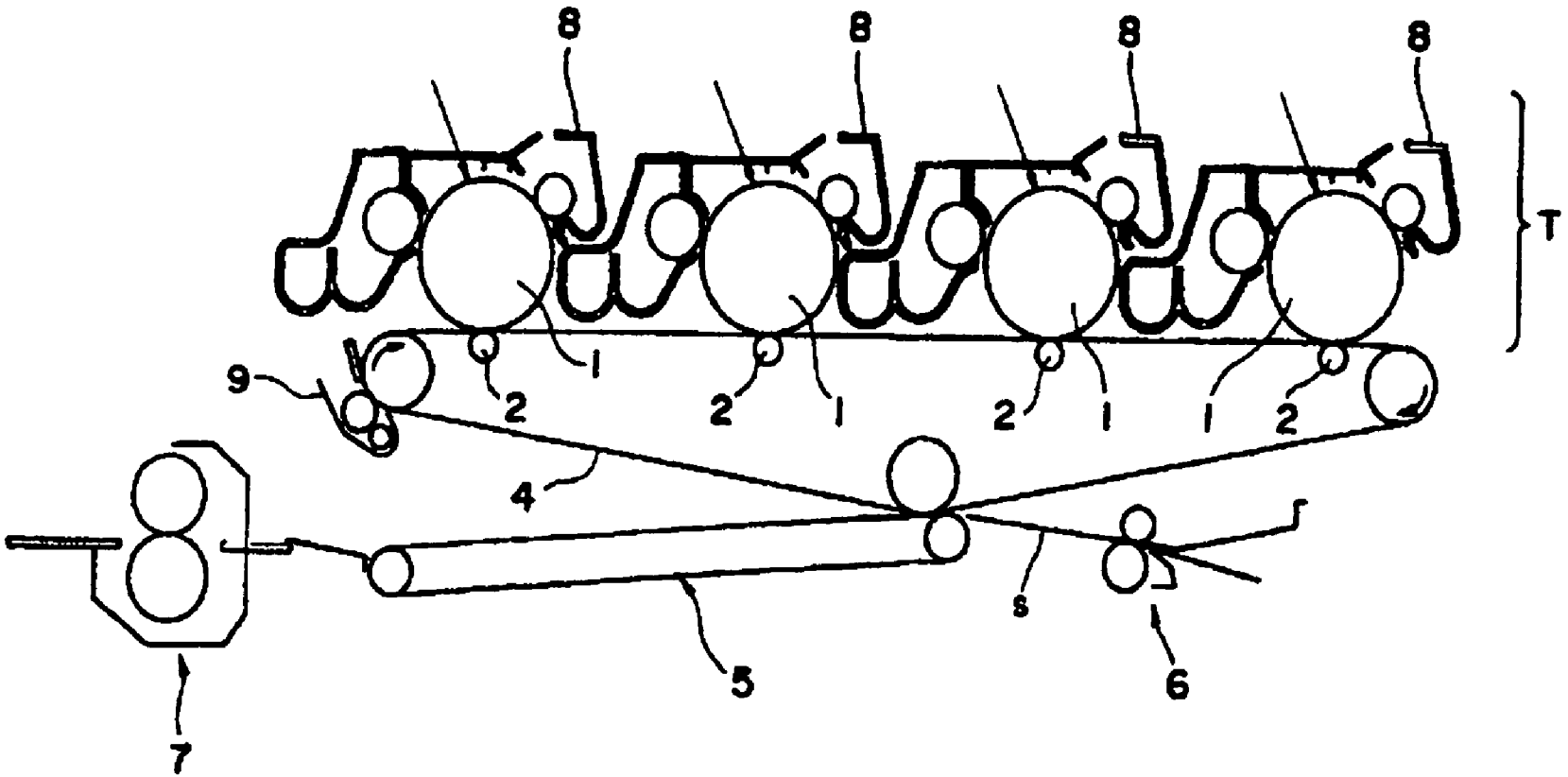
FIG. 14 is a schematic view to show an exemplary construction of a color-image forming apparatus of tandem type equipped with an intermediate transfer medium according to the present invention.

In the color electrophotographic apparatus of the tandem type as shown in FIG. 14, a photoconductor cleaning device 8 removes a residual toners on the photoconductor 1 after transferring and cleans the surface of the photoconductor 1 for another image forming process. In addition, an intermediate transfer cleaning device 9 removes residual toners on the intermediate transfer 4 after the secondary transferring step to thereby clean the surface of the intermediate transfer 4 for another image-forming process.

Figure 15:
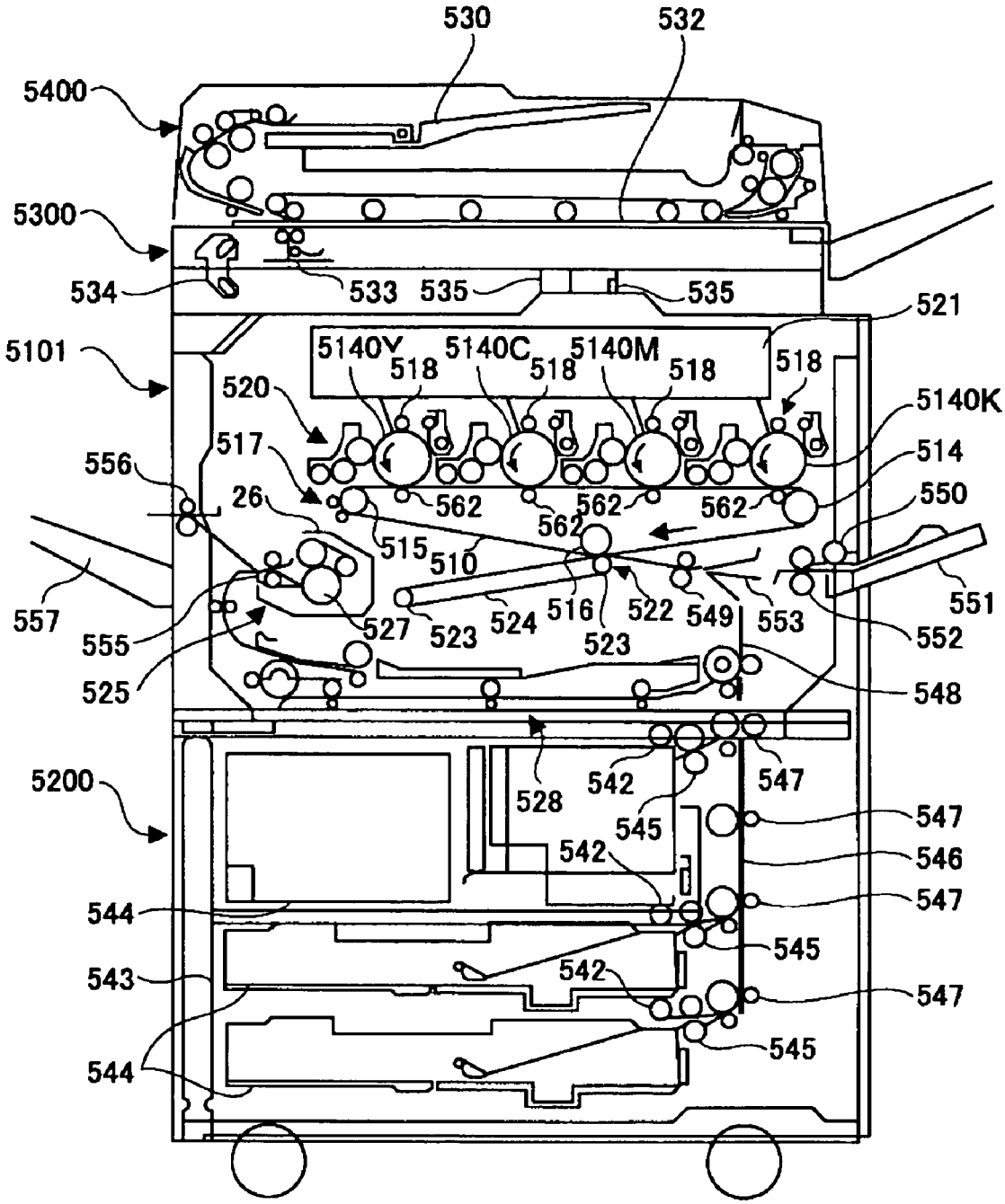
FIG. 15 is a schematic view to show an exemplary construction of an image forming apparatus of tandem indirect-transfer type according to the present invention.

FIG. 15 is a schematic view showing an example of an electrophotographic apparatus of the tandem indirect image transfer system as an embodiment using the toner and the developer of the present invention. The apparatus includes a copying machine main body 5100, a feeder table 5200 on which the copying machine main body 5100 is placed, a scanner 5300 arranged on the copying machine main body 5100, and an automatic document feeder (ADF) 5400 arranged on the scanner 5300. The copying machine main body 5100 includes an endless-belt intermediate transfer 510.

The intermediate transfer member 10 shown in FIG. 5 is spanned around three support rollers 514, 515 and 516 and is capable of rotating and moving in a clockwise direction in the figure.

This apparatus includes an intermediate transfer cleaning device 517 on the left side of the second support roller 515. The intermediate transfer cleaning device 517 is capable of removing a residual toner on the intermediate transfer 510 after image-transfer.

Above the intermediate transfer 510 spanned between the first and second support rollers 514 and 515, yellow, cyan, magenta, and black image-forming device 518 are arrayed in parallel in a moving direction of the intermediate transfer 510 to thereby constitute a tandem image forming unit 520.

The apparatus further includes an exposing device 521 serving as an image-developer, above the tandem image forming unit 520 and a secondary transfer 522 below the intermediate transfer 510 as shown in FIG. 5. The secondary transfer 522, shown in FIG. 5 comprises an endless belt serving as a secondary transfer belt 524 spanned around two rollers 523. The secondary transfer belt 524 is pressed on the third support roller 516 with the interposition of the intermediate transfer 510 and is capable of transferring an image on the intermediate transfer 510 to a sheet.

An image-fixing device 525 is arranged on the side of the secondary transfer 522 and is capable of fixing a transferred image on the sheet. The image-fixing device 525 comprises an endless image-fixing belt 526 and a pressure roller 527 pressed on the image-fixing belt 526.

The secondary transfer 522 is also capable of transporting a sheet after image transfer to the image-fixing device 525. Naturally, a transfer roller or a non-contact charger can be used as the secondary transfer 522. In this case, the secondary transfer 522 may not have the capability of transporting the sheet.

The apparatus shown in FIG. 15 also includes a sheet reverser 528 below the secondary transfer 522 and the image-fixing device 525 in parallel with the tandem image forming unit 520. The sheet reverser 528 is capable of reversing the sheet so as to form images on both sides of the sheet.

A copy is made using the color electrophotographic apparatus in the following manner. Initially, a document is placed on a document platen 530 of the automatic document feeder 5400. Alternatively, the automatic document feeder 5400 is opened, the document is placed on a contact glass 532 of the scanner 5300, and the automatic document feeder 5400 is closed to press the document.

At the push of a start switch (not shown), the document, if any, placed on the automatic document feeder 5400 is transported onto the contact glass 532. When the document is initially placed on the contact glass 532, the scanner 5300 is immediately driven to operate a first carriage 533 and a second carriage 534. Light is applied from a light source to the document, and reflected light from the document is further reflected toward the second carriage 534 at the first carriage 533. The reflected light is further reflected by a mirror of the second carriage 534 and passes through an image-forming lens 535 into a read sensor 536 to thereby read the document.

At the push of the start switch (not shown), a drive motor (not shown) rotates and drives one of the support rollers 514, 515 and 516 to thereby allow the residual two support rollers to rotate following the rotation of the one support roller to thereby rotatably convey the intermediate transfer 510. Simultaneously, the individual image forming device 518 rotates their photoconductors 540 to thereby form black, yellow, magenta, and cyan monochrome images on the photoconductors 540, respectively. With the conveying intermediate transfer 510, the monochrome images are sequentially transferred to form a composite color image on the intermediate transfer 510.

Separately at the push of the start switch (not shown), one of feeder rollers 542 of the feeder table 5200 is selectively rotated, sheets are ejected from one of multiple feeder cassettes 544 in a paper bank 543 and are separated in a separation roller 545 one by one into a feeder path 546, are transported by a transport roller 547 into a feeder path 548 in the copying machine main body 5100 and are bumped against a resist roller 549.

Alternatively, the push of the start switch rotates a feeder roller 550 to eject sheets on a manual bypass tray 551, the sheets are separated one by one on a separation roller 552 into a manual bypass feeder path 553 and are bumped against the resist roller 549.

The resist roller 549 is rotated synchronously with the movement of the composite color image on the intermediate transfer 510 to transport the sheet into between the intermediate transfer 510 and the secondary transfer 522, and the composite color image is transferred onto the sheet by action of the secondary transfer 522 to thereby record a color image.

The sheet bearing the transferred image is transported by the secondary transfer 522 into the image-fixing device 525, is applied with heat and pressure in the image-fixing device 525 to fix the transferred image, changes its direction by action of a switch blade 555, is ejected by an ejecting roller 556 and is stacked on an output tray 557. Alternatively, the sheet changes its direction by action of the switch blade 555 into the sheet reverser 528, turns therein, is transported again to the transfer position, followed by image formation on the back surface of the sheet. The sheet bearing images on both sides thereof is ejected through the ejecting roller 556 onto the output tray 557.

Separately, the intermediate transfer cleaning device 517 removes a residual toner on the intermediate transfer 510 after image transfer for another image forming procedure by the tandem image forming unit 520.

The resist roller 549 is generally grounded, but it is also acceptable to apply a bias thereto for the removal of paper dust of the sheet.

—Process Cartridge—

FIG. 13 shows a schematic view of an exemplary process cartridge according to the present invention. As shown in FIG. 13, the process cartridge A is equipped with photoconductor B, charger C, developing unit D, and cleaner E. In these element components, at least photoconductor B and developing unit D are combined integrally as a process cartridge, the process cartridge is constructed to be detachably mounted to copiers or printers.

Figure 16:
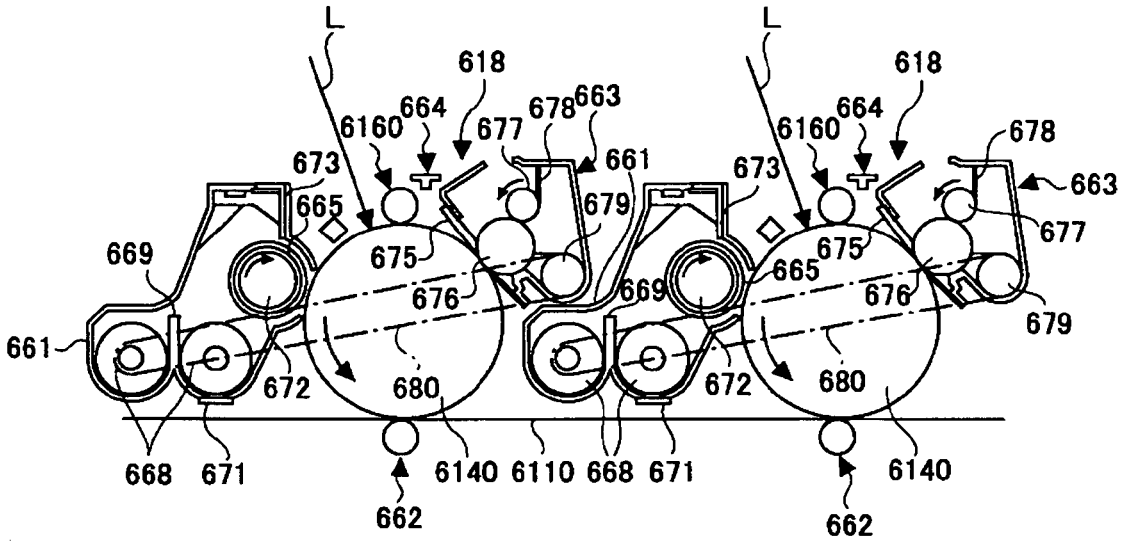
FIG. 16 is a schematic view to show an exemplary construction of an image forming apparatus of tandem indirect-transfer type equipped with an intermediate transfer medium according to the present invention.

FIG. 16 is a schematic view to show an exemplary construction of an image forming apparatus of tandem indirect-transfer type equipped with an intermediate transfer medium according to the present invention.

In the tandem image forming apparatus, each of the image forming units 618 comprises drum photoconductor 6140, and around the photoconductor 6140 are equipped with charge charger 616, developer 661, first transfer unit 662, cleaner 663, charge eliminator 664. Further, developer 665 on developing sleeve 672, stirring puddle 668, partition plate 669, toner-concentration sensor 671, developing sleeve 672, doctor 673, cleaning blade 675, cleaning brush 676, cleaning roller 677, cleaning blade 678, toner-discharge auger 679, and driving unit 680 are equipped as shown in FIG. 16.

The present invention will be illustrated in more detailed with reference to examples given below, but these are not to be construed as limiting the present invention. All percentages and parts are by mass unless indicated otherwise.

EXAMPLE A (Evaluation of Two-Component Developer)

A two-component developer for image evaluation was prepared by uniformly mixing 100 parts of carrier and each 7 parts of respective toners by means of Turbula mixer that can mix components through tumbling. The carrier was a ferrite carrier that was coated with a silicone resin in an average thickness of 0.5 μm and had an average particle diameter of 35 μm.

| (Preparation of Carrier) | |
|---|---|
| Core material | |
| Mn ferrite particles[1*)] | 5000 parts |
| Coating material | |
| Toluene | 450 parts |
| Silicone resin SR2400[2*)] | 450 parts |
| Amino silane SH6020[3*)] | 10 parts |
| Carbon black | 10 parts |

[1*)]mass-average particle diameter: 35 μm
[2*)]by Toray Dow Corning Silicone Co., nonvolatile content: 50%
[3*)]by Toray Dow Corning Silicone Co.

The coating materials were dispersed by a stirrer for 10 minutes to prepare a coating liquid. The coating liquid and the core material were poured into a coating apparatus which was equipped with a rotary bottom-plate disc and a swirl-stream stirring blade within a fluidizing bed. The coating liquid was coated on the core material and was calcined at 250° C. for 2 hours to prepare the carrier.

(Preparation of External Additive)

The external additives were prepared as follows.

(External Additive 1)

A slurry containing 50 parts of metal silicon powder having an average particle diameter of 6.7 μm and 50 parts of water was injected at a rate of 22.0 kg/hr into a flame of about 1800° C. from a central outlet of two-fluid nozzle disposed at burner center, around which oxygen gas was fed. The resulting spherical silica powder was air-transported through a collecting line using a blower, and was collected into a bag filter. The resulting spherical silica powder of 250 g was poured into a vibrating-fluidizing bed, and was allowed to fluidize under circulating air by action of a suction blower. Then 3.2 g of water was sprayed into the vibrating-fluidizing bed and mixed with the silica powder under the fluidizing condition for 5 minutes, then 5.3 g of hexamethyldisilazane of a silane coupling agent was sprayed into the vibrating-fluidizing bed and mixed with the silica powder under the fluidizing condition for 40 minutes, thereby External Additive 1 was obtained.

(External Additive 2)

A total of 600 parts of methanol, 46 parts of water, and 55 parts of 28% aqueous ammonium solution were mixed to prepare an aqueous solution. To the aqueous solution, being controlled at 35° C. under stirring, 1,300 parts of tetramethoxysilane and 470 parts of 5.4% aqueous ammonium solution were added drop-wise for 7 hours and 3 hours respectively from simultaneous-starting addition. After the tetramethoxysilane was added completely, the solution was stirred successively for 0.5 hour, thereby a suspension of silica fine particles was prepared through hydrolysis reaction of the tetramethoxysilane. To the resulting suspension, 550 parts of hexamethyldisilazane was added at room temperature and heated to 55° C. for 3 hours, then the silica fine particles was subjected to trimethylsilyl reaction, thereby External Additive 2 was obtained.

(External Additive 3)

A slurry containing 40 parts of metal silicon powder having an average particle diameter of 6.7 μm, 10 parts of metal titanium powder having an average particle diameter of 6.7 μm, and 50 parts of water was injected at a rate of 23.0 kg/hr into a flame of about 1900° C. from a central outlet of two-fluid nozzle disposed at burner center, around which oxygen gas was fed. The resulting spherical silica-titanium oxide powder was air-transported through a collecting line using a blower, and was collected into a bag filter. The resulting spherical silica-titanium oxide powder of 250 g was poured into a vibrating-fluidizing bed, and was allowed to fluidize under circulating air by action of a suction blower. Then 3.2 g of water was sprayed into the vibrating-fluidizing bed and mixed with the silica powder under the fluidizing condition for 5 minutes, then 5.3 g of hexamethyldisilazane of a silane coupling agent was sprayed into the vibrating-fluidizing bed and mixed with the silica powder under the fluidizing condition for 40 minutes, thereby External Additive 3 was obtained.

Example A-1

—Preparation of Organic Fine-Particle Emulsion—

Preparation Example 1

Into a reactor equipped with a stirring rod and a thermometer were poured 683 parts of water, 11 parts of sodium salt of sulfuric acid ester of ethylene oxide adduct of methacrylic acid (Eleminol RS-30, by Sanyo Chemical Industries Co.), 166 parts of methacrylic acid, 110 parts of butyl acrylate, and 1 part of ammonium persulfate; and the mixture was stirred at 3,800 rpm for 30 minutes to yield a white emulsion. The emulsion was heated to 75° C. and was allowed to react for 3 hours. The reaction mixture was further treated with 30 parts of a 1% aqueous solution of ammonium persulfate, was aged at 70° C. for 5 hours, thereby yielded an aqueous dispersion of vinyl resin i.e. a copolymer of methacrylic acid-butyl acrylate-sodium salt of sulfate of methacrylic acid-ethylene oxide adduct (hereinafter referring to as "Fine Particle Dispersion 1"). Fine Particle Dispersion 1 had a volume-average particle diameter of 75 nm by the analyzer LA-920 (by Horiba, Ltd.). A part of Fine Particle Dispersion 1 was dried to isolate the resin component. The resin component had a Tg of 60° C. and a mass-average molecular mass of about 110,000.

—Preparation of Aqueous Phase—

Preparation Example 2

An opaque liquid was prepared by blending and stirring 990 parts of water, 83 parts of Fine Particle Dispersion 1, 37 parts of 48.3% aqueous solution of sodium dodecyldiphenylether disulfonate (Eleminol MON-7, by Sanyo Chemical Industries, Ltd.), and 90 parts of ethylacetate (hereinafter referring to as "Aqueous Phase 1").

—Preparation of Lower Molecular-Mass Polyester—

Preparation Example 3

Into a reactor equipped with a condenser, a stirrer, and a nitrogen gas feed tube were poured 229 parts of ethylene oxide (2 mole) adduct of bisphenol A, 529 parts of propylene oxide (3 mole) adduct of bisphenol A, 208 parts of terephthalic acid, 46 parts of adipic acid, and 2 parts of dibutyltin oxide. The mixture was reacted at 230° C. at normal atmospheric pressure for 7 hours and was further reacted at a reduced pressure of 10 mmHg to 15 mmHg for 5 hours. Thereafter, the reaction mixture was further reacted with 44 parts of trimellitic anhydride at 180° C. at normal atmospheric pressure for 1.8 hours, thereby yielded a reaction product (hereinafter referring to as "Lower Molecular-Mass Polyester 1"). The Lower Molecular-Mass Polyester 1 had a number-average molecular mass of 2,300, a mass-average molecular mass of 6,700, a Tg of 43° C., and an acid value of 25.

—Preparation of Intermediate Polyester—

Preparation Example 4

Into a reactor equipped with a condenser, a stirrer, and a nitrogen gas feed tube were poured 682 parts of ethylene oxide (2 mole) adduct of bisphenol A, 81 parts of a propylene oxide (2 mole) adduct of bisphenol A, 283 parts of terephthalic acid, 22 parts of trimellitic anhydride, and 2 parts of dibutyltin oxide. The mixture was reacted at 230° C. at normal atmospheric pressure for 7 hours, was further reacted under a reduced pressure of 10 mmHg to 15 mmHg for 5 hours, thereby yielded a reaction product having a number-average molecular mass of 2,200, a mass-average molecular mass of 9,700, a Tg of 54° C., an acid value of 0.5, and a hydroxyl value of 52 (hereinafter referring to as "Intermediate Polyester 1").

Then, into a reactor equipped with a condenser, a stirrer, and a nitrogen gas feed tube were poured 410 parts of Intermediate Polyester 1, 89 parts of isophorone diisocyanate, and 500 parts of ethylacetate, followed by reaction at 100° C. for 5 hours to yield a reaction product having a free isocyanate content of 1.53% by mass (hereinafter referring to as "Prepolymer 1").

—Synthesis of Ketimine Compound—

Preparation Example 5

Into a reactor equipped with a stirring rod and a thermometer were poured 170 parts of isophoronediamine and 75 parts of methylethylketone, followed by reaction at 50° C. for 4.5 hours to yield a reaction product having an amine value of 417 (hereinafter referring to as "Ketimine Compound 1").

—Preparation of Master Batch—

Preparation Example 6

A total of 600 parts of water, Pigment Blue 15:3 wet cake having a solid content of 50%, and 1200 parts of a polyester resin were mixed in Henschel Mixer (by Mitsui Mining Co.). The mixture was kneaded at 120° C. for 45 minutes by a two-roll mill, cold-rolled, and milled by a pulverizer, thereby yielded Master Batch 1.

—Preparation of Oil Phase—

Preparation Example 7

Into a reactor equipped with a stirring rod and a thermometer were poured 378 parts of Lower Molecular-Mass Polyester 1, 100 parts of carnauba wax, and 947 parts of ethylacetate. The mixture was heated at 80° C. for 5 hours with stirring and was then cooled to 30° C. over 1 hour. The mixture was further treated with 500 parts of Master Batch 1 and 500 parts of ethylacetate with stirring for 1 hour, thereby yielded Material Solution 1.

Thereafter, 1324 parts of Material Solution 1 was poured into a vessel, and the components therein were dispersed using a bead mill (Ultravisco-Mill, by Aimex Co.) at a liquid feeding speed of 1 kg/hr, a disc rotation speed of 6 m/sec, using zirconia beads 0.5 mm in diameter filled 80% by volume. The dispersing procedure was repeated three times. The dispersion was further treated with 1324 parts of 65% ethylacetate solution of Lower Molecular-Mass Polyester 1, and the mixture was dispersed under the above conditions except that the dispersion procedure was repeated two times to yield Pigment-Wax Dispersion 1. Pigment-Wax Dispersion 1 had a solid content of 50% as determined by heating to 130° C. for 30 minutes.

—Emulsification and Solvent Removal—

Preparation Example 8

Into a vessel were poured 749 parts of Pigment-Wax Dispersion 1, 115 parts of Prepolymer 1, and 2.9 parts of Ketimine Compound 1; and the mixture was mixed at 5,000 rpm for 2 minutes using TK Homo Mixer (by Tokushu Kika Kogyo Co.), then 1,200 parts of Aqueous Phase 1 were added, and the mixture was further mixed at 13,000 rpm for 25 minutes using the TK Homo Mixer, thereby yielded Emulsified Slurry 1.

Into a vessel equipped with a stirrer and a thermometer was poured Emulsified Slurry 1 and was heated at 30° C. for 8 hours to remove the solvents, and the slurry was aged at 45° C. for 7 hours, thereby yielded Dispersed Slurry 1.

—Washing and Drying—

Preparation Example 9

A total of 100 parts of Emulsified Slurry 1 was filtered under a reduced pressure and was washed by the following procedures.

(1) The filtered cake and 100 parts of deionized water were mixed in TK Homo Mixer at 12,000 rpm for 10 minutes, and the mixture was filtered.

(2) The filtered cake prepared in (1) and 100 parts of 10% aqueous solution of sodium hydroxide were mixed in TK Homo Mixer at 12,000 rpm for 30 minutes, and the mixture was filtered under a reduced pressure.

(3) The filtered cake prepared in (2) and 100 parts of 10% hydrochloric acid were mixed in TK Homo Mixer at 12,000 rpm for 10 minutes, and the mixture was filtered.

(4) The filtered cake prepared in (3) and 300 parts of deionized water were mixed in TK Homo Mixer at 12,000 rpm for 10 minutes, and the mixture was filtered, wherein this washing procedure was repeated twice to yield Filtered Cake 1. The Filtered Cake 1 was dried at 45° C. for 48 hours in a circulating air dryer.

Then, the fluorine-containing compound (2) shown below was added to the Filtered Cake 1 in an amount of 0.1% by mass based on the substantial mass of toner by way of mixing the Filtered Cake 1 with an aqueous liquid containing 1% by mass of the fluorine-containing compound (2), drying the mixture at 45° C. for 48 hours in a circulating air dryer followed by drying the mixture at 30° C. for 10 hours in a container. Thereafter, the mixture was screened through a mesh of 75 μm opening, thereby Toner Particles 1 was obtained.

Then, 100 parts of the Toner Particles 1, 1.5 parts of hexamethyldisilazane-treated hydrophobic silica having a primary-particle diameter of 10 nm produces by a combustion method, 1 part of External Additive 1, and 0.5 part of hydrophobic-treated titanium oxide were mixed using Henschel Mixer (FM20C, by Mitsui-Mining Co.), thereby to produce a toner. The mixing was carried out by repeating 12 times of stirring for 30 seconds at circumferential speed of 30 m/sec and allowing to stand for 60 second. The resulting toner was shown in Table 1 as to the properties and in Table 2 as to the evaluations.

Fluorine-Containing Compound (1):

(2)

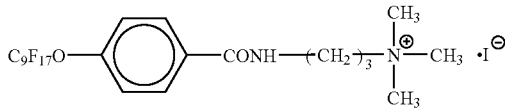

Example A-2

A toner was produced and evaluated in the same manner as Example A-1, except that the mixing condition was changed at mixing the external additive as follows.

The mixing was carried out by stirring for 12 minutes at circumferential speed of 35 m/sec, allowing to stand for 60 second, and stirring for 12 minutes. The resulting toner was shown in Table 1 as to the properties and in Table 2 as to the evaluations.

Example A-3

A toner was produced and evaluated in the same manner as Example A-1, except that the mixing condition was changed at mixing the external additive as follows.

The mixing was carried out by repeating 6 times of stirring for 30 seconds at circumferential speed of 23 m/sec and allowing to stand for 60 second. The resulting toner was shown in Table 1 as to the properties and in Table 2 as to the evaluations.

Example A-4

A toner was produced and evaluated in the same manner as Example A-1, except that the External Additive 1 was exchanged into External Additive 2. The resulting toner was shown in Table 1 as to the properties and in Table 2 as to the evaluations.

Example A-5

A toner was produced and evaluated in the same manner as Example A-1, except that the amount of the External Additive 1 was changed into 0.5 part, and the mixing condition was changed at mixing the external additive as follows.

The mixing was carried out by repeating 8 times of stirring for 30 seconds at circumferential speed of 35 m/sec and allowing to stand for 60 second. The resulting toner was shown in Table 1 as to the properties and in Table 2 as to the evaluations.

Example A-6

A toner was produced and evaluated in the same manner as Example A-1, except that the amount of the External Additive 1 was changed into 2 parts, and the mixing condition was changed at mixing the external additive as follows.

The mixing was carried out by repeating 10 times of stirring for 30 seconds at circumferential speed of 28 m/sec and allowing to stand for 60 second. The resulting toner was shown in Table 1 as to the properties and in Table 2 as to the evaluations.

Example A-7

A toner was produced and evaluated in the same manner as Example A-1, except that the External Additive 1 was exchanged into External Additive 3. The resulting toner was shown in Table 1 as to the properties and in Table 2 as to the evaluations.

Example A-8

A toner was produced and evaluated in the same manner as Example A-1, except that the washing and drying were changed as follows, and the addition process of the external additive was carried out by the wet process as follows. The resulting toner was shown in Table 1 as to the properties and in Table 2 as to the evaluations.

—Washing and Drying—

A total of 100 parts of Emulsified Slurry 1 was filtered under a reduced pressure and was washed by the following procedures.

(1) The filtered cake and 100 parts of deionized water were mixed in TK Homo Mixer at 12,000 rpm for 10 minutes, and the mixture was filtered.

(2) The filtered cake prepared in (1) and 100 parts of 10% aqueous solution of sodium hydroxide were mixed in TK Homo Mixer at 12,000 rpm for 30 minutes, and the mixture was filtered under a reduced pressure.

(3) The filtered cake prepared in (2) and 100 parts of 10% hydrochloric acid were mixed in TK Homo Mixer at 12,000 rpm for 10 minutes, and the mixture was filtered.

(4) The filtered cake prepared in (3) and 300 parts of deionized water were mixed in TK Homo Mixer at 12,000 rpm for 10 minutes, and the mixture was filtered, wherein this washing procedure was further repeated twice to yield Filtered Cake 1. The Filtered Cake 1 was dried at 45° C. for 48 hours in a circulating air dryer.

Then, the fluorine-containing compound (1) described above was dispersed into water at a content of 1% by mass, and External Additive 1 was also dispersed at a content of 1.2% by mass. Then, the Filtered Cake 1 was dispersed into the dispersion in an amount of 0.1% by mass of the fluorine-containing compound (2) based on the mass of toner, to cause adhesion of the fluorine-containing compound (2) onto the toner in an amount of 1% by mass of based on resulting toner. Then, the mixture was dried at 45° C. for 48 hours in a circulating air dryer followed by drying the mixture at 30° C. for 10 hours in a container. Thereafter, the mixture was screened through a mesh of 75 μm opening, thereby Toner Particles 1 was prepared.

Then, 100 parts of the Toner Particles 1, 1.5 parts of hexamethyldisilazane-treated hydrophobic silica having a primary-particle diameter of 10 nm produces by a combustion method, 1 part of External Additive 1, and 0.5 part of hydrophobic-treated titanium oxide were mixed using Henschel Mixer (FM20C, by Mitsui-Mining Co.), thereby to produce a toner. The mixing was carried out by repeating 12 times of stirring for 30 seconds at circumferential speed of 30 m/sec and allowing to stand for 60 second. The resulting toner was shown in Table 1 as to the properties and in Table 2 as to the evaluations.

Example A-9

A toner was produced and evaluated in the same manner as Example A-1, except that 0.15 part of zinc stearate was added and mixed together when the External Additive was added and mixed. The resulting toner was shown in Table 1 as to the properties and in Table 2 as to the evaluations.

Example A-10

A toner was produced and evaluated in the same manner as Example A-1, except that the emulsification and solvent removal were changed as follows. The resulting toner was shown in Table 1 as to the properties and in Table 2 as to the evaluations.

—Emulsification and Solvent Removal—

Into a vessel were poured 749 parts of Pigment-Wax Dispersion 1, 115 parts of Prepolymer 1, and 2.9 parts of Ketimine Compound 1, and the mixture was mixed at 6,000 rpm for 2 minutes using TK Homo Mixer (by Tokushu Kika Kogyo Co.); then 1,200 parts of Aqueous Phase 1 were added, and the mixture was further mixed at 13,000 rpm for 10 minutes using the TK Homo Mixer, thereby yielded Emulsified Slurry 1.

Into a vessel equipped with a stirrer and a thermometer was poured Emulsified Slurry 1 and was heated at 30° C. for 5 hours to remove the solvents, and the slurry was aged at 45° C. for 4 hours, thereby yielded Dispersed Slurry 1.

Example A-11

A toner was produced and evaluated in the same manner as Example A-1, except that the emulsification and solvent removal were changed as follows. The resulting toner was shown in Table 1 as to the properties and in Table 2 as to the evaluations.

—Emulsification and Solvent Removal—

Into a vessel were poured 630 parts of Pigment-Wax Dispersion 1, 120 parts of Prepolymer 1, and 3.1 parts of Ketimine Compound 1, and the mixture was mixed at 5,000 rpm for 2 minutes using TK Homo Mixer (by Tokushu Kika Kogyo Co.); then 1,200 parts of Aqueous Phase 1 were added, and the mixture was further mixed at 11,000 rpm for 50 minutes using the TK Homo Mixer, thereby yielded Emulsified Slurry 1.

Into a vessel equipped with a stirrer and a thermometer was poured Emulsified Slurry 1 and was heated at 30° C. for 10 hours to remove the solvents, and the slurry was aged at 45° C. for 24 hours, thereby yielded Dispersed Slurry 1.

Example A-12

The device for evaluations was modified such that DC charging is exclusively applied, and the toner in Example A-1 was used.

Comparative Example A-1

A toner was produced and evaluated in the same manner as Example A-1, except that the mixing condition by the Henschel Mixer was changed at mixing the external additive as follows.

The mixing was carried out by stirring for 25 minutes at circumferential speed of 35 m/sec, allowing to stand for 60 second, and stirring for 25 minutes. The resulting toner was shown in Table 1 as to the properties and in Table 2 as to the evaluations.

Comparative Example A-2

A toner was produced and evaluated in the same manner as Example A-1, except that the mixing condition by the Henschel Mixer was changed at mixing the external additive as follows.

The mixing was carried out by repeating 2 times of stirring for 30 seconds at circumferential speed of 23 m/sec and allowing to stand for 60 second. The resulting toner was shown in Table 1 as to the properties and in Table 2 as to the evaluations.

—Evaluation Items—

(i) Particle Diameter

The particle diameter was measured using a particle analyzer of Coulter Counter TAII (by Coulter Electronics Co.) with an aperture diameter of 100 μm. The volume-average particle diameter Dv and number-average particle diameter Dn were determined using the above particle analyzer.

(ii) Average Sphericity E

Average sphericity E was evaluated by flow particle image analyzer FPIA-1000 (by Sysmex Co.). Specifically, the measurement was performed by adding 0.3 ml of surfactant, preferably alkylbenzene sulfonate, as a dispersing agent to 120 ml of water in a container from which solid impurities had been previously removed, and then adding approximately 0.2 g of the sample. The suspension in which the sample was dispersed was subjected to dispersion for about 2 minutes by an ultrasonic disperser to adjust dispersion concentration to about 5,000 particles/μl, and toner shape and distribution were measured with the analyzer, thereby the sphericity was measured.

(iii) Fusibility

Using an imagio Neo 450 (by Ricoh Co., Ltd.) modified into a belt fusing system, solid images with adhering toner amount of 1.0±0.1 mg/cm$^2$ were printed on sheets of plain paper and thick paper (by Ricoh Co., Type 6200 and NBS copy and print paper <135>). A Fusing test was conducted with different fusing temperatures at a fusing belt, and the highest temperature at which no hot offset occurred on plain paper sheets was determined as highest fusing temperature. Also, lowest fusing temperature was measured using thick paper sheets. The lowest fusing temperature was determined as the temperature of a fusing roller at which a fused image was rubbed with a pad and the remaining rate of the image density of the fused image was 70% or more. It is generally desirable that the highest fusing temperature is 190° C. or more and the lowest fusing temperature is 140° C. or less.

(iv) Cleanability (LL Evaluation)

Using a test device of Ipsio Color 8100 (by Ricoh Co.) modified into oilless fixing and applied tuning, transfer residual toner on the photoconductor was transferred to a white paper sheet using Scotch tape (by Sumitomo 3M Co.), after an output of 100 sheets of 5% image density and cleaning process under lower temperature of 10° C. and lower humidity of 15% (LL condition). The sheet was measured by X-Rite 938 (by X-Rite Co.) and the difference between the sample and blank was evaluated. The measurement was rated as follows.

A: the difference was less than 0.005
B: the difference was 0.005 to 0.010
C: the difference was 0.011 to 0.02
D: the difference was more than 0.02

(v) Cleanability (Durability)

Using a test device of Ipsio Color 8100 (by Ricoh Co.) modified into oilless fixing and applied tuning, transfer residual toner on a photoconductor was transferred to a white paper sheet using Scotch tape (by Sumitomo 3M Co.), after an output of 40,000 sheets of 5% image density and cleaning process. The sheet was measured by X-Rite 938 (by X-Rite Co.) and the difference between the sample and blank was evaluated. The measurement was rated as follows.

A: the difference was less than 0.005
B: the difference was 0.005 to 0.010
C: the difference was 0.011 to 0.02
D: the difference was more than 0.02

(vi) Filming Property

Using a test device of Ipsio Color 8100 (by Ricoh Co.) modified into oilless fixing and applied tuning, substance or material deposited or adhered on the photoconductor was evaluated visually, after an output of 2,000 sheets of 5% image density and cleaning process. The result was rated as follows.

A: no deposition or adhesion was observable
B: haze was observable slightly
C: haze was observable streakedly
D: haze area was remarkably observable (vii) HH Image Blur Using a test device of Ipsio Color 8100 (by Ricoh Co.) modified into oilless fixing and applied tuning, transfer residual toner on a photoconductor was transferred to a white paper sheet using Scotch tape (by Sumitomo 3M Co.) under higher temperature of 90° C. and higher humidity of 80% (HH condition), after an output of 2,000 sheets of 5% image density and cleaning process. The result was rated as follows.

A: no blur was observable
B: little or almost no blur was observable
C: a little blur was observable
D: significant blur was observable (viii) Charge Stability Using a test device of Ipsio Color 8100 (by Ricoh Co.) modified into oilless fixing and applied tuning, the difference of charge amount for each toner was measured by conducting an endurance test of 100,000-sheet successive output with chart images of 5% toner coverage. The charge amount difference was obtained from 1 g of developer by way of a blow off method. The result was rated as follows.

A: the difference was 5 μc/g or less
B: the difference was 10 μc/g or less
C: the difference was more than 10 μc/g (ix) Image Density Using a test device of Imagio Neo 450 (by Ricoh Co.) modified into belt fixing type, solid images with adhering toner amount of 0.4±0.1 mg/cm$^2$ were printed on sheets of plain paper (Type 6200, by Ricoh Co.). Then, the image density of the sheets was measured with X-Rite 938 (by X-Rite Co.). The result was rated as follows.

A: the image density was 1.4 or more
B: the image density was less than 1.4

(x) Image Graininess and Sharpness

Using a test device of Ipsio Color 8100 (by Ricoh Co.) modified into oilless fixing and applied tuning, photographic images were output in monochrome and the levels of graininess and sharpness were evaluated visually. The result was rated as follows.

A: the image was as superior as offset prints
B: the image was slightly inferior to offset prints
C: the image was considerably inferior to offset prints
D: the image was substantially the same as conventional electrophotographic images thus was remarkably inferior (xi) Fog Using a test device of Ipsio Color 8100 (by Ricoh Co.) modified into oilless fixing and applied tuning under lower temperature of 10° C. and lower humidity of 15% (LL condition), an endurance test of 100,000-sheet successive output with chart images of 5% toner coverage was conducted. Then, toner contamination of the background portion of printed sheets was evaluated visually using a magnifier. The result was rated as follows.

A: no contamination was observable
B: little contamination was observable and no troublesome
C: a little contamination was observable
D: considerable contamination was observable and troublesome (xii) Toner Scatter Using a test device of Ipsio Color 8100 (by Ricoh Co.) modified into oilless fixing and applied tuning under a temperature of 40° C. and a humidity of 90%, an endurance test of 100,000-sheet successive output with chart images of 5% toner coverage was conducted for respective toners. Then, toner contamination within the test device was evaluated visually. The result was rated as follows.

A: no contamination was observable
B: a little contamination was observable
C: considerable contamination was observable and troublesome (xiii) Environmental Preservability A sample of each toner was taken in an amount of 10 g and put in a 20 ml glass container. After being tapped for 100 times, the container was set in a thermostat at a temperature of 55° C. and humidity of 80% for 24 hours. Then, penetration was measured using a penetrometer. In addition, penetration of toner samples that were kept in a cold and dry environment (10° C., 15%) was also measured, and the lower value of penetration of the two conditions, i.e. hot and humid and cold and dry, was used for evaluation. The result was rated as follows.

A: penetration was 20 mm or more
B: penetration was 15 mm to 20 mm
C: penetration was 10 mm to 15 mm
D: penetration was less than 10 mm (xiv) Transfer Property Using a test device of Ipsio Color 8100 (by Ricoh Co.) modified into oilless fixing and applied tuning, developing stress was applied through stirring the developing device without outputting paper for 60 minutes. Then, the electrostatic image, which was developed on the photoconductor in a deposition amount of 0.4 mg/cm$^2$, was transferred on Type 6200 paper (by Ricoh Co.) through transfer current of 15 μA, then transfer residual toner on a photoconductor was transferred to a white paper sheet using Scotch tape (by Sumitomo 3M Co.). The sheet was measured by X-Rite 938 (by X-Rite Co.) and the difference between the sample and blank was evaluated. The measurement was rated as follows.

A: the difference was less than 0.005
B: the difference was 0.005 to 0.010
C: the difference was 0.011 to 0.02
D: the difference was more than 0.02

(xv) Surface Nonuniformity of Image

Using a test device of Ipsio Color 8100 (by Ricoh Co.) modified into oilless fixing and applied tuning, developing stress was applied through stirring the developing device without outputting paper for 60 minutes. Then, the electrostatic image, which was developed on the photoconductor in a deposition amount of 0.4 mg/cm$^2$, was transferred on Type 6200 paper (by Ricoh Co.) through transfer current of 15 μA, then transfer residual toner on a photoconductor is transferred to a white paper sheet using Scotch tape (by Sumitomo 3M Co.). The transferred residual image was visually observed in terms of the surface nonuniformity of image. The observation was rated as follows.

A: no nonuniformity
B: little and no significant nonuniformity
C: a little nonuniformity
D: significant nonuniformity and no allowable (xvi) Smear of Charge Roller Using a test device of Ipsio Color 8100 (by Ricoh Co.) modified into oilless fixing and applied tuning, the smear deposited on the charge roller due to external additives was determined after 2,000-sheet successive output with 5% image density. The observation was rated as follows.

A: no smear
B: little smear and no troublesome
C: a little smear and usable
D: significant smear and no usable (xvii) Sphericity Factors SF-1 and SF-2

S-4200 FE-SEM (by Hitachi Co.) was employed to obtain SEM images of toner particles. A total of 300 images were randomly selected, and the information of the images was introduced to Luzex AP image analyzer (by Nireco Co.) through an interface and analyzed by the device.

TABLE 1

| | Free external additive (%) | Free external additive (Part) | External Additive | Particle Diameter (nm)*1) | Rate of 120 nm to 300 nm*2) | Mixing type | Particle Diameter volume average Dv (μm) | Particle Diameter number average Dn (μm) | Dv/Dn | Circularity Circularity | Circularity SF-1 | Circularity SF-2 | Circularity r2/r1 | Circularity r3/r2 |
|---|---|---|---|---|---|---|---|---|---|---|---|---|---|---|
| Ex. A-1 | 16 | 0.29 | Silica | 52 | 1.3 | dry mixing | 5.5 | 5.1 | 1.08 | 0.96 | 130 | 121 | 0.9 | 0.9 |
| Ex. A-2 | 9 | 0.15 | Silica | 52 | 1.3 | dry mixing | 5.5 | 5.1 | 1.08 | 0.96 | 130 | 121 | 0.9 | 0.9 |
| Ex. A-3 | 47 | 0.60 | Silica | 52 | 1.3 | dry mixing | 5.5 | 5.1 | 1.08 | 0.96 | 130 | 121 | 0.9 | 0.9 |
| Ex. A-4 | 43 | 0.3 | Silica | 80 | 0 | dry mixing | 5.5 | 5.1 | 1.08 | 0.96 | 130 | 121 | 0.9 | 0.9 |
| Ex. A-5 | 16 | 0.04 | Silica | 52 | 1.3 | dry mixing | 5.5 | 5.1 | 1.08 | 0.96 | 130 | 121 | 0.9 | 0.9 |
| Ex. A-6 | 16 | 0.9 | Silica | 52 | 1.3 | dry mixing | 5.5 | 5.1 | 1.08 | 0.96 | 130 | 121 | 0.9 | 0.9 |
| Ex. A-7 | 39 | 0.6 | silica/ titanium oxide | 120 | 2.3 | dry mixing | 5.5 | 5.1 | 1.08 | 0.96 | 130 | 121 | 0.9 | 0.9 |
| Ex. A-8 | 9 | 0.21 | Silica | 52 | 1.3 | wet mixing | 5.5 | 5.1 | 1.08 | 0.96 | 130 | 121 | 0.9 | 0.9 |
| Ex. A-9 | 16 | 0.29 | Silica | 52 | 1.3 | dry mixing | 5.5 | 5.1 | 1.08 | 0.96 | 130 | 121 | 0.9 | 0.9 |
| Ex. A-10 | 16 | 0.29 | Silica | 52 | 1.3 | dry mixing | 6.2 | 5.0 | 1.24 | 0.94 | 132 | 126 | 0.9 | 0.9 |
| Ex. A-11 | 16 | 0.29 | Silica | 52 | 1.3 | dry mixing | 5.6 | 5.0 | 1.12 | 0.98 | 141 | 132 | 0.8 | 0.7 |
| Ex. A-12 | 16 | 0.29 | Silica | 52 | 1.3 | dry mixing | 5.5 | 5.1 | 1.08 | 0.96 | 130 | 121 | 0.9 | 0.9 |
| Comp. Ex. A-1 | 6 | 0.04 | Silica | 52 | 1.3 | dry mixing | 5.5 | 5.1 | 1.08 | 0.96 | 130 | 121 | 0.9 | 0.9 |
| Comp. Ex. A-2 | 52 | 0.8 | Silica | 52 | 1.3 | dry mixing | 5.5 | 5.1 | 1.08 | 0.96 | 130 | 121 | 0.9 | 0.9 |

*1)number average particle diameter of external additive
*2)number rate of external additive

TABLE 2

| | Cleanability (LL) | Cleanability (durability) | Filming | HH image blur | Fixing property lower limit (° C.) | Fixing property higher limit (° C.) | Charge stability | Image density | Image graininess and sharpness | Fog | Toner scatter | Environmental preservability | Transfer property | Irregularity | Smear of charge roller |
|---|---|---|---|---|---|---|---|---|---|---|---|---|---|---|---|
| Ex. A-1 | B | B | B | B | 140 | 210≦ | A | A | B | B | B | B | B | B | B |
| Ex. A-2 | C | C | A | A | 135 | 210≦ | A | A | B | B | B | B | C | B | B |
| Ex. A-3 | A | B | B | B | 140 | 210≦ | A | A | B | B | C | B | B | B | C |
| Ex. A-4 | C | A | B | C | 145 | 200 | A | B | B | B | B | B | B | B | B |
| Ex. A-5 | C | C | A | A | 135 | 210≦ | A | A | A | B | B | C | C | C | B |
| Ex. A-6 | A | A | C | C | 145 | 200 | B | A | C | C | C | B | B | B | C |
| Ex. A-7 | A | B | C | B | 145 | 210≦ | B | A | B | C | B | C | B | B | B |
| Ex. A-8 | B | B | A | B | 140 | 210≦ | A | A | B | B | B | B | C | B | B |
| Ex. A-9 | A | B | B | B | 145 | 210≦ | B | A | B | C | B | B | B | B | B |
| Ex. A-10 | B | A | B | B | 140 | 210≦ | A | A | C | C | C | B | B | B | B |
| Ex. A-11 | A | A | B | B | 145 | 210≦ | A | A | B | B | C | B | B | B | B |
| Ex. A-12 | B | B | A | A | 140 | 210≦ | A | A | B | B | B | B | B | B | B |
| Comp. Ex. A-1 | D | D | A | B | 140 | 210≦ | A | A | B | B | B | B | D | D | B |
| Comp. Ex. A-2 | B | B | D | D | 155 | 190 | A | B | B | B | D | B | D | D | D |

EXAMPLE B (Amount of Free Additive)

The free rate of external additive and its absorptive affinity were determined through applying the toner with stress using an ultrasonic homogenizer in an aqueous medium and causing desorption thereof. Specific procedures were as follows so as to minimize the fluctuation owing to operators and other environmental factors:

(i) a mixture of 0.5 ml of drywell of a surfactant, 100 ml of Isoton of an electrolyte, and 4 g of toner was hand-shaken 50 times, then was allowed to stand for one hour or more;

(ii) the mixture was further hand-shaken 30 times, then was dispersed for 1 minute by means of an ultrasonic homogenizer in following conditions, electrical supply: 20 W (watt), vibration period: 60 second non-stop, amplitude: 20 W (39%), temperature at vibration start: 23±1.5° C.;

(iii) the dispersion was filtered by means of a filter having a pore size of 1 μm, the additive desorbed from the toner was removed, then the toner was dried; and (iv) the additive amount in the toner was determined by fluorescent X-ray analysis in terms of before and after the removal of the additive, thereby the desorbed rate or amount of the additive was obtained.

(Evaluation of Hardness)

The Vickers hardness of photoconductors was determined using a micro surface hardness tester in following conditions:

Tester: Microhardness Tester DUH 201 (by Shimadzu Co.)

Procedure: one time of load and unload

Measurement: seven times (ignoring maximum and minimum of modulus rates)

Indenter: Berkovich Indenter (pyramid 115 indenter)

Maximum load: 1 g

Load release rate: 0.0143 g/sec (set 10)

Retention time: 5 seconds (Explanation of Properties)

Maximum displacement (D1): indentation depth at maximum load of 1.00 g

Plastic displacement (D2): indentation depth at non load (0 g)

Elastic displacement: difference between the maximum displacement and the plastic displacement DHT115-1: dynamic hardness from D1 and the maximum load DHT115-2: dynamic hardness from D2 and the maximum load Rate of modulus change: (D1−D2)÷D1×100

The Vickers hardness means DHT115-1 dynamic hardness in this Example.

(Filler Whiteness)

Filler whiteness was determined in accordance with diffusion illusion (JIS P 8184).

(Particle Diameter, Shape, and Deposited Condition of External Additive and Filler)

These properties were determined by means of a transmission electron microscope (TEM, H-9000NAR, by Hitachi Co.), a scanning electron microscope (FE-SEM, S-4800, by Hitachi Co.), and the like.

(Electrophotographic Photoconductor 1)

Coating liquids for undercoat layer, charge-generating layer, and charge-transport layer having the following compositions respectively, were coated individually by immersion-coating and drying in turn on an aluminum cylinder, thereby an undercoat layer of 3.5 μm thick, charge-generating layer of 0.2 μm thick, and charge-transport layer of 23 μm thick were formed.

| (Coating Liquid for Undercoat Layer) | |
|---|---|
| Titanium dioxide powder | 400 parts |
| Melamine resin | 65 parts |
| Alkyd resin | 120 parts |
| 2-butanone | 400 parts |
| (Coating Liquid for Charge-Generating Layer) | |
| Polyvinyl butyral | 5 parts |
| Bisazo pigment of following formula (2) | 12 parts |
| 2-butanone | 200 parts |
| Cyclohexanone | 400 parts |

Formula (2)

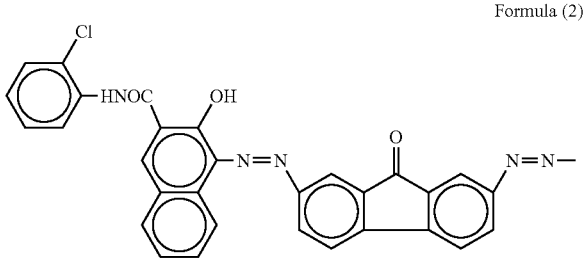

-continued

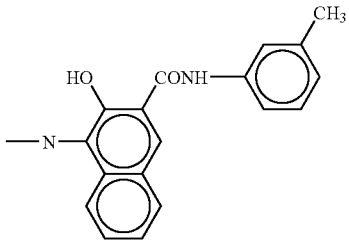

| (Coating Liquid for Charge-Transport Layer) | |
|---|---|
| Polycarbonate (Z-polyca, by Teijinkasei Co.) | 10 parts |
| Charge transport substance (Ip: 5.4 eV) of following formula (3) | 10 parts |
| Tetrahydrofuran | 100 parts |

Formula (3)

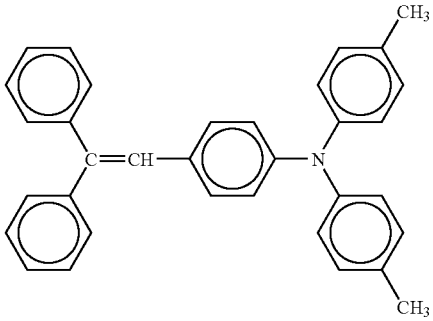

Then, the Protective-Layer Coating Liquid having the following recipe was spray-coated on the charge transport layer to form a protective layer of 5 μm thick, thereby Electrophotographic Photoconductor 1 was obtained.

| (Protective-Layer Coating Liquid 1) | |
|---|---|
| α-alumina (primary-particle diameter: 0.3 μm)*1) | 4 parts |
| Polyester resin (acid value: about 35 mgKOH/g) | 0.8 part |
| Charge transport substance of formula (3) | 4 parts |
| Polycarbonate*2) | 6 parts |
| Tetrahydrofuran | 220 parts |
| Cyclohexanone | 80 parts |

*1)Sumicorundum AA-03, by Sumitomo Chemical Co. specific resistance: more than $10^{10}$ Ω · cm, pH: 8 to 9
*2)Z-polyca, by Teijinkasei Co.

The above-noted ingredients were ball-milled with alumina balls for 16 hours to prepare the coating liquid of protective layer 1.

(Electrophotographic Photoconductor 2)

Electrophotographic Photoconductor 2 was prepared in the same manner as Electrophotographic Photoconductor 1, except that the following Protective-Layer Coating Liquid 2 was employed.

| (Protective-Layer Coating Liquid 2) | |
|---|---|
| α-alumina (primary-particle diameter: 0.3 μm)*1) | 3 parts |
| Acrylic resin (acid value: about 35 mgKOH/g)*2) | 0.2 part |
| Charge transport substance of formula (3) | 4 parts |
| Polycarbonate*3) | 6 parts |

-continued

| (Protective-Layer Coating Liquid 2) | |
|---|---|
| Tetrahydrofuran | 220 parts |
| Cyclohexanone | 80 parts |

*1)Sumicorundum AA-03, by Sumitomo Chemical Co. specific resistance: more than $10^{10}$ Ω · cm, pH: 8 to 9
*2)Dianarl BR-605, by Mitsubishi Rayon Co.
*3)Z-polyca, by Teijinkasei Co.

The above-noted ingredients were ball-milled with alumina balls for 13 hours to prepare the coating liquid of protective layer 2.

(Electrophotographic Photoconductor 3)

Electrophotographic Photoconductor 3 was prepared in the same manner as Electrophotographic Photoconductor 1, except that the following Protective-Layer Coating Liquid 3 was employed.

| (Protective-Layer Coating Liquid 3) | |
|---|---|
| α-alumina (AKP-50, by Sumitomo Chemical Co.)*1) | 5 parts |
| Polyester resin (acid value: about 35 mgKOH/g) | 0.8 part |
| Charge transport substance of formula (3) | 4 parts |
| Polycarbonate*2) | 6 parts |
| Tetrahydrofuran | 220 parts |
| Cyclohexanone | 80 parts |

*1)average primary-particle diameter: 0.2 μm
*2)Dianarl BR-605, by Mitsubishi Rayon Co.
*3)Z-polyca, by Teijinkasei Co.

The above-noted ingredients were ball-milled with alumina balls for 12 hours to prepare the coating liquid of protective layer 3.

(Electrophotographic Photoconductor 4)

Electrophotographic Photoconductor 4 was prepared in the same manner as Electrophotographic Photoconductor 1, except that the following Protective-Layer Coating Liquid 4 was employed.

| (Protective-Layer Coating Liquid 4) | |
|---|---|
| Titanium oxide (pH: 6 to 7)*1) | 3 parts |
| Polyester resin (acid value: about 35 mgKOH/g) | 0.8 part |
| Charge transport substance of formula (3) | 4 parts |
| Polycarbonate*2) | 6 parts |
| Tetrahydrofuran | 220 parts |
| Cyclohexanone | 80 parts |

*1)average primary-particle diameter: 0.3 μm, specific resistance: more than $10^{10}$ Ω · cm
*2)Z-polyca, by Teijinkasei Co.

The above-noted ingredients were ball-milled with alumina balls for 12 hours to prepare the coating liquid of protective layer 4.

(Electrophotographic Photoconductor 5)

Electrophotographic Photoconductor 5 was prepared in the same manner as Electrophotographic Photoconductor 1, except that the following Protective-Layer Coating Liquid 5 was employed.

| (Protective-Layer Coating Liquid 5) | |
|---|---|
| Titanium oxide (pH: 6 to 7)*1) | 2 parts |
| Polyester resin (acid value: about 35 mgKOH/g) | 0.8 part |
| Charge transport substance of formula (3) | 4 parts |
| Polycarbonate*2) | 6 parts |
| Tetrahydrofuran | 220 parts |
| Cyclohexanone | 80 parts |

*1)average primary-particle diameter: 0.3 μm, specific resistance: more than $10^{10}$ Ω · cm
*2)Z-polyca, by Teijinkasei Co.

The above-noted ingredients were ball-milled with alumina balls for 12 hours to prepare the coating liquid of protective layer 4.

(Electrophotographic Photoconductor 6)

Electrophotographic Photoconductor 6 was prepared in the same manner as Electrophotographic Photoconductor 1, except that the following Protective-Layer Coating Liquid 6 was employed.

| (Protective-Layer Coating Liquid 6) | |
|---|---|
| α-alumina (primary-particle diameter: 0.3 μm)*1) | 4 parts |
| Polyester resin (acid value: about 35 mgKOH/g) | 0.8 part |
| Charge transport substance of formula (3) | 4 parts |
| Polycarbonate*2) | 6 parts |
| Tetrahydrofuran | 220 parts |
| Cyclohexanone | 80 parts |

*1)Sumicorundum AA-03, by Sumitomo Chemical Co. specific resistance: more than $10^{10}$ Ω · cm, pH: 8 to 9
*2)Z-polyca, by Teijinkasei Co.

The above-noted ingredients were ball-milled with alumina balls for 16 hours to prepare the coating liquid of protective layer 1.

(Evaluation of Two-Component Developer)

A two-component developer for image evaluation was prepared by uniformly mixing 100 parts of carrier and each 7 parts of respective toners by means of Turbula mixer that can mix components through tumbling. The carrier was a ferrite carrier that was coated with a silicone resin in an average thickness of 0.5 μm and had an average particle diameter of 35 μm.

| (Preparation of Carrier) | |
|---|---|
| Core material | |
| Mn ferrite particles[1]*) | 5000 parts |
| Coating material | |
| Toluene | 450 parts |
| Silicone resin SR2400[2]*) | 450 parts |
| Amino silane SH6020[3]*) | 10 parts |
| Carbon black | 10 parts |

[1]*)mass-average particle diameter: 35 μm
[2]*)by Toray Dow Corning Silicone Co., nonvolatile content: 50%
[3]*)by Toray Dow Corning Silicone Co.

The coating materials were dispersed by a stirrer for 10 minutes to prepare a coating liquid. The coating liquid and the core material were poured into a coating apparatus which was equipped with a rotary bottom-plate disc and a swirl-stream stirring blade within a fluidizing bed. The coating liquid was coated on the core material and was calcined at 180° C. for 2 hours to prepare the carrier.

(Preparation of External Additive)

The external additives were prepared as follows.

(External Additive 1)

A slurry containing 50 parts of metal silicon powder having an average particle diameter of 6.7 μm and 50 parts of water was injected at a rate of 18.0 kg/hr into a flame of about 1800° C. from a central outlet of two-fluid nozzle disposed at burner center, around which oxygen gas was fed. The resulting spherical silica powder was air-transported through a collecting line using a blower, and was collected into a bag filter. The resulting spherical silica powder of 250 g was poured into a vibrating-fluidizing bed, and was allowed to fluidize under circulating air by action of a suction blower. Then 3.2 g of water was sprayed into the vibrating-fluidizing bed and mixed with the silica powder under the fluidizing condition for 5 minutes, then 4.9 g of hexamethyldisilazane of a silane coupling agent was sprayed into the vibrating-fluidizing bed and mixed with the silica powder under the fluidizing condition for 30 minutes, thereby External Additive 1 was obtained.

(External Additive 2)

A total of 600 parts of methanol, 46 parts of water, and 55 parts of 28% aqueous ammonium solution were mixed to prepare an aqueous solution. To the aqueous solution, being controlled at 35° C. under stirring, 1,300 parts of tetramethoxysilane and 470 parts of 7.2% aqueous ammonium solution were added drop-wise for 7 hours and 3 hours respectively from simultaneous-starting addition. After the tetramethoxysilane was added completely, the solution was stirred successively for 0.5 hour, thereby a suspension of silica fine particles was prepared through hydrolysis reaction of the tetramethoxysilane. To the resulting suspension, 550 parts of hexamethyldisilazane was added at room temperature and heated to 55° C. for 3 hours, then the silica fine particles was subjected to trimethylsilyl reaction, thereby External Additive 2 was obtained.

Example B-1

—Preparation of Organic Fine-Particle Emulsion—

Preparation Example 1

Into a reactor equipped with a stirring rod and a thermometer were poured 683 parts of water, 11 parts of sodium salt of sulfuric acid ester of ethylene oxide adduct of methacrylic acid (Eleminol RS-30, by Sanyo Chemical Industries Co.), 166 parts of methacrylic acid, 110 parts of butyl acrylate, and 1 part of ammonium persulfate; and the mixture was stirred at 3,800 rpm for 30 minutes to yield a white emulsion. The emulsion was heated to 75° C. and was allowed to react for 3 hours. The reaction mixture was further treated with 30 parts of a 1% aqueous solution of ammonium persulfate, was aged at 70° C. for 5 hours, thereby yielded an aqueous dispersion of vinyl resin i.e. a copolymer of methacrylic acid-butyl acrylate-sodium salt of sulfate of methacrylic acid-ethylene oxide adduct (hereinafter referring to as "Fine Particle Dispersion 1"). Fine Particle Dispersion 1 had a volume-average particle diameter of 75 nm by the analyzer LA-920 (by Horiba, Ltd.). A part of Fine Particle Dispersion 1 was dried to isolate the resin component. The resin component had a Tg of 60° C. and a mass-average molecular mass of about 110,000.

—Preparation of Aqueous Phase—

Preparation Example 2

An opaque liquid was prepared by blending and stirring 990 parts of water, 83 parts of Fine Particle Dispersion 1, 37 parts of 48.5% aqueous solution of sodium dodecyldiphenylether disulfonate (Eleminol MON-7, by Sanyo Chemical Industries, Ltd.), and 90 parts of ethylacetate (hereinafter referring to as "Aqueous Phase 1").

—Preparation of Lower Molecular-Mass Polyester—

Preparation Example 3

Into a reactor equipped with a condenser, a stirrer, and a nitrogen gas feed tube were poured 229 parts of ethylene oxide (2 mole) adduct of bisphenol A, 529 parts of propylene oxide (3 mole) adduct of bisphenol A, 208 parts of terephthalic acid, 46 parts of adipic acid, and 2 parts of dibutyltin oxide. The mixture was reacted at 230° C. at normal atmospheric pressure for 7 hours and was further reacted at a reduced pressure of 10 mmHg to 15 mmHg for 5 hours. Thereafter, the reaction mixture was further reacted with 44 parts of trimellitic anhydride at 180° C. at normal atmospheric pressure for 1.8 hours, thereby yielded a reaction product (hereinafter referring to as "Lower Molecular-Mass Polyester 1"). The Lower Molecular-Mass Polyester 1 had a number-average molecular mass of 2,300, a mass-average molecular mass of 6,700, a Tg of 43° C., and an acid value of 25.

—Preparation of Intermediate Polyester—

Preparation Example 4

Into a reactor equipped with a condenser, a stirrer, and a nitrogen gas feed tube were poured 682 parts of ethylene oxide (2 mole) adduct of bisphenol A, 81 parts of a propylene oxide (2 mole) adduct of bisphenol A, 283 parts of terephthalic acid, 22 parts of trimellitic anhydride, and 2 parts of dibutyltin oxide. The mixture was reacted at 230° C. at normal atmospheric pressure for 7 hours, was further reacted under a reduced pressure of 10 mmHg to 15 mmHg for 5 hours, thereby yielded a reaction product having a number-average molecular mass of 2,200, a mass-average molecular mass of 9,700, a Tg of 54° C., an acid value of 0.5, and a hydroxyl value of 52 (hereinafter referring to as "Intermediate Polyester 1").

Then, into a reactor equipped with a condenser, a stirrer, and a nitrogen gas feed tube were poured 410 parts of Intermediate Polyester 1, 89 parts of isophorone diisocyanate, and 500 parts of ethylacetate, followed by reaction at 100° C. for 5 hours to yield a reaction product having a free isocyanate content of 1.53% by mass (hereinafter referring to as "Prepolymer 1").

—Synthesis of Ketimine Compound—

Preparation Example 5

Into a reactor equipped with a stirring rod and a thermometer were poured 170 parts of isophoronediamine and 75 parts of methylethylketone, followed by reaction at 50° C. for 4.5 hours to yield a reaction product having an amine value of 417 (hereinafter referring to as "Ketimine Compound 1").

—Preparation of Master Batch—

Preparation Example 6

A total of 600 parts of water, Pigment Blue 15:3 wet cake having a solid content of 50%, and 1200 parts of a polyester resin were mixed in Henschel Mixer (by Mitsui Mining Co.). The mixture was kneaded at 120° C. for 45 minutes by a two-roll mill, cold-rolled, and milled by a pulverizer, thereby yielded Master Batch 1.

—Preparation of Oil Phase—

Preparation Example 7

Into a reactor equipped with a stirring rod and a thermometer were poured 378 parts of Lower Molecular-Mass Polyester 1, 100 parts of carnauba wax, and 947 parts of ethylacetate. The mixture was heated at 80° C. for 5 hours with stirring and was then cooled to 30° C. over 1 hour. The mixture was further treated with 500 parts of Master Batch 1 and 500 parts of ethylacetate with stirring for 1 hour, thereby yielded Material Solution 1.

Thereafter, 1324 parts of Material Solution 1 was poured into a vessel, and the components therein were dispersed using a bead mill (Ultravisco-Mill, by Aimex Co.) at a liquid feeding speed of 1 kg/hr, a disc rotation speed of 6 m/sec, using zirconia beads 0.5 mm in diameter filled 80% by volume. The dispersing procedure was repeated three times. The dispersion was further treated with 1324 parts of 65% ethylacetate solution of Lower Molecular-Mass Polyester 1, and the mixture was dispersed under the above conditions except that the dispersion procedure was repeated two times to yield Pigment-Wax Dispersion 1. Pigment-Wax Dispersion 1 had a solid content of 50% as determined by heating to 130° C. for 30 minutes.

—Emulsification and Solvent Removal—

Preparation Example 8

Into a vessel were poured 749 parts of Pigment-Wax Dispersion 1, 115 parts of Prepolymer 1, and 2.9 parts of Ketimine Compound 1; and the mixture was mixed at 5,000 rpm for 2 minutes using TK Homo Mixer (by Tokushu Kika Kogyo Co.), then 1,200 parts of Aqueous Phase 1 were added, and the mixture was further mixed at 13,000 rpm for 25 minutes using the TK Homo Mixer, thereby yielded Emulsified Slurry 1.

Into a vessel equipped with a stirrer and a thermometer was poured Emulsified Slurry 1 and was heated at 30° C. for 8 hours to remove the solvents, and the slurry was aged at 45° C. for 7 hours, thereby yielded Dispersed Slurry 1.

—Washing and Drying—

Preparation Example 9

A total of 100 parts of Emulsified Slurry 1 was filtered under a reduced pressure and was washed by the following procedures.

(1) The filtered cake and 100 parts of deionized water were mixed in TK Homo Mixer at 12,000 rpm for 10 minutes, and the mixture was filtered.

(2) The filtered cake prepared in (1) and 100 parts of 10% aqueous solution of sodium hydroxide were mixed in TK Homo Mixer at 12,000 rpm for 30 minutes, and the mixture was filtered under a reduced pressure.

(3) The filtered cake prepared in (2) and 100 parts of 10% hydrochloric acid were mixed in TK Homo Mixer at 12,000 rpm for 10 minutes, and the mixture was filtered.

(4) The filtered cake prepared in (3) and 300 parts of deionized water were mixed in TK Homo Mixer at 12,000 rpm for 10 minutes, and the mixture was filtered, wherein this washing procedure was repeated twice to yield Filtered Cake 1. The Filtered Cake 1 was dried at 45° C. for 48 hours in a circulating air dryer.

Then, the fluorine-containing compound (1) shown above was added to the Filtered Cake 1 in an amount of 0.1% by mass based on the substantial mass of toner by way of mixing the Filtered Cake 1 with an aqueous liquid containing 1% by mass of the fluorine-containing compound (1), drying the mixture at 45° C. for 48 hours in a circulating air dryer followed by drying the mixture at 30° C. for 10 hours in a container. Thereafter, the mixture was screened through a mesh of 75 μm opening, thereby Toner Particles 1 was obtained.

Then, 100 parts of the Toner Particles 1, 1.5 parts of hexamethyldisilazane-treated hydrophobic silica having a primary-particle diameter of 12 nm produces by a combustion method, 1 part of External Additive 2, and 0.7 part of hydrophobic-treated titanium oxide were mixed using Henschel Mixer (FM20C, by Mitsui-Mining Co.), thereby to produce a toner. The mixing was carried out by repeating 10 times of stirring for 30 seconds at circumferential speed of 30 m/sec and allowing to stand for 60 second.

Electrophotographic Photoconductor 1 was utilized for evaluations. The resulting toner was shown in Table 3 as to the properties and in Table 4 as to the evaluations. The cleaning blade utilized for the evaluations was formed of a urethane rubber; and the cleaning was performed in a counter manner, wherein the contacting angle was 25 degrees and the contacting pressure was 20 g/cm$^2$.

Example B-2

A toner was produced and evaluated in the same manner as Example B-1, except that Electrophotographic Photoconductor 2 was utilized in place of Electrophotographic Photoconductor 2. The resulting toner was shown in Table 3 as to the properties and in Table 4 as to the evaluations.

Example B-3

A toner was produced and evaluated in the same manner as Example B-1, except that Electrophotographic Photoconductor 3 was utilized in place of Electrophotographic Photoconductor 1. The resulting toner was shown in Table 3 as to the properties and in Table 4 as to the evaluations.

Example B-4

A toner was produced and evaluated in the same manner as Example B-1, except that Electrophotographic Photoconductor 4 was utilized in place of Electrophotographic Photoconductor 1. The resulting toner was shown in Table 3 as to the properties and in Table 4 as to the evaluations.

Example B-5

A toner was produced and evaluated in the same manner as Example B-1, except that the mixing condition by the Henschel Mixer was changed at mixing the external additive as follows.

The mixing was carried out by stirring for 12 minutes at circumferential speed of 35 m/sec, allowing to stand for 60 second, and stirring for 15 minutes. The resulting toner was shown in Table 3 as to the properties and in Table 4 as to the evaluations.

Example B-6

A toner was produced and evaluated in the same manner as Example B-1, except that the mixing condition by the Henschel Mixer was changed at mixing the external additive as follows.

The mixing was carried out by repeating 7 times of stirring for 30 seconds at circumferential speed of 25 m/sec, and allowing to stand for 60 second. The resulting toner was shown in Table 3 as to the properties and in Table 4 as to the evaluations.

Example B-7

A toner was produced and evaluated in the same manner as Example B-1, except External Additive 2 was changed into External Additive 1. The resulting toner was shown in Table 3 as to the properties and in Table 4 as to the evaluations.

Example B-8

A toner was produced and evaluated in the same manner as Example B-1, except that the emulsification and solvent removal were changed as follows. The resulting toner was shown in Table 3 as to the properties and in Table 4 as to the evaluations.

—Emulsification and Solvent Removal—

Into a vessel were poured 749 parts of Pigment-Wax Dispersion 1, 115 parts of Prepolymer 1, and 2.9 parts of Ketimine Compound 1, and the mixture was mixed at 6,000 rpm for 2 minutes using TK Homo Mixer (by Tokushu Kika Kogyo Co.); then 1,200 parts of Aqueous Phase 1 were added, and the mixture was further mixed at 13,000 rpm for 10 minutes using the TK Homo Mixer, thereby yielded Emulsified Slurry 1. Into a vessel equipped with a stirrer and a thermometer was poured Emulsified Slurry 1 and was heated at 30° C. for 5 hours to remove the solvents, and the slurry was aged at 45° C. for 4 hours, thereby yielded Dispersed Slurry 1.

Example B-9

A toner was produced and evaluated in the same manner as Example B-1, except that the emulsification and solvent removal were changed as follows. The resulting toner was shown in Table 3 as to the properties and in Table 4 as to the evaluations.

—Emulsification and Solvent Removal—

Into a vessel were poured 630 parts of Pigment-Wax Dispersion 1, 120 parts of Prepolymer 1, and 3.1 parts of Ketimine Compound 1, and the mixture was mixed at 5,000 rpm for 2 minutes using TK Homo Mixer (by Tokushu Kika Kogyo Co.); then 1,200 parts of Aqueous Phase 1 were added, and the mixture was further mixed at 11,000 rpm for 50 minutes using the TK Homo Mixer, thereby yielded Emulsified Slurry 1.

Into a vessel equipped with a stirrer and a thermometer was poured Emulsified Slurry 1 and was heated at 30° C. for 10 hours to remove the solvents, and the slurry was aged at 45° C. for 22 hours, thereby yielded Dispersed Slurry 1.

Comparative Example B-1

A toner was produced and evaluated in the same manner as Example B-1, except that the mixing condition by the Henschel Mixer was changed at mixing the external additive as follows.

The mixing was carried out by stirring for 25 minutes at circumferential speed of 35 m/sec, allowing to stand for 60 second, and stirring for 25 minutes. The resulting toner was shown in Table 3 as to the properties and in Table 4 as to the evaluations.

Comparative Example B-2

A toner was produced and evaluated in the same manner as Example B-1, except that the mixing condition by the Henschel Mixer was changed at mixing the external additive as follows.

The mixing was carried out by repeating 2 times of stirring for 30 seconds at circumferential speed of 23 m/sec and allowing to stand for 60 second. The resulting toner was shown in Table 3 as to the properties and in Table 4 as to the evaluations.

—Evaluation Items—

(i) Particle Diameter

This property was determined in the same manner as described above in terms of Example A.

(ii) Average Sphericity E

This property was determined in the same manner as described above in terms of Example A.

(iii) Cleanability (LL Evaluation)

This property was determined in the same manner as described above in terms of Example A.

(iv) Cleanability (Durability)

This property was determined in the same manner as described above in terms of Example A.

(v) Filming Property

This property was determined in the same manner as described above in terms of Example A.

(vi) HH Image Blur

This property was determined in the same manner as described above in terms of Example A.

(vii) Charge Stability

This property was determined in the same manner as described above in terms of Example A.

(viii) Image Density

This property was determined in the same manner as described above in terms of Example A.

(ix) Image Graininess and Sharpness

This property was determined in the same manner as described above in terms of Example A.

(x) Fog

This property was determined in the same manner as described above in terms of Example A.

(xi) Toner Scatter

This property was determined in the same manner as described above in terms of Example A.

(xii) Environmental Preservability

This property was determined in the same manner as described above in terms of Example A.

(xiii) Transfer Property

This property was determined in the same manner as described above in terms of Example A.

(xiv) Surface Nonuniformity of Image

This property was determined in the same manner as described above in terms of Example A.

(xv) Sphericity Factors SF-1 and SF-2

S-4200 FE-SEM (by Hitachi Co.) was employed to obtain SEM images of toner particles. A total of 300 images were randomly selected, and the information of the images was introduced to Luzex AP image analyzer (by Nireco Co.) through an interface and analyzed by the device.

(xvi) Abrasion Wear of Film Thickness on Photoconductor

Using a test device of Ipsio Color 8100 (by Ricoh Co.) modified into oilless fixing and applied tuning under a temperature of 40° C. and a humidity of 90%, an endurance test of 100,000-sheet successive output with chart images of 5% toner coverage was conducted for intended toners and photoconductors. Then, the decrease of film thickness was determined using a film-thickness meter based on eddy current (Fischer Corp MMS, by Fischer Co.)

(xvii) Surface flaw of Photoconductor

Using a test device of Ipsio Color 8100 (by Ricoh Co.) modified into oilless fixing and applied tuning under a temperature of 10° C. and a humidity of 90%, an endurance test of 100,000-sheet successive output with chart images of 5% toner coverage was conducted for respective toners. Then, the surface of the photoconductor was observed in terms of the flaws using laser microscope VK-8500 (by Keyence Co.). The flaws were rated as follows.

A: no significant

B: observable by microscope and no effect image

C: large deep flaws and effect on image

TABLE 3

| | Photoconductor | | | | External additive | | | | Toner particle diameter | | | Toner circularity | | |
|---|---|---|---|---|---|---|---|---|---|---|---|---|---|---|
| | No. | Filler vol. (%) | Filler whiteness | Hard-ness | Free amount (%) | Shape | Condition | Dn(nm) | Dv | Dn | Dv/Dn | Circularity | SF-1 | SF-2 |
| Ex. B-1 | 1 | 12 | 92 | 26.2 | 17 | spherical | monodisperse | 110 | 5.5 | 5.1 | 1.08 | 0.96 | 130 | 121 |
| Ex. B-2 | 2 | 5 | 92 | 20.6 | 17 | spherical | monodisperse | 110 | 5.5 | 5.1 | 1.08 | 0.96 | 130 | 121 |
| Ex. B-3 | 3 | 18 | 88 | 48.1 | 17 | spherical | monodisperse | 110 | 5.5 | 5.1 | 1.08 | 0.96 | 130 | 121 |
| Ex. B-4 | 4 | 7 | 70 | 20.5 | 17 | spherical | monodisperse | 110 | 5.5 | 5.1 | 1.08 | 0.96 | 130 | 121 |
| Ex. B-5 | 1 | 12 | 92 | 26.2 | 9 | spherical | monodisperse | 110 | 5.5 | 5.1 | 1.08 | 0.96 | 130 | 121 |
| Ex. B-6 | 1 | 12 | 92 | 26.2 | 48 | spherical | monodisperse | 110 | 5.5 | 5.1 | 1.08 | 0.96 | 130 | 121 |
| Ex. B-7 | 1 | 12 | 92 | 26.2 | 23 | spherical | monodisperse | 85 | 5.5 | 5.1 | 1.08 | 0.96 | 130 | 121 |
| Ex. B-8 | 1 | 12 | 92 | 26.2 | 14 | spherical | monodisperse | 110 | 6.2 | 5.0 | 1.24 | 0.94 | 132 | 126 |
| Ex. B-9 | 1 | 12 | 92 | 26.2 | 30 | spherical | monodisperse | 110 | 5.6 | 5.0 | 1.12 | 0.98 | 141 | 132 |
| Comp. Ex. B-1 | 1 | 12 | 92 | 26.2 | 5 | spherical | monodisperse | 110 | 5.5 | 5.1 | 1.08 | 0.96 | 130 | 121 |
| Comp. Ex. B-2 | 1 | 12 | 92 | 26.2 | 56 | spherical | monodisperse | 110 | 5.5 | 5.1 | 1.08 | 0.96 | 130 | 121 |

TABLE 4

| | Cleanability (LL) | Cleanability (durability) | Film-ing | HH image blur | Charge stability | Image density | Image graininess and sharpness | Fog | Toner scatter | Environ-mental preser-vability | Trans-fer prop-erty | Irreg-ularity | Flaw | Abra-sion wear (μm) |
|---|---|---|---|---|---|---|---|---|---|---|---|---|---|---|
| Ex. B-1 | B | B | B | B | A | A | B | B | B | B | B | B | A | 1.2 |
| Ex. B-2 | C | C | A | A | A | A | B | B | B | B | C | C | B | 3.2 |
| Ex. B-3 | A | B | C | C | A | A | B | B | C | B | B | B | A | 0.8 |
| Ex. B-4 | B | C | B | C | A | B | B | C | C | B | B | C | B | 3.7 |
| Ex. B-5 | C | C | A | A | A | A | A | B | B | C | C | C | A | 0.9 |
| Ex. B-6 | A | A | C | B | B | A | C | C | C | B | B | B | B | 2.8 |
| Ex. B-7 | C | B | B | B | B | A | B | C | B | C | B | B | B | 2.1 |
| Ex. B-8 | B | A | B | C | A | A | C | C | C | B | B | B | A | 1.6 |
| Ex. B-9 | A | A | B | B | A | A | B | B | C | B | B | B | A | 1.8 |
| Comp. Ex. B-1 | D | D | A | B | A | A | B | B | B | B | D | D | A | 0.8 |
| Comp. Ex. B-2 | B | B | D | D | B | B | D | D | D | B | D | D | C | 5.1 |

EXAMPLE C (Evaluation of Two-Component Developer)

A two-component developer for image evaluation was prepared by uniformly mixing 100 parts of carrier and each 7 parts of respective toners by means of Turbula mixer that can mix components through tumbling. The carrier was a ferrite carrier that was coated with a silicone resin in an average thickness of 0.5 μm and had an average particle diameter of 35 μm.

(Preparation of Carrier)

The carrier was prepared in the same manner as Example A described above.

<Apparatus for Evaluating Printed Image>

Toners obtained in Example C were evaluated by Apparatus A and Apparatus B. The Apparatus A was Ipsio 8000 (by Ricoh Co.) modified such that a contact charger, amorphous-silicon photoconductor, and oilless-surf fixing device were provided, vibrating bias voltages were applied as developing bias by duplicating DC with AC voltages, and the photoconductor, the charging device, and a cleaning device were integrally constructed to form a process cartridge. The Apparatus B was constructed by modifying the fixing device of Apparatus A into oilless IH fixing device. Ipsio 8000 described above is a full-color laser printer in which developing portions develop four colors in sequence on one belt photoconductor, the resulting images are transferred onto a intermediate transferor, then four-color images are transferred simultaneously. In this Example C, the four developing portions were filled with a developer, thus the images were evaluated under monocolor mode.

—Evaluation Items—

Evaluation items in terms of toners in Example C are as follows.

(i) Cleanability

Apparatuses X and Y were disposed at downstream of the cleaning device of the photoconductor, and a felt member was mounted to contact with Apparatuses X and Y. After 20,000-sheet successive output with chart images of 50% toner coverage under monocolor mode, the smear of the felt member was compared with the reference and was ranked by five steps of A to E. The order of cleanability is A>B>C>D>E; "A" means substantially no smear and the highest cleanability, and "E" means considerable smear and the lowest cleanability. The results are shown in Table 6.

(ii) Image Graininess and Sharpness

After 10,000-sheet successive output under monocolor mode using Apparatuses X and Y, image graininess and sharpness were visually evaluated. The result was rated as follows.

A: as superior as offset prints
B: slightly inferior to offset prints
C: slightly superior to conventional electrophotographic images
D: comparable to conventional electrophotographic images
E: inferior to conventional electrophotographic images (iii) Image Density After 150,000-sheet successive image output of 50% toner coverage under monocolor mode using Apparatuses X and Y, solid images were printed on sheets of plain paper (Type 6000, by Ricoh Co.), and the image density of the sheets was measured with X-Rite 938 (by X-Rite Co.). The result was rated as follows and shown in Table 6.

A: the image density was 1.8 or more and below 2.2
B: the image density was 1.4 or more and below 1.8
C: the image density was 1.2 or more and below 1.4
D: the image density was less than 1.2

(iv) Thin-Line Reproducibility

After 30,000-sheet successive image output of 50% toner coverage under monocolor mode using Apparatuses X and Y, thin-line images were printed on sheets of plain paper (Type 6000, by Ricoh Co.), and the bleeding of thin lines was compared with the reference and was ranked by five steps of A to E. The order of cleanability is A>B>C>D>E; "A" means the highest thin-line reproducibility, and "E" means the lowest thin-line reproducibility. The results are shown in Table 6.

(v) Voids within Letters

After 30,000-sheet successive image output of 50% toner coverage under monocolor mode using Apparatuses X and Y, letter images were printed on OHP sheets (Type DX, by Ricoh Co.), and the level of voids where the toner was absent in line images of letters was compared with the reference and was ranked by five steps of A to E. The order of cleanability is A>B>C>D>E; "A" means the lowest occurrences of voids, and "E" means the highest occurrences of voids. The results are shown in Table 6.

(vi) External Additive Embedding

The toner was stored at temperature 40° C. and relative humidity 80% for one week, then the toner was stirred for one hour in the developing unit of Apparatus X. Thereafter, the toner was observed by Model S-4200 field-emission scanning electron microscope (by Hitachi Co.) in terms of the embedded condition of the external additives. The result was rated as follows and shown in Table 6.

A: almost no occurrence of embedding into toner
B: a part of external additives were embedded
C: external additives appeared only at toner surface and almost all were embedded
D: no external additives appeared and substantially all were embedded Example C-1

—Preparation of Organic Fine-Particle Emulsion—

Into a reactor equipped with a stirring rod and a thermometer were poured 683 parts of water, 11 parts of sodium salt of sulfuric acid ester of ethylene oxide adduct of methacrylic acid (Eleminol RS-30, by Sanyo Chemical Industries Co.), 83 parts of styrene, 83 parts of methacrylic acid, 110 parts of butyl acrylate, and 1 part of ammonium persulfate; and the mixture was stirred at 400 rpm for 15 minutes to yield a white emulsion. The emulsion was heated to 75° C. and was allowed to react for 5 hours. The reaction mixture was further treated with 30 parts of a 1% aqueous solution of ammonium persulfate, was aged at 70° C. for 5 hours, thereby yielded an aqueous dispersion of vinyl resin i.e. a copolymer of styrene-methacrylic acid-butyl acrylate-sodium salt of sulfate of methacrylic acid-ethylene oxide adduct (hereinafter referring to as "Fine Particle Dispersion 1").

Fine Particle Dispersion 1 had a volume-average particle diameter of 105 nm by the analyzer LA-920 (by Horiba, Ltd.). A part of Fine Particle Dispersion 1 was dried to isolate the resin component. The resin component had a Tg of 59° C. and a mass-average molecular mass of about 150,000.

—Preparation of Aqueous Phase—

An opaque liquid was prepared by blending and stirring 990 parts of water, 83 parts of Fine Particle Dispersion 1, 37 parts of 48.5% aqueous solution of sodium dodecyldiphenylether disulfonate (Eleminol MON-7, by Sanyo Chemical Industries, Ltd.), and 90 parts of ethylacetate (hereinafter referring to as "Aqueous Phase 1").

—Synthesis of Ketimine Compound—

Into a reactor equipped with a stirring rod and a thermometer were poured 170 parts of isophoronediamine and 75 parts of methylethylketone, followed by reaction at 50° C. for 5 hours to yield a blocked amine having an amine value of 418 (hereinafter referring to as "Ketimine Compound 1").

—Preparation of Master Batch—

A total of 1200 parts of water, 40 parts of carbon black Regal 400R (by Cabot Co.), 60 parts of a polyester resin RS801 (Sanyo Chemical Industries Co.), and additional 60 parts of water were mixed in Henschel Mixer (by Mitsui Mining Co.). The mixture was kneaded at 120° C. for 45 minutes by a two-roll mill, cold-rolled, and milled by a pulverizer, thereby yielded carbon black Master Batch 1.

—Preparation of Oil Phase—

Into a reactor equipped with a stirring rod and a thermometer were poured 400 parts of Lower Molecular-Mass Polyester 1, 110 parts of carnauba wax, and 947 parts of ethylacetate. The mixture was heated at 80° C. for 5 hours with stirring and was then cooled to 30° C. over 1 hour. The mixture was further added with 500 parts of Master Batch 1 and 500 parts of ethylacetate with stirring for 1 hour, thereby yielded Material Solution 1.

Thereafter, 1324 parts of Material Solution 1 was poured into a vessel, and the wax therein were dispersed using a bead mill (Ultravisco-Mill, by Aimex Co.) at a liquid feeding speed of 1 kg/hr, a disc rotation speed of 6 m/sec, using zirconia beads 0.5 mm in diameter filled 80% by volume. The dispersing procedure was repeated three times. The dispersion was further added with 1324 parts of 65% ethylacetate solution of Lower Molecular-Mass Polyester 1, and the mixture was dispersed under the above conditions except that the dispersion procedure was one time to yield Pigment-Wax Dispersion 1.

—Emulsification—

Into a vessel were poured 1772 parts of Pigment-Wax Dispersion 1, 100 parts of 50% ethylacetate solution of Prepolymer 1 (number-average molecular mass: 3800, mass-average molecular mass: 15,000, Tg: 60° C., acid value: 0.5, hydroxyl group value: 51, and free isocyanate content: 1.53% by mass), and 8.5 parts of Ketimine Compound 1; and the mixture was mixed at 5,000 rpm for 1 minutes using TK Homo Mixer (by Tokushu Kika Kogyo Co.), then 1,200 parts of Aqueous Phase 1 were added, and the mixture was further mixed at 10,000 rpm for 20 minutes using the TK Homo Mixer, thereby yielded Emulsified Slurry 1.

—Removal of Organic Solvent—

Into a vessel equipped with a stirrer and a thermometer was poured Emulsified Slurry 1 and was heated at 30° C. for 8 hours to remove the solvents, and the slurry was aged at 45° C. for 4 hours, thereby yielded Dispersed Slurry 1.

—Washing—

A total of 100 parts of Emulsified Slurry 1 was filtered under a reduced pressure and was washed by the following procedures.

(1) The filtered cake and 100 parts of deionized water were mixed in TK Homo Mixer at 12,000 rpm for 10 minutes, and the mixture was filtered.

(2) The filtered cake prepared in (1) and 100 parts of 10% aqueous solution of sodium hydroxide were mixed in TK Homo Mixer at 12,000 rpm for 30 minutes, and the mixture was filtered under a reduced pressure.

(3) The filtered cake prepared in (2) and 100 parts of 10% hydrochloric acid were mixed in TK Homo Mixer at 12,000 rpm for 10 minutes, and the mixture was filtered.

(4) The filtered cake prepared in (3) and 300 parts of deionized water were mixed in TK Homo Mixer at 12,000 rpm for 10 minutes, and the mixture was filtered, wherein this washing procedure was repeated twice to yield a filtered cake.

—External-Additive Mixing 1—

To 100 parts of the filtered cake, 500 parts of deionized water was added to prepare Re-dispersed Slurry 1. Separately, 2 parts by mass of hydrophobic-treated silica having a primary-particle diameter of 120 nm (X-24, by Shin-Etsu Chemical Co.) was slowly added to the solution containing 0.2 part by mass of stearylamine acetate, 70 parts by mass of deionized water, and 30 parts by mass of methanol under stirring, thereby yielded a silica fine-particle dispersion of the first inorganic fine particles. The resulting silica fine-particle dispersion and the Re-dispersed Slurry 1 were mixed and stirred for one hour at room temperature, then filtered to obtain a filtered cake.

—Drying—

The filtered cake was dried at 45° C. for 48 hours in a circulating air dryer, then screened through a mesh of 75 μm opening, thereby toner particles were obtained.

—External-Additive Mixing 2—

The resulting toner particles of 100 parts by mass and hydrophobic silica (HDK 2000H, by Clariant in Japan) of 1.0 parts by mass as an external additive of the second inorganic fine particles were mixed by Henschel mixer at 2000 rpm of blade rotation and mixing period 30 second×5 times, then the mixture was screened through a mesh of 38 μm opening to remove coagulates, thereby Toner 1 was obtained.

—Toner Evaluation—

The Toner 1 was evaluated in terms of volume average particle diameter (Dv), Dv/Dn, primary-particle diameter, content Xa and Xb, remaining rate Za and Zb of the first inorganic fine particles and the second inorganic fine particles, and standard deviation σ of particle diameter distribution of the first inorganic fine particles. The remaining rate is determined in accordance with Measure Condition 1 described above.

A developer was prepared from Toner 1 in accordance with the Evaluation of Two-Component Developer described above, and the developer was evaluated in terms of the Evaluation Items described above using Apparatus A.

Example C-2

Toner 6 was prepared in the same manner as Toner 1, except that the silica in External-additive mixing 1 described above was changed into one part by mass of another silica of which the standard deviation was 40, and the blade rotation in External-additive mixing 2 described above was changed into 1600 rpm. The evaluations were carried out in the same manner as Example C-1, and the results are shown in Table 6.

Example C-3

Toner 7 was prepared in the same manner as Toner 1, except that the silica in External-additive mixing 1 described above was changed into one part by mass of another silica of which the standard deviation was 113, and the blade rotation in External-additive mixing 2 described above was changed into 2300 rpm. The evaluations were carried out in the same manner as Example C-1, and the results are shown in Table 6.

Example C-4

The evaluations were carried out in the same manner as Example C-1, except that Apparatus A was changed into Apparatus B, and the results are shown in Table 6.

Example C-5

Toner 8 was prepared in the same manner as Toner 1 of Example C-1, except that the hydrophobic-treated silica having a primary-particle diameter of 120 nm was changed into magnesium titanate having a primary-particle diameter of 150 nm (by Titan Kogyo Co.) to yield a magnesium titanate. The evaluations were carried out in the same manner as Example C-1, and the results are shown in Table 6.

TABLE 5

| | Toner DV (μm) | Toner Dv/Dn | Diameter of first particle(nm) | Diameter of second particle (nm) | Initial content Xa (%) | Initial content Xb (%) | Remaining rate Za (%) | Remaining rate Zb (%) | Standard deviation σ of first particles |
|---|---|---|---|---|---|---|---|---|---|
| Toner 1 | 7.6 | 1.15 | 120 | 12 | 2.1 | 1.1 | 88 | 80 | 11 |
| Toner 6 | | | | | 1.1 | 1.0 | 88 | 72 | 40 |
| Toner 7 | | | | | 1.1 | 1.0 | 85 | 92 | 113 |
| Toner 8 | | | 150 | | 2.1 | 1.1 | 87 | 76 | 25 |

TABLE 6

| | Toner | Evaluation apparatus | Cleanability | Image graininess and sharpness | Image density | Reproducibility of thin line | Void in letter | Embedding of external additive |
|---|---|---|---|---|---|---|---|---|
| Ex. C-1 | Toner 1 | X | A | B | A | B | B | B |
| Ex. C-2 | Toner 6 | X | A | A | A | A | A | A |
| Ex. C-3 | Toner 7 | X | A | A | A | A | A | A |
| Ex. C-4 | Toner 1 | Y | A | A | A | A | B | B |
| Ex. C-5 | Toner 8 | X | A | B | A | B | B | A |

EXAMPLE D (Evaluation of Two-Component Developer)

A two-component developer for image evaluation was prepared by uniformly mixing 100 parts of carrier and each 7 parts of respective toners by means of Turbula mixer that can mix components through tumbling. The carrier was a ferrite carrier that was coated with a silicone resin in an average thickness of 0.5 μm and had an average particle diameter of 35 μm.

| (Preparation of Carrier) | |
|---|---|
| Core material | |
| Mn ferrite particles[1*)] | 5000 parts |
| Coating material | |
| Toluene | 450 parts |
| Silicone resin SR2400[2*)] | 450 parts |
| Amino silane SH6020[3*)] | 10 parts |
| Carbon black | 10 parts |

[1*)]mass-average particle diameter: 35 μm
[2*)]by Toray Dow Corning Silicone Co., nonvolatile content: 50%
[3*)]by Toray Dow Corning Silicone Co.

The coating materials were dispersed by a stirrer for 10 minutes to prepare a coating liquid. The coating liquid and the core material were poured into a coating apparatus which was equipped with a rotary bottom-plate disc and a swirl-stream stirring blade within a fluidizing bed. The coating liquid was coated on the core material and was calcined at 250° C. for 2 hours to prepare the carrier. The remaining rate was evaluated in accordance with Remaining-Rate Evaluation Process 2 described above.

—Evaluation Items—

(i) Toner Scatter

An endurance test of 100,000-sheet successive output with chart images of 7% toner coverage was conducted for respective toners; then, toner contamination within the copier was evaluated visually. The result was rated as follows.

A: no contamination was observable

B: little contamination was observable and no troublesome

C: a little contamination was observable

D: considerable contamination was observable and troublesome (ii) Image Graininess Photographic images were output in monochrome and the level of graininess was evaluated visually. The result was rated as follows.

A: the image was as superior as offset prints

B: the image was slightly inferior to offset prints

C: the image was considerably inferior to offset prints

D: the image was substantially the same as conventional electrophotographic images thus was remarkably inferior (iii) Background Smear The difference ΔID was measured with respect to respective toners after an endurance test of 100,000-sheet successive output with chart images of 7% toner coverage. The result was rated as follows.

A: $\Delta ID \leqq 0.01$

B: $0.01 \leqq \Delta ID \leqq 0.02$

C, $0.02 \leqq \Delta ID$ (iv) Filming

An endurance test of 100,000-sheet successive output was conducted with chart images of 15% toner coverage in terms of the respective toners. The filming was determined visually and was rated as follows.

A: no occurrence of filming

B: filming was observed slightly

C: filming appeared on the way (v) Charge Stability

The difference of charge amount for each toner was measured by conducting an endurance test of 100,000-sheet successive output with chart images of 7% toner coverage. The charge amount difference was obtained from 1 g of developer with a blow off method. The result was rated as follows.

A: the difference was 51 μc/g or less

B: the difference was 10 μc/g or less

C: the difference was more than 10 μc/g (vi) cleanability

After an endurance test of 100,000-sheet successive output with chart images of 95% toner coverage, transfer residual toner on the photoconductor after cleaning step was transferred to a white paper sheet using Scotch tape (by Sumitomo 3M Co.), which was measured by Macbeth Reflective Densitometer RD514. The measurement was compared to the blank and rated as follows.

A: the difference from the blank was less than 0.01

B: the difference from the blank was 0.01 to 0.02

C: the difference from the blank was more than 0.02

[Production of Toner]

—Preparation of Organic Fine-Particle Emulsion—

Preparation Example 1

Into a reactor equipped with a stirring rod and a thermometer were poured 683 parts of water, 11 parts of sodium salt of sulfuric acid ester of ethylene oxide adduct of methacrylic acid (Eleminol RS-30, by Sanyo Chemical Industries Co.), 166 parts of methacrylic acid, 110 parts of butyl acrylate, and 1 part of ammonium persulfate; and the mixture was stirred at 3,800 rpm for 30 minutes to yield a white emulsion. The emulsion was heated to 75° C. and was allowed to react for 4 hours. The reaction mixture was further treated with 30 parts of a 1% aqueous solution of ammonium persulfate, was aged at 75° C. for 6 hours, thereby yielded an aqueous dispersion of vinyl resin i.e. a copolymer of methacrylic acid-butyl acrylate-sodium salt of sulfate of methacrylic acid-ethylene oxide adduct (hereinafter referring to as "Fine Particle Dispersion 1"). Fine Particle Dispersion 1 had a volume-average particle diameter of 110 nm by the analyzer LA-920. A part of Fine Particle Dispersion 1 was dried to isolate the resin component. The resin component had a Tg of 58° C. and a mass-average molecular mass of about 130,000.

—Preparation of Aqueous Phase—

Preparation Example 2

An opaque liquid was prepared by blending and stirring 990 parts of water, 83 parts of Fine Particle Dispersion 1, 37 parts of 48.3% aqueous solution of sodium dodecyldiphenylether disulfonate (Eleminol MON-7, by Sanyo Chemical Industries, Ltd.), and 90 parts of ethylacetate (hereinafter referring to as "Aqueous Phase 1").

—Preparation of Lower Molecular-Mass Polyester—

Preparation Example 3

Into a reactor equipped with a condenser, a stirrer, and a nitrogen gas feed tube were poured 229 parts of ethylene oxide (2 mole) adduct of bisphenol A, 529 parts of propylene oxide (3 mole) adduct of bisphenol A, 208 parts of terephthalic acid, 46 parts of adipic acid, and 2 parts of dibutyltin oxide. The mixture was reacted at 230° C. at normal atmospheric pressure for 7 hours and was further reacted at a reduced pressure of 10 mmHg to 15 mmHg for 5 hours. Thereafter, the reaction mixture was further reacted with 44 parts of trimellitic anhydride at 180° C. at normal atmospheric pressure for 1.8 hours, thereby yielded a reaction product (hereinafter referring to as "Lower Molecular-Mass Polyester 1"). The Lower Molecular-Mass Polyester 1 had a number-average molecular mass of 2,300, a mass-average molecular mass of 6,700, a Tg of 43° C., and an acid value of 25.

—Preparation of Intermediate Polyester—

Preparation Example 4

Into a reactor equipped with a condenser, a stirrer, and a nitrogen gas feed tube were poured 682 parts of ethylene oxide (2 mole) adduct of bisphenol A, 81 parts of a propylene oxide (2 mole) adduct of bisphenol A, 283 parts of terephthalic acid, 22 parts of trimellitic anhydride, and 2 parts of dibutyltin oxide. The mixture was reacted at 230° C. at normal atmospheric pressure for 7 hours, was further reacted under a reduced pressure of 10 mmHg to 15 mmHg for 5 hours, thereby yielded a reaction product having a number-average molecular mass of 2,200, a mass-average molecular mass of 9,700, a Tg of 54° C., an acid value of 0.5, and a hydroxyl value of 52 (hereinafter referring to as "Intermediate Polyester 1").

Then, into a reactor equipped with a condenser, a stirrer, and a nitrogen gas feed tube were poured 410 parts of Intermediate Polyester 1, 89 parts of isophorone diisocyanate, and 500 parts of ethylacetate, followed by reaction at 100° C. for 5 hours to yield a reaction product having a free isocyanate content of 1.53% by mass (hereinafter referring to as "Prepolymer 1").

—Synthesis of Ketimine Compound—

Preparation Example 5

Into a reactor equipped with a stirring rod and a thermometer were poured 170 parts of isophoronediamine and 75 parts of methylethylketone, followed by reaction at 50° C. for 4.5 hours to yield a reaction product having an amine value of 417 (hereinafter referring to as "Ketimine Compound 1").

—Preparation of Master Batch—

Preparation Example 6

A total of 1200 parts of water, 540 parts of carbon black (Printex 35, DBP absorption: 42 ml/100 g, pH: 9.5, by Degussa Co.), and 1200 parts of a polyester resin were mixed in Henschel Mixer (by Mitsui Mining Co.). The mixture was kneaded at 130° C. for one hour by a two-roll mill, cold-rolled, and milled by a pulverizer, thereby yielded Master Batch 1.

—Preparation of Oil Phase—

Preparation Example 7

Into a reactor equipped with a stirring rod and a thermometer were poured 378 parts of Lower Molecular-Mass Polyester 1, 100 parts of carnauba wax, and 947 parts of ethylacetate. The mixture was heated at 80° C. for 5 hours with stirring and was then cooled to 30° C. over 1 hour. The mixture was further treated with 500 parts of Master Batch 1 and 500 parts of ethylacetate with stirring for 1 hour, thereby yielded Material Solution 1.

Thereafter, 1324 parts of Material Solution 1 was poured into a vessel, and the components therein were dispersed using a bead mill (Ultravisco-Mill, by Aimex Co.) at a liquid feeding speed of 1 kg/hr, a disc rotation speed of 6 m/sec, using zirconia beads 0.5 mm in diameter filled 80% by volume. The dispersing procedure was repeated three times. The dispersion was further treated with 1324 parts of 65% ethylacetate solution of Lower Molecular-Mass Polyester 1, and the mixture was dispersed under the above conditions except that the dispersion procedure was repeated two times to yield Pigment-Wax Dispersion 1. Pigment-Wax Dispersion 1 had a solid content of 50% as determined by heating to 130° C. for 30 minutes.

—Emulsification and Solvent Removal—

Preparation Example 8

Into a vessel were poured 749 parts of Pigment-Wax Dispersion 1, 115 parts of Prepolymer 1, and 2.9 parts of Ketimine Compound 1; and the mixture was mixed at 5,000 rpm for 2 minutes using TK Homo Mixer (by Tokushu Kika Kogyo Co.), then 1,200 parts of Aqueous Phase 1 were added, and the mixture was further mixed at 13,000 rpm for 25 minutes using the TK Homo Mixer, thereby yielded Emulsified Slurry 1.

Into a vessel equipped with a stirrer and a thermometer was poured Emulsified Slurry 1 and was heated at 30° C. for 8 hours to remove the solvents, and the slurry was aged at 45° C. for 7 hours, thereby yielded Dispersed Slurry 1.

—Washing and Drying—

Preparation Example 9

A total of 100 parts of Emulsified Slurry 1 was filtered under a reduced pressure and was washed by the following procedures.

(1) The filtered cake and 100 parts of deionized water were mixed in TK Homo Mixer at 12,000 rpm for 10 minutes, and the mixture was filtered.

(2) The filtered cake prepared in (1) and 100 parts of 10% aqueous solution of sodium hydroxide were mixed in TK Homo Mixer at 12,000 rpm for 30 minutes, and the mixture was filtered under a reduced pressure.

(3) The filtered cake prepared in (2) and 100 parts of 10% hydrochloric acid were mixed in TK Homo Mixer at 12,000 rpm for 10 minutes, and the mixture was filtered.

(4) The filtered cake prepared in (3) and 300 parts of deionized water were mixed in TK Homo Mixer at 12,000 rpm for 10 minutes, and the mixture was filtered, wherein this washing procedure was repeated twice to yield Filtered Cake 1. The Filtered Cake 1 was dried at 45° C. for 48 hours in a circulating air dryer. Thereafter, the mixture was screened through a mesh of 75 μm opening, thereby Toner Raw Particles 1 was obtained. The properties are shown in Table 7 and the evaluations are shown in Table 8.

Example D-1

The toner raw particles, prepared by a polymerization process using carnauba wax, were treated to remove fine particles and coarse particles. A total of 100 parts of the treated toner fine particles, 1.5 parts of silica fine particles having an average particle diameter of 10 nm, 1.0 part of silica fine particles having an average particle diameter of 140 nm, and 0.5 part of titanium oxide fine particles having an average particle diameter of 15 nm were mixed by Henschel mixer in a mixing condition of 5 cycles of mixing at 2000 rpm for 90 seconds and allowing to stand for 120 seconds to prepare an electrophotographic toner.

Example D-2

The toner raw particles, prepared by a polymerization process using carnauba wax, were treated to remove fine particles and coarse particles. A total of 100 parts of the treated toner fine particles, 1.5 parts of silica fine particles having an average particle diameter of 10 nm, 1.0 part of silica fine particles having an average particle diameter of 140 nm, and 0.5 part of titanium oxide fine particles having an average particle diameter of 15 nm were mixed by Super mixer in a mixing condition of 5 cycles of mixing at 2400 rpm for 90 seconds and allowing to stand for 120 seconds to prepare an electrophotographic toner.

Example D-3

The toner raw particles, prepared by a polymerization process using carnauba wax, were treated to remove fine particles and coarse particles. A total of 100 parts of the treated toner fine particles, 1.5 parts of silica fine particles having an average particle diameter of 10 nm, 1.0 part of silica fine particles having an average particle diameter of 140 nm, and 0.5 part of titanium oxide fine particles having an average particle diameter of 15 nm were mixed by Q mixer in a mixing condition of 5 cycles of mixing at 6000 rpm for 90 seconds and allowing to stand for 120 seconds to prepare an electrophotographic toner.

Comparative Example D-1

The toner raw particles, prepared by a polymerization process using carnauba wax, were treated to remove fine particles and coarse particles. A total of 100 parts of the treated toner fine particles, 1.5 parts of silica fine particles having an average particle diameter of 10 nm, 1.0 part of silica fine particles having an average particle diameter of 140 nm, and 0.5 part of titanium oxide fine particles having an average particle diameter of 15 nm were mixed by Henschel mixer in a mixing condition of 5 cycles of mixing at 3000 rpm for 90 seconds and allowing to stand for 120 seconds. Then, the resulting mixture was heated to fix the external additives, thereby yielded an electrophotographic toner.

Example D-4

The toner raw particles of Example D-1 were not treated to remove fine particles and coarse particles. A total of 100 parts of the toner raw particles, 1.5 parts of silica fine particles having an average particle diameter of 10 nm, 1.0 part of silica fine particles having an average particle diameter of 140 nm, and 0.5 part of titanium oxide fine particles having an average particle diameter of 15 nm were mixed by Henschel mixer in a mixing condition of 5 cycles of mixing at 2000 rpm for 90 seconds and allowing to stand for 120 seconds to prepare an electrophotographic toner.

Example D-5

The toner raw particles were classified into a volume average particle diameter of 9 μm, thereafter were treated to remove fine particles and coarse particles by a centrifugal process. A total of 100 parts of the treated toner fine particles, 1.5 parts of silica fine particles having an average particle diameter of 10 nm, 1.0 part of silica fine particles having an average particle diameter of 140 nm, and 0.5 part of titanium oxide fine particles having an average particle diameter of 15 nm were mixed by Henschel mixer in a mixing condition of 5 cycles of mixing at 2000 rpm for 90 seconds and allowing to stand for 120 seconds. Then, the resulting mixture was heated to fix the external additives, thereby yielded an electrophotographic toner.

Example D-6

An electrophotographic toner was prepared in the same manner as Example D-1, except that the carnauba wax was changed into an ester wax.

Example D-7

An electrophotographic toner was prepared in the same manner as Example D-1, except that the toner raw particles were produced by the milling process in place of the polymerization process. Namely, the following ingredients were melted and kneaded, then crushed after cooling, then milled by an air-jet mill to produce fine particles, thereafter classified to prepare toner raw particles having a mass-average particle diameter of 5 μm.

| | |
|---|---|
| Binder resin: polyester resin<br>number-average molecular mass: 3,700<br>mass-average molecular mass: 21,000<br>glass transition temperature (Tg): 61° C.<br>softening temperature: 118° C. | 100 parts |
| Colorant: Cu phthalocyanine pigment C.I.P.B. 15:3 | 8 parts |
| Charge control agent: zinc salicylate | 1 part |
| Releasant: carnauba wax (melting point: 61° C.) | 6.5 parts |

The capacity of mixers in Example D was as follows.

Henschel mixer: 20 liters

Super mixer: 200 liters

Q mixer: 20 liters

TABLE 7

| | Toner production process | Silica average particle size 10 nm | Silica average particle size 140 nm | Titanium oxide average particle size 15 nm | Volume average diameter (μm) | Dv/Dn | Fine particle content (%) | Circu-larity | Wax species | Wax content (%) | Remaining rate of titanium oxide after ultrasonic | Remaining rate of silica after ultrasonic |
|---|---|---|---|---|---|---|---|---|---|---|---|---|
| Ex. D-1 | polymerization | exist | exist | exist | 5.8 | 1.10 | 8.2 | 0.95 | carnauba | 6.1 | 81 | 67 |
| Ex. D-2 | polymerization | exist | exist | exist | 5.7 | 1.12 | 9.6 | 0.96 | carnauba | 6.0 | 79 | 51 |
| Ex. D-3 | polymerization | exist | exist | exist | 5.8 | 1.10 | 7.9 | 0.96 | carnauba | 6.0 | 97 | 85 |
| Ex. D-4 | polymerization | exist | exist | exist | 5.6 | 1.20 | 16.4 | 0.93 | carnauba | 5.9 | 80 | 63 |
| Ex. D-5 | polymerization | exist | exist | exist | 9.5 | 1.20 | 3.7 | 0.95 | carnauba | 6.3 | 78 | 64 |
| Ex. D-6 | polymerization | exist | exist | exist | 5.5 | 1.16 | 8.8 | 0.96 | ester | 5.8 | 83 | 67 |
| Ex. D-7 | milling | exist | exist | exist | 7.8 | 1.23 | 9.8 | 0.92 | carnauba | 6.0 | 82 | 74 |
| Comp. Ex. D-1 | polymerization | exist | exist | exist | 5.7 | 1.13 | 7.9 | 0.96 | carnauba | 6.2 | 98 | 92 |

TABLE 8

| | Background smear | Filming | Image graininess | Toner scatter | Charge stability | Cleanability |
|---|---|---|---|---|---|---|
| Ex. D-1 | A | A | B | A | A | A |
| Ex. D-2 | A | A | B | B | A | A |
| Ex. D-3 | A | A | B | A | A | A |
| Ex. D-4 | B | A | B | C | A | B |
| Ex. D-5 | A | A | C | A | A | A |
| Ex. D-6 | A | B | B | B | A | B |
| Ex. D-7 | A | A | C | A | A | A |
| Comp. Ex. D-1 | B | A | B | B | B | C |

What is claimed is:

1. A toner for developing an electrostatic image comprising:

toner particles, and an external additive, wherein the toner particles comprise a binder resin and a colorant, the external additive is located on the surface of the toner particles, and when the toner is dispersed in a surfactant-containing electrolyte at 20 W output power and 20 kHz frequency for one minute by means of an ultrasonic homogenizer, 7% to 50% of the external additive is liberated from the surface of the toner particles.

2. The toner for developing an electrostatic image according to claim 1, wherein when the toner is so dispersed in said surfactant-containing electrolyte, 0.1 part to 0.7 part of the external additive, based on 100 parts of the toner, liberates from the surface of the toner particles.

3. The toner for developing an electrostatic image according to claim 1, wherein the external additive comprises a compound selected from the group consisting of metal oxides, metal nitrides, and metal carbides.

4. The toner for developing an electrostatic image according to claim 1, wherein the toner comprises an external additive having a number-average particle diameter of 8 nm to 80 nm and another external additive having a number-average particle diameter of 120 nm to 300 nm.

5. The toner for developing an electrostatic image according to claim 1, wherein the toner is produced through mixing the external additive with a mixing medium under a dry-mixing condition.

6. The toner for developing an electrostatic image according to claim 1, wherein the toner is produced through mixing the external additive under a wet-mixing condition.

7. The toner for developing an electrostatic image according to claim 1, wherein the toner further comprises a metal stearate.

8. The toner for developing an electrostatic image according to claim 1, wherein the toner is a color toner.

9. The toner for developing an electrostatic image according to claim 1, wherein the toner has an average circularity of 0.94 or more.

10. The toner for developing an electrostatic image according to claim 1, wherein the toner has Dv of 3.0 μm to 8.0 μm and Dv/Dn of 1.00 to 1.40 (Dv: volume-average particle diameter of toner particles, Dn: number-average particle diameter of toner particles).

11. The toner for developing an electrostatic image according to claim 1, wherein the toner has SF-1 of 100 to 180 and SF-2 of 100 to 180, in which SF-1 and SF-2 mean as follows:

$$SF\text{-}1=\{(MXLNG)^2/AREA\}\times(100\pi/4)$$

$$SF\text{-}2=\{(PERI)^2/AREA\}\times(100/4\pi)$$

MXLNG: maximum length of toner-particle image,
PERI: peripheral length of toner-particle image, and
AREA: area of toner-particle image.

12. The toner for developing an electrostatic image according to claim 1, wherein maximum length r1, minimum length r2, and thickness r3 of the toner particles exhibit the following relation:

$$0.5\leqq r2/r1\leqq 1.0,$$

$$0.7\leqq r3/r2\leqq 1.0, \text{ and}$$

$$r1\geqq r2\geqq r3.$$

13. The toner for developing an electrostatic image according to claim 1, wherein the toner is produced through at least one of crosslinking reactions and elongation reactions of a toner composition in an aqueous medium under presence of resin fine particles, and the toner composition comprises a polymerizable compound that has a site capable of reacting with a compound having an active hydrogen group; and polyester, a colorant, and a releasant.

14. The toner for developing an electrostatic image according to claim 1, wherein the external additive comprises first inorganic fine particles having a primary-particle diameter of 50 nm to 300 nm and second inorganic fine particles having a primary-particle diameter of 5 nm to 30 nm, the remaining rate Za of the first inorganic fine particles is 80% to 90%, and the remaining rate Zb of the second inorganic fine particles is 70% to 95%; wherein Za is determined by Ya/Xa, and Xa is the content of the first inorganic fine particles in the toner, Ya is the content of the first inorganic fine particles remaining in the toner after exposing the toner to ultrasonic wave of 25 kHz frequency at 20 W output power for one minute within a liquid containing an surfactant; Zb is determined by Yb/Xb, and Xb is the content of the second inorganic fine particles in the toner, Yb is the content of the second inorganic fine particles remaining in the toner after exposing the toner to ultrasonic wave of 25 kHz frequency at 20 W output power for one minute within a liquid containing a surfactant.

15. The toner for developing an electrostatic image according to claim 14, wherein Xa is 0.5% by mass to 6.0% by mass, and Xb is 0.2% by mass to 5.0% by mass.

16. The toner for developing an electrostatic image according to claim 14, wherein the first inorganic fine particles satisfy the relation of $R/4\leqq\sigma\leqq R$, in which R is an average primary-particle diameter of the first inorganic fine particles, and σ is the standard deviation of the primary-particle diameter distribution.

17. The toner for developing an electrostatic image according to claim 14, wherein the first inorganic fine particles are silica.

18. The toner for developing an electrostatic image according to claim 1, wherein the external additive contains at least titanium oxide and silica, the remaining rate of the titanium oxide is 75% by mass or more and the remaining rate of the silica is 85% by mass or less, and the remaining rate of the titanium oxide is higher than the remaining rate of the silica, wherein the remaining rate means the content of the titanium oxide or silica remaining in the toner after exposing the toner to ultrasonic wave of 20 kHz frequency at 20 W output power for one minute within a liquid containing a surfactant.

19. The toner for developing an electrostatic image according to claim 18, wherein the remaining rate of the titanium oxide is 98% by mass or less.

20. The toner for developing an electrostatic image according to claim 18, wherein the remaining rate of the silica is 50% by mass or more.

21. The toner for developing an electrostatic image according to claim 18, wherein the silica has an average primary-particle diameter of 80 nm to 500 nm.

22. The toner for developing an electrostatic image according to claim 18, wherein the toner further comprises a wax.

23. The toner for developing an electrostatic image according to claim 22, wherein the wax is carnauba wax.

24. The toner for developing an electrostatic image according to claim 22, wherein the content of the wax is 5% by mass or more in the toner.

25. The toner for developing an electrostatic image according to claim 1, wherein the content of fine particles having a particle diameter of 3 μm or less is 10% by mass or less.

26. A two-component developer for developing an electrostatic image formed on a photoconductor, comprising:

a toner for developing an electrostatic image, and a magnetic carrier, wherein the toner contains toner particles that comprise a binder resin and a colorant, and an external additive that is located on the surface of the toner particles, and when the toner is dispersed in a surfactant-containing electrolyte at 20 W output power and 20 kHz frequency for one minute by means of an ultrasonic homogenizer, 7% to 50% of the external additive is liberated from the surface of the toner particles.

27. A monocomponent developer for developing an electrostatic image formed on a photoconductor, comprising:

a toner for developing an electrostatic image, wherein the toner contains toner particles that comprise a binder resin and a colorant, and an external additive that is located on the surface of the toner particles, and when the toner is dispersed in a surfactant-containing electrolyte at 20 W output power and 20 kHz frequency for one minute by means of an ultrasonic homogenizer, 7% to 50% of the external additive is liberated from the surface of the toner particles.

28. An image forming apparatus, comprising:

a photoconductor, a charging unit configured to charge the photoconductor uniformly, an exposing unit configured to expose the charged photoconductor depending on image data to form an electrostatic latent image, a developing unit configured to develop the electrostatic latent image by means of a developer to form a toner image, a transferring unit configured to transfer the toner image onto a transfer material, and a cleaning unit configured to clean the surface of the photoconductor, a developer comprising a toner, wherein the toner contains toner particles that comprise a binder resin and a colorant, and an external additive that is located on the surface of the toner particles, and when the toner is dispersed in a surfactant-containing electrolyte at 20 W output power and 20 kHz frequency for one minute by means of an ultrasonic homogenizer, 7% to 50% of the external additive is liberated from the surface of the toner particles.

29. The image forming apparatus according to claim 28, wherein the photoconductor contains a filler, and the content of the filler is 4% by volume to 20% by volume at the region from the photoconductor surface to 5 μm depth.

30. The image forming apparatus according to claim 29, wherein the photoconductor contains the filler at the uppermost layer, and Vickers hardness is 20.6 to 50.0 at the uppermost layer.

31. The image forming apparatus according to claim 29, wherein the filler contained within the photoconductor is inorganic fine particles having a whiteness of 60 to 100 determined in accordance with JIS P 8148.

32. The image forming apparatus according to claim 29, wherein the filler is alumina particles of which the number average particle diameter is 100 nm to 500 nm.

33. The image forming apparatus according to claim 28, wherein the cleaning unit comprises an elastomeric cleaning blade.

34. The image forming apparatus according to claim 28, wherein the external additive has a number-average particle diameter of 80 nm to 500 nm.

35. The image forming apparatus according to claim 28, wherein the external additive contains at least one species of silica, alumina, and titanium oxide.

36. The image forming apparatus according to claim 28, wherein the cleaning unit comprises a cleaning blade made of polyurethane.

37. The image forming apparatus according to claim 28, wherein the cleaning is performed through a counter contact at a contact angle of 15° to 40° between the cleaning blade and the photoconductor.

38. The image forming apparatus according to claim 28, wherein the cleaning is performed at a contact pressure of 5 $g/cm^2$ to 50 $g/cm^2$ between the cleaning blade and the photoconductor.

39. The image forming apparatus according to claim 28, wherein the image forming apparatus comprises a photoconductor, and a process cartridge detachably attached thereto.

40. The image forming apparatus according to claim 28, wherein the image forming apparatus further comprises a heated revolution body, a pressurized revolution body that is disposed oppositely to the heated revolution body, and a fixing unit configured to fix a toner image.

41. The image forming apparatus according to claim 28, wherein the fixing unit comprises a heating body that is equipped with a heater, a film that contacts with the heating body, and a pressuring body that contacts with the heating body through the film, and a toner image is fixed on a recording material by passing the recording material between the film and the pressuring body.

42. The image forming apparatus according to claim 28, wherein the heating member of the fixing unit is formed from a magnetic metal, and heated through electromagnetic induction.

43. The image forming apparatus according to claim 42, wherein the electromagnetic induction device is disposed outside the heated revolution body.

44. A process cartridge comprising:

a photoconductor, a developing unit configured to develop an electrostatic latent image by means of a developer to form a toner image, and a developer comprising a toner, wherein the process cartridge is detachably attached to an mage forming apparatus to form a unitary construction, the toner contains toner particles that comprise a binder resin and a colorant, and an external additive that is located on the surface of the toner particles, and when the toner is dispersed in a surfactant-containing electrolyte at 20 W output power and 20 kHz frequency for one minute by means of an ultrasonic homogenizer, 7% to 50% of the external additive is liberated from the surface of the toner particles.

45. An image forming method comprising:

charging a photoconductor, exposing the charged photoconductor to form an electrostatic latent image, developing an electrostatic latent image by means of a developer comprising a toner to form a toner image, and transferring the toner image onto a transferring material, wherein the toner contains toner particles that comprise a binder resin and a colorant, and an external additive that is located on the surface of the toner particles, and when the toner is dispersed in a surfactant-containing electrolyte at 20 W output power and 20 kHz frequency for one minute by means of an ultrasonic homogenizer, 7% to 50% of the external additive is liberated from the surface of the toner particles.

* * * * *